US012252332B2

(12) United States Patent
Skeid et al.

(10) Patent No.: US 12,252,332 B2
(45) **Date of Patent: *Mar. 18, 2025**

(54) INTERMODAL CONTAINER

(71) Applicant: SHARKCAGE INC., San Antonio, TX (US)

(72) Inventors: Eirik Skeid, Oslo (NO); Andriy Koba, Kyiv Region (UA)

( * ) Notice: Subject to any disclaimer, the term of this patent is extended or adjusted under 35 U.S.C. 154(b) by 0 days.

This patent is subject to a terminal disclaimer.

(21) Appl. No.: 18/736,773

(22) Filed: Jun. 7, 2024

(65) Prior Publication Data

US 2024/0327104 A1 Oct. 3, 2024

Related U.S. Application Data

(63) Continuation of application No. 18/100,862, filed on Jan. 24, 2023, now Pat. No. 12,030,711.

(51) Int. Cl.

| | |
|---|---|
| ***B65D 88/00*** | (2006.01) |
| ***B65D 85/06*** | (2006.01) |
| ***B65D 88/10*** | (2006.01) |
| ***B65D 88/52*** | (2006.01) |

(52) U.S. Cl.

CPC ..... *B65D 85/06* (2013.01); *B65D 88/005* (2013.01); *B65D 88/10* (2013.01); *B65D 88/52* (2013.01); *B65D 2585/686* (2013.01)

(58) Field of Classification Search

CPC ..... B65D 88/10; B65D 88/12; B65D 88/02; B65D 88/52; B65D 88/54; B65D 85/06; B65D 88/005; B65D 2585/686

USPC ..... 206/304

See application file for complete search history.

(56) References Cited

U.S. PATENT DOCUMENTS

| | | | | |
|---|---|---|---|---|
| 4,875,811 | A * | 10/1989 | Merrett | B60P 3/426 222/105 |
| 5,092,106 | A * | 3/1992 | Doster | B66F 9/18 53/409 |
| 12,030,711 | B1 * | 7/2024 | Skeid | B65D 88/10 |
| 2014/0299596 | A1 * | 10/2014 | Kochanowski | B65D 88/524 220/1.5 |
| 2018/0237216 | A1 * | 8/2018 | Saer | B65D 90/004 |
| 2022/0234817 | A1 * | 7/2022 | Gunn | B65D 88/022 |

* cited by examiner

*Primary Examiner* — Jacob K Ackun
(74) *Attorney, Agent, or Firm* — Michael A. Blake

(57) ABSTRACT

An intermodal container comprising: a bottom frame; a first side end wall configured to slide into a first side of the bottom frame, the first side end wall is height adjustable with respect to the bottom frame; a second side end wall configured to slide into a second side of the bottom frame, the second side opposite of the first side, the second side end wall is height adjustable with respect to the bottom frame; a first vertical limiting member configured to attach to the top of the first side end wall and the second side end wall; where the intermodal container is configured to store, transport, and secure items; and where the first vertical limiting member is configured to limit items from moving in a vertical direction.

12 Claims, 51 Drawing Sheets

INTERMODAL CONTAINER

CROSS-REFERENCES

This patent application is a continuation of U.S. patent application Ser. No. 18/100,862 filed on Jan. 24, 2023 by Eirik Skeid and Andriy Koba, entitled "INTERMODAL CONTAINER", which application is fully incorporated by reference herein.

TECHNICAL FIELD

The invention relates to transport containers, and, more particularly, to intermodal transport containers that efficiently use the available space in a transportation means.

BACKGROUND

There is a need to package large quantities of different sizes vehicle wheels for transport. The primary means of transportation are shipping containers and as secondary loads in vehicles, such as pick up trucks, Humvees, tractors, trailers, etc. Therefore, the wheels need to be packed on an apparatus that is movable and transportable because packing of the wheels may occur prior to loading in container, trucks, ships, etc. The wheel weights may range from about 50 lbs. to about 1000 lbs. or more, thus the apparatus needs to be strong enough to support heavy loads. Additionally, there is a need to maximize the available space inside of the shipping container or truck (or other vehicle carrying a secondary load) by volume. Government regulations now require that the wheels should be stored vertically to extend the life of the wheels while in storage. It has been determined that the packing of wheels on top of each other cause the wheels to deteriorate in storage.

Currently, the commercial practice of packing wheels for shipping in trucks is to have them individually loaded and off loaded by people. This is time intensive, and risks injury to those loading and unloading the wheels. For other transport, wheels are packed flat on wooden pallets often leads to flat stacking of wheels in violation of government regulations.

Thus there is a need for an intermodal container that overcomes the above listed and other disadvantages.

SUMMARY OF THE INVENTION

The invention relates to an intermodal container comprising: a bottom frame; a first side end wall configured to slide into a first side of the bottom frame, the first side end wall is height adjustable with respect to the bottom frame; a second side end wall configured to slide into a second side of the bottom frame, the second side opposite of the first side, the second side end wall is height adjustable with respect to the bottom frame; a first vertical limiting member configured to attach to the top of the first side end wall and the second side end wall; where the intermodal container is configured to store, transport, and secure items; and where the first vertical limiting member is configured to limit items from moving in a vertical direction.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
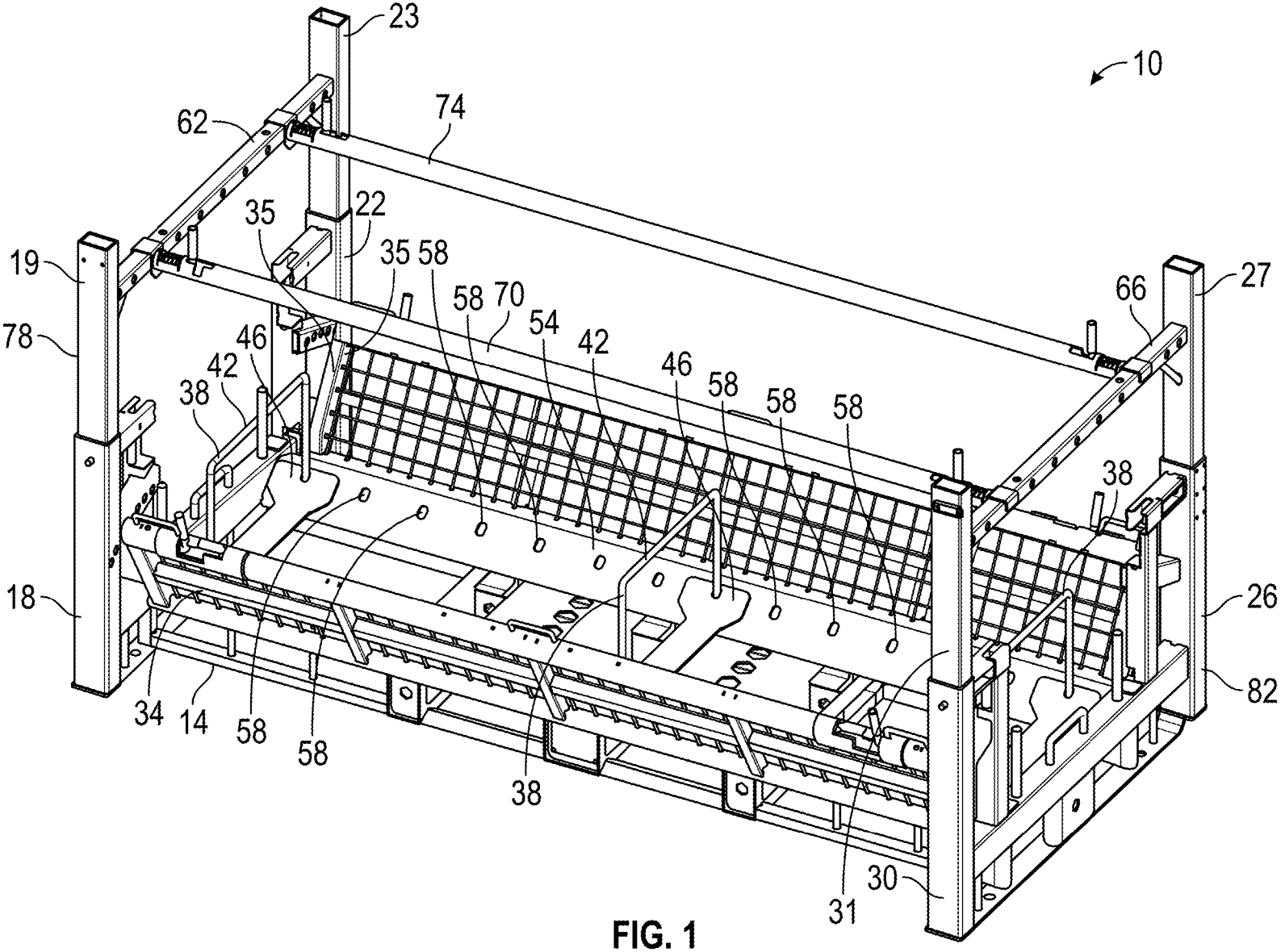
FIG. 1 is a perspective view of one embodiment of the disclosed intermodal container.

The intermodal container is designed to make it easy to get wheels in and out of the container. Front gates and rear gates were designed to use like a "ramp" for which one can roll in and roll out wheels. The front and rear gates may be locked with spring-loaded bars from both sides. The gates are designed to secure the wheels from rolling out of the intermodal container, as well as securing other items. Also, the intermodal container cage is designed to be symmetrical so that a user has access to the wheels from the front and back of the cage The intermodal container is designed to store, transport, and secure wheels of varying sizes. The end walls and front gates have hole patterns, one a user can use the hole patterns to choose a position according to the dimensions of the wheels to secure it in place. The intermodal container may be able to secure, store, transport wheels and tires, in sizes from about 28" to about 59" in outer diameter. The intermodal container is designed to secure wheels during transport. The intermodal container is designed with two removable top vertical members to prevent wheels from shifting and moving, and even unexpectedly and dangerously exiting the intermodal container during transportation, which may be due to negative G forces. The top vertical members prevent movements to the top. The top vertical members may have spring-loaded bars, and are designed to change position depending on the diameter of the wheels. The intermodal container has adjustable and removable vertical limiting top members which secure the wheels. The vertical limiting top members are not welded on to the end walls which enables smoother sliding up and down of the end walls. The intermodal container can be stored more efficiently when not fully assembled enabling more efficient transport and storage when not in use. The intermodal container is designed with removable divider walls that are designed to prevent the tipping of wheels to the side of the intermodal container when not fully loaded. The divider walls may be installed in different positions and are easy to change and choose the right position. The intermodal container can be stored more efficiently when not fully assembled enabling more efficient transport and storage when not in use. The intermodal container can be disassembled and stored taking up less space. The intermodal container has been designed such that a side of the bottom frame is open and then a second frame on the top can go deeply to the first frame. This means that seven (7) disassembled intermodal containers can be stored in the space of two (2) assembled intermodal containers. The intermodal container is designed so that the wheels are secured by a gate and the intermodal container gate can be operated without standing in front of it where the wheels are to be rolled out, reducing the risk of a user being hurt by a heavy wheel during opening and loading and unloading of the intermodal container. The intermodal container has been designed to improve the lock on the front gates, which allows a user to open the gates and stand to the side of the intermodal container, to prevent injury from loading and unloading of the wheels. The intermodal container is designed with fewer beams, leaving only structure where it is needed for the storing and securing the wheels hence reduce weight and cost. The intermodal container has been designed to decrease the quantity of tubes and profile to reduce weight and cost. The intermodal container has reduced the number of beams such that only the beams required to hold the wheels in place are left. In one embodiment, the intermodal container when assembled in a low profile configuration (with the side rails 62, 66 at their lowest positions) may have the following dimensions: height about 44 inches; length about 84 inches, depth about 43 inches. In the same embodiment, the intermodal container when assembled in a high profile configuration (with the side rails 62, 66 at their highest positions) may have the following dimensions: height about 62 inches; length about 84 inches, depth about 43 inches.

FIG. 1 is a perspective view of one embodiment of the disclosed intermodal container 10. The intermodal container 10 may also be a called a "cage". The cage 10 comprises a bottom frame 14. The bottom frame 14 may comprise four corner posts 18, 22, 26, 30, and a front gate 34 that is configured to swing in and out of the bottom frame 14. The bottom frame 14 may also comprise a rear gate 35 that is configured to swing in and out of the bottom frame 14. The corner posts 18, 22, 26, 30 may be in slideable communication with extensible members 19, 23, 27, 31. The extensible members can be extended or retracted relative to their respective corner posts 18, 22, 26, 30 to change the size of the cage 10 so that it can handle various sized objects, like bigger wheels or smaller wheels. The frame 14 may comprise a plurality of removable divider walls 38. The divider walls 38 may comprise an angled bar 42 and bottom member 46. The bottom frame 14 may comprise a front bottom rail (not visible in this view), and a rear bottom rail 54. The front bottom rail and rear bottom rail 54 may have a plurality of holes 58. The divider walls 38 are configured to slide into the holes 58 on both bottom rails 50, 54. The bottom member 46 is configured to sit flush against the angled bottom rails 50, 54. The cage 10 also comprises a first side rail 62 connected to corner posts 18 and 22, and a second side rail 66 connected to corner posts 26, 30. Attached to the first side rail 62 and second side rail 66 is a first vertical limiting top member 70 and a second vertical limiting top member 74. First side rail 62, and extensible members 19, 23 form a first side end wall 78. Second side rail 66, and extensible members 27, 31 form a second side end wall 82. The first side rail 62 and second side rail 66 may be referred to as the top of the first and second side end walls 78, 82 respectively.

Figure 2:
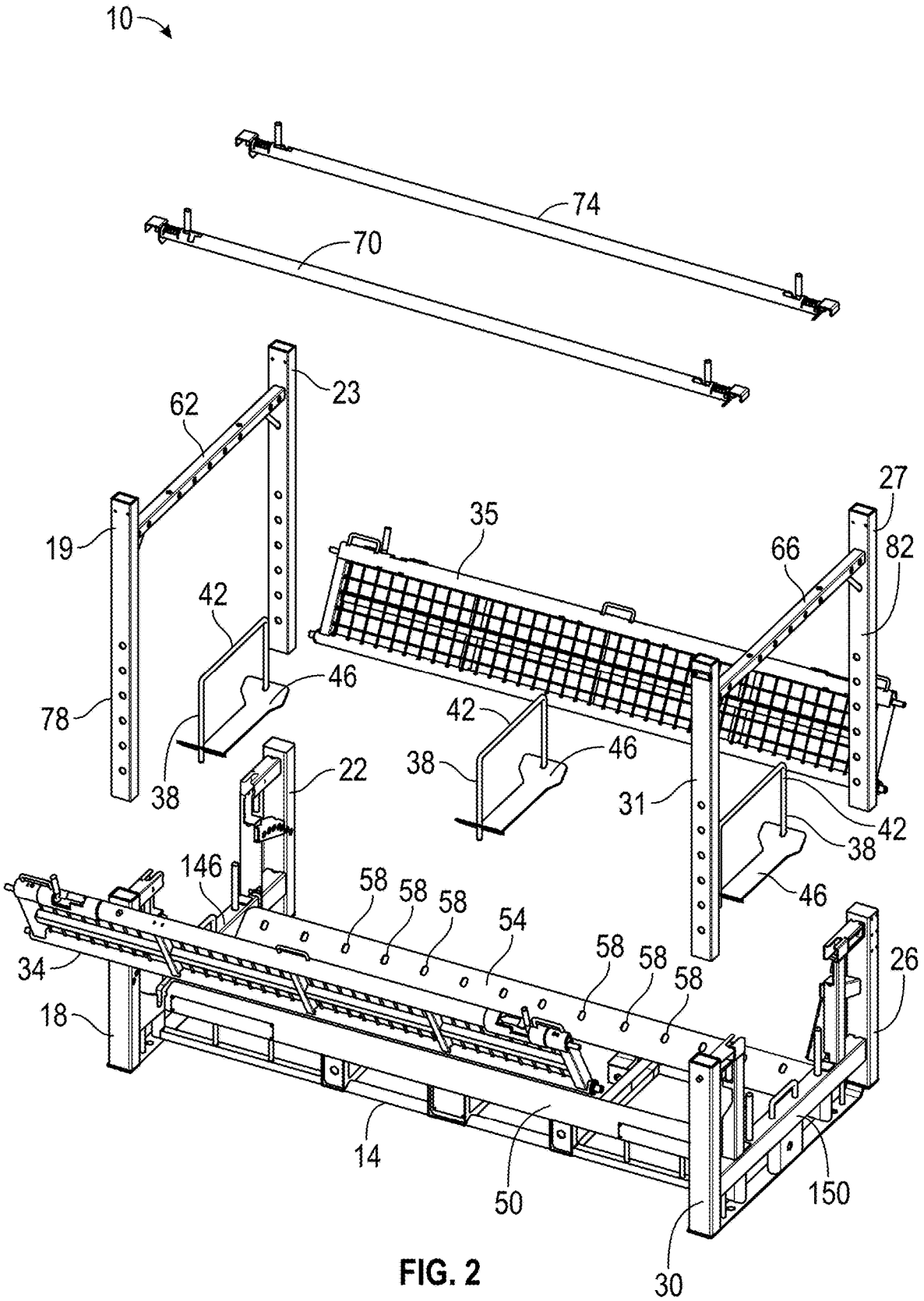
FIG. 2 is an exploded view of the cage from FIG. 1.

FIG. 2 is an exploded view of the cage 10 from FIG. 1. A first side bottom member 146 attaches to the first corner post 18 and second corner post 22. A second side bottom member 150 attaches to the third corner post 26 and the fourth corner post 30. The front bottom rail 50 is attached to and located between the first side bottom member 146 and second side bottom member 150. The rear bottom rail 54 is attached to and located between the first side bottom member 146 and second side bottom member 150.

Figure 3:
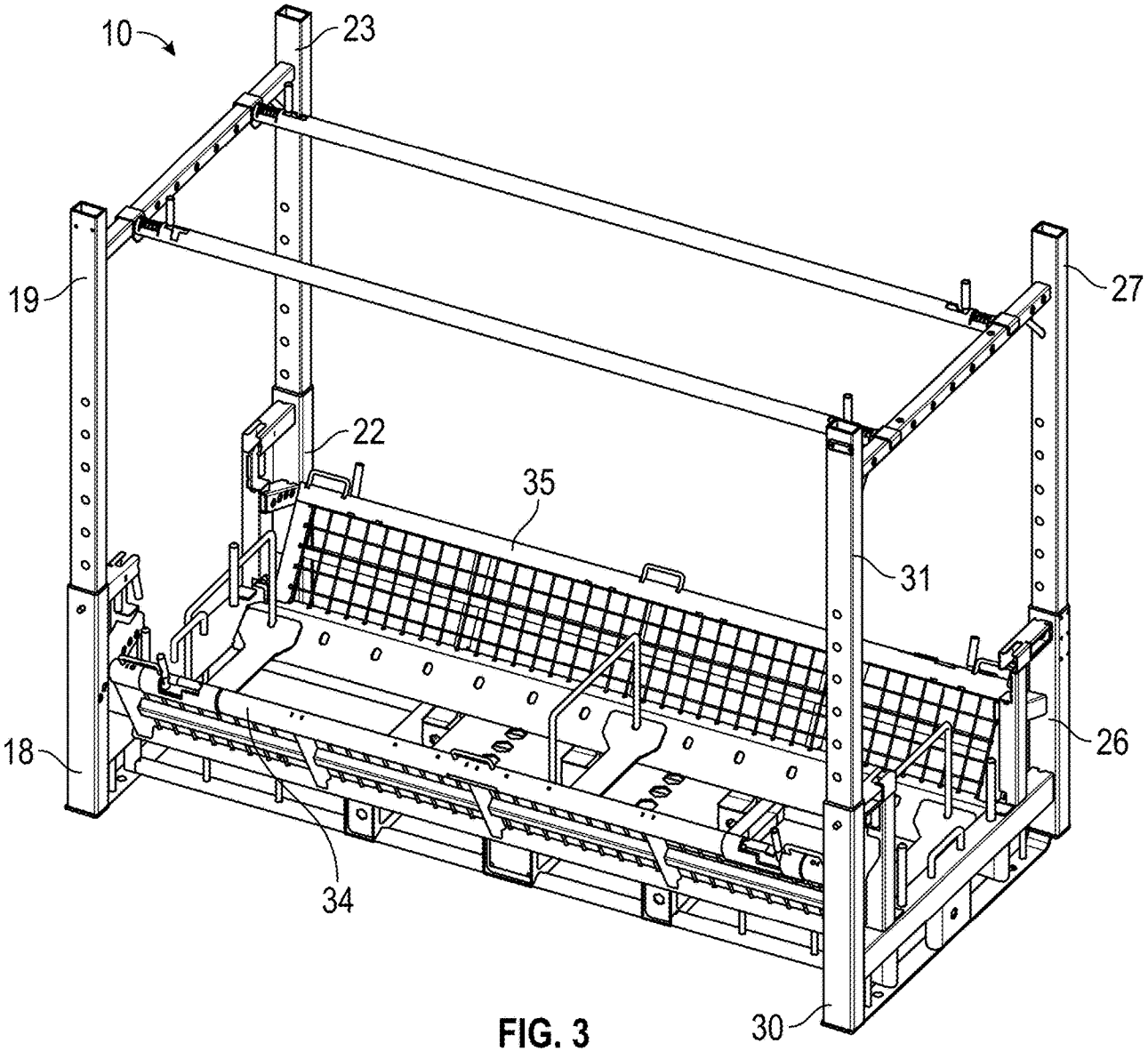
FIG. 3 is the cage from FIGS. 1 and 2, with the extensible members extended from the corner posts.

FIG. 3 is the cage from FIGS. 1 and 2, but with the extensible members 19, 23, 27, 31 extended from the corner posts 18, 22, 26, 30 to make the cage 10 larger.

Figure 4:
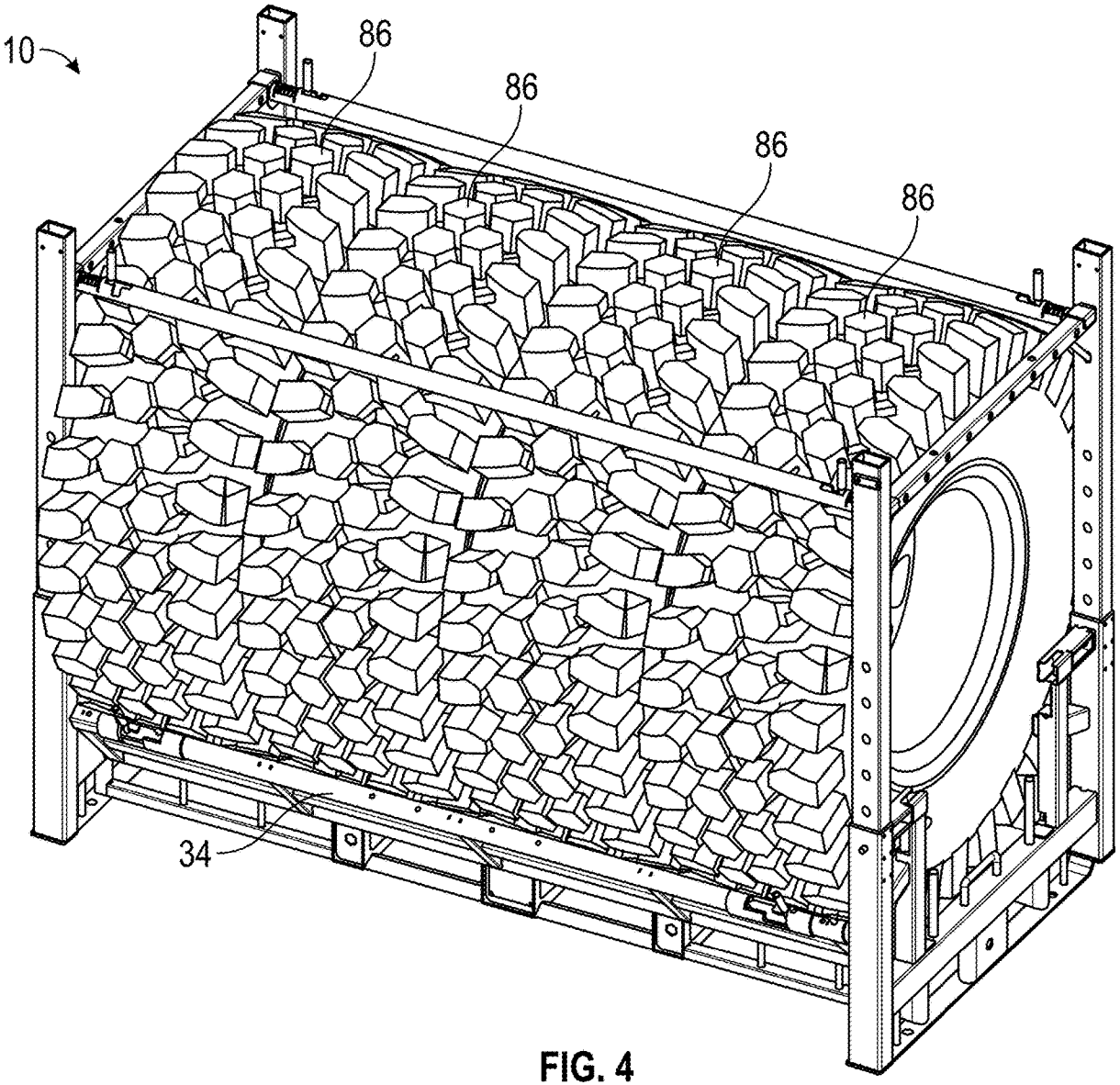
FIG. 4 is the cage from FIG. 3, showing the cage holding four tires and wheels.

FIG. 4 is the cage from FIG. 3, showing the cage 10 holding four tires and wheels 86.

Figure 5:
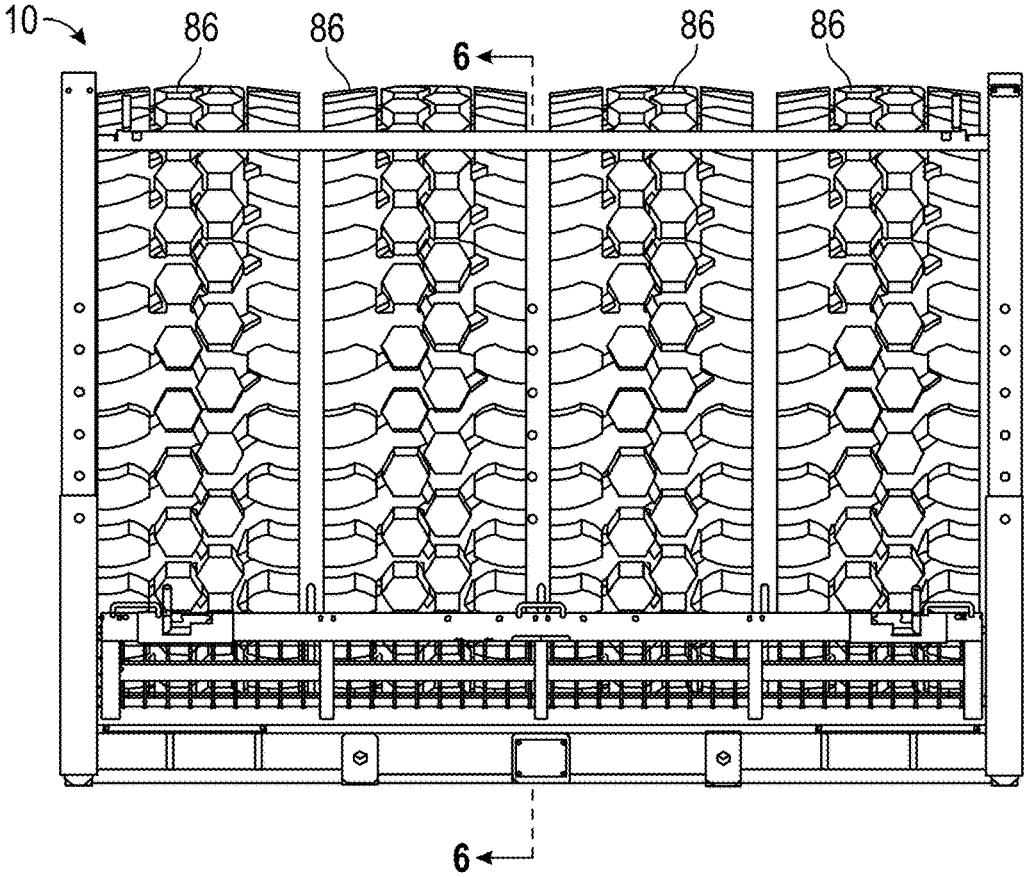
FIG. 5 is a front view of the cage from FIG. 4.

FIG. 5 is a front view of the cage 10 from FIG. 4.

Figure 6:
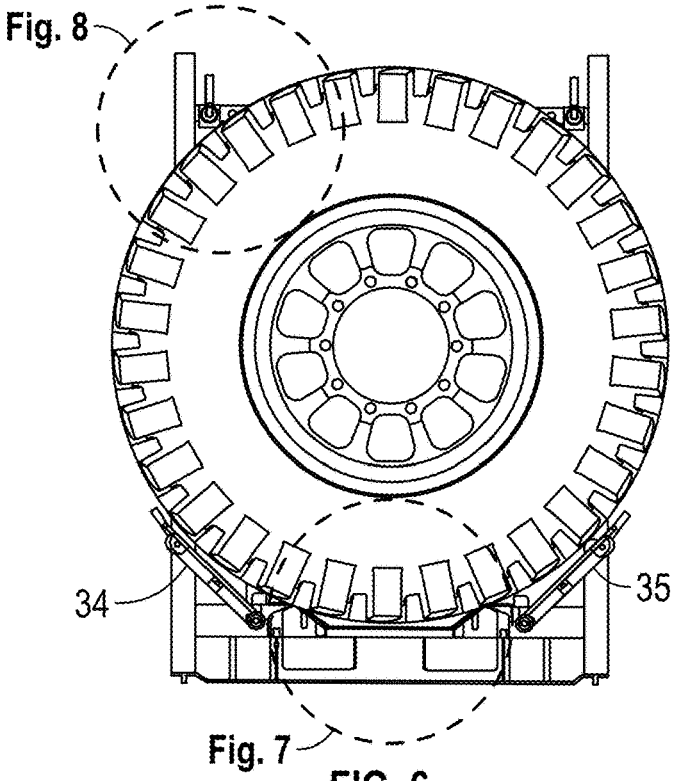
FIG. 6 is a sectional view of the cage from FIG. 5.

FIG. 6 is a sectional view of the cage 10 from FIG. 5.

Figure 7:
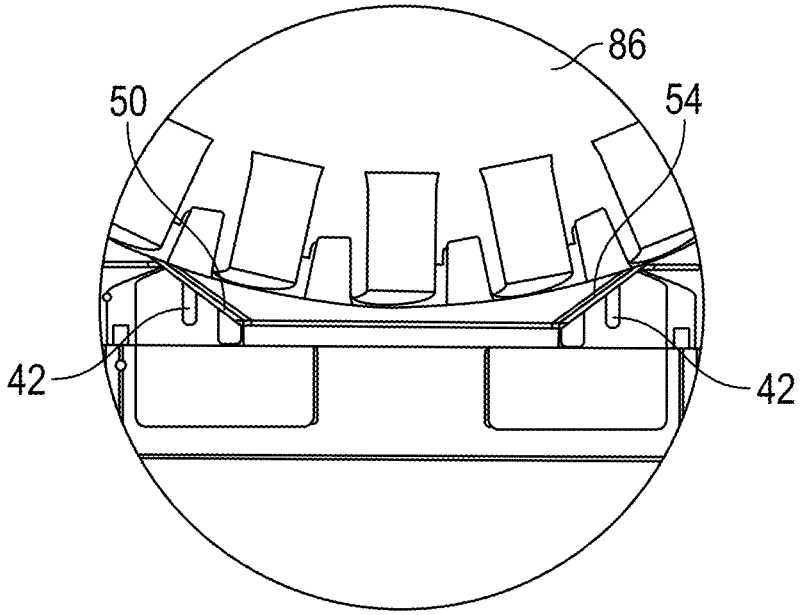
FIG. 7 is a detail view from FIG. 6.

FIG. 7 is a detail view from FIG. 6. In this view the front bottom rail 50 can be seen.

Figure 8:
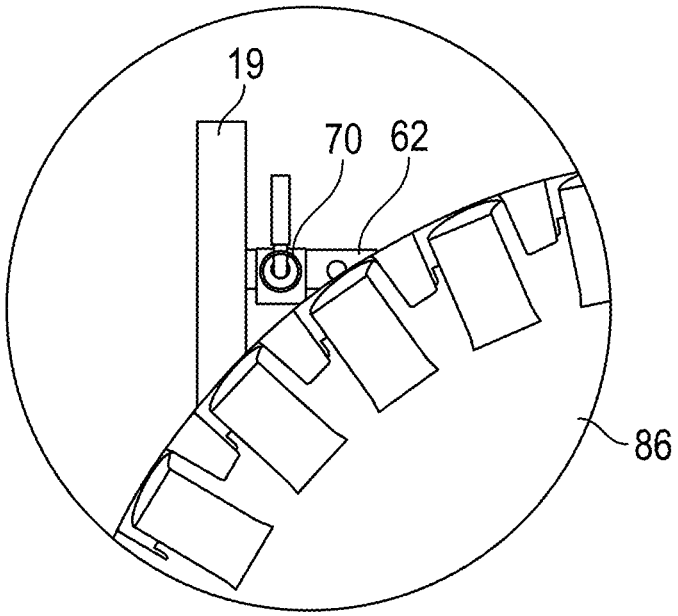
FIG. 8 is a detail view from FIG. 6.

FIG. 8 is a detail view from FIG. 6.

Figure 9:
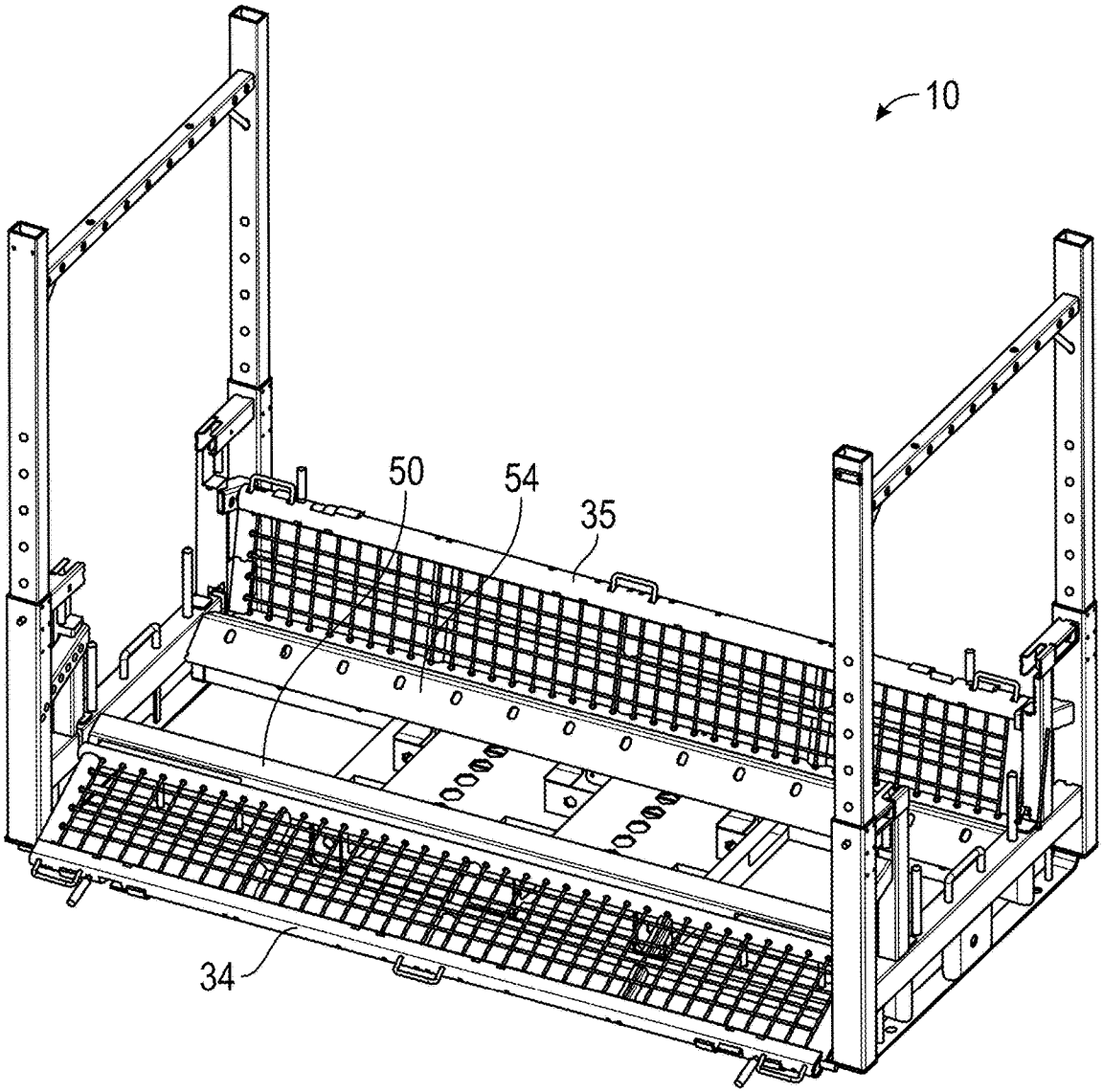
FIG. 9 is a perspective view of the cage with the front gate opened.

FIG. 9 is a perspective view of the cage 10 with the front gate 34 opened.

Figure 10:
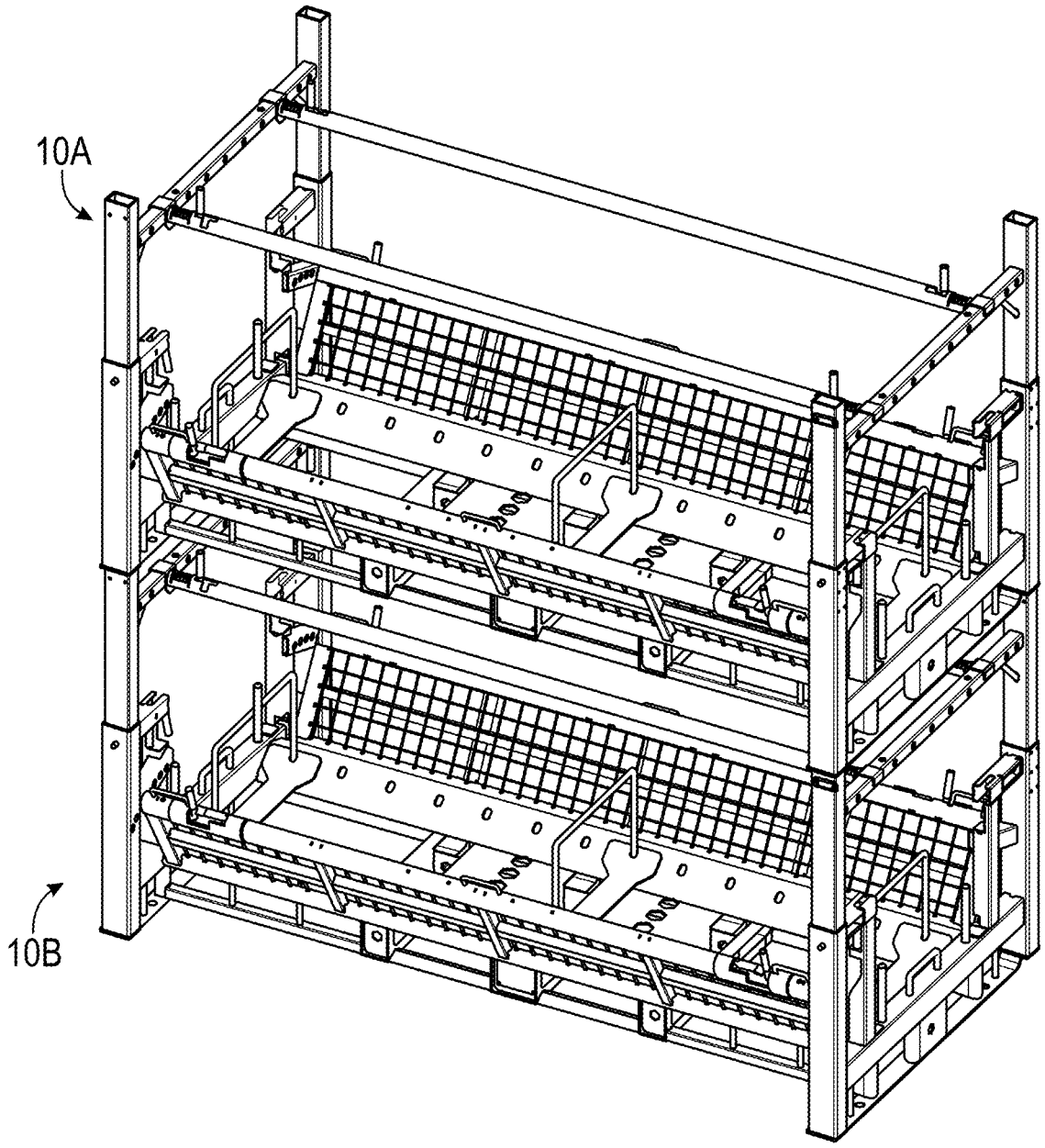
FIG. 10 shows two cages stacked one on top of the other.

FIG. 10 shows two cages 10A and 10B stacked one on top of the other, and able to store items such as wheels.

Figure 11:
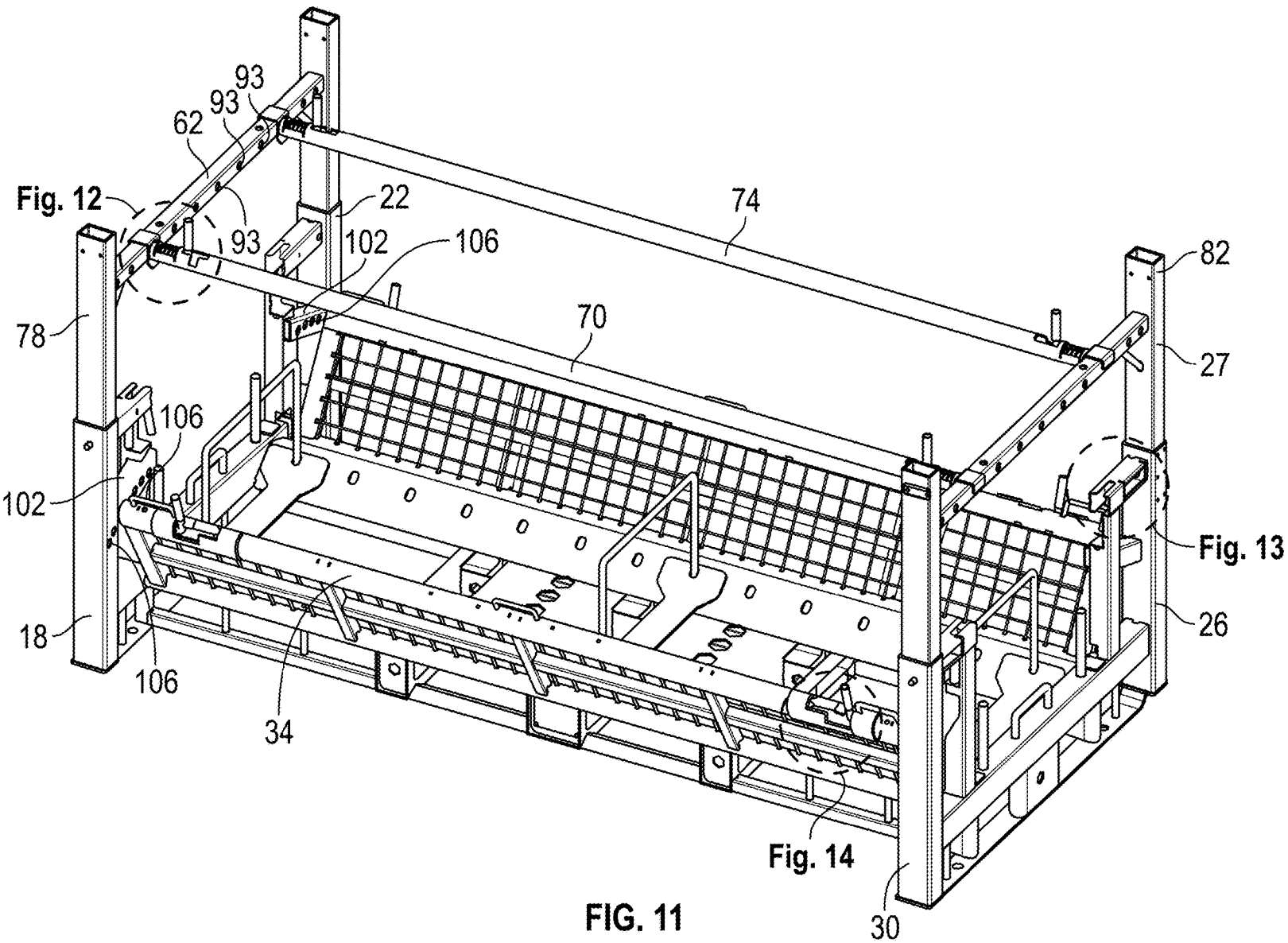
FIG. 11 is a perspective view of the cage.

FIG. 11 is a perspective view of the cage 10.

Figure 12:
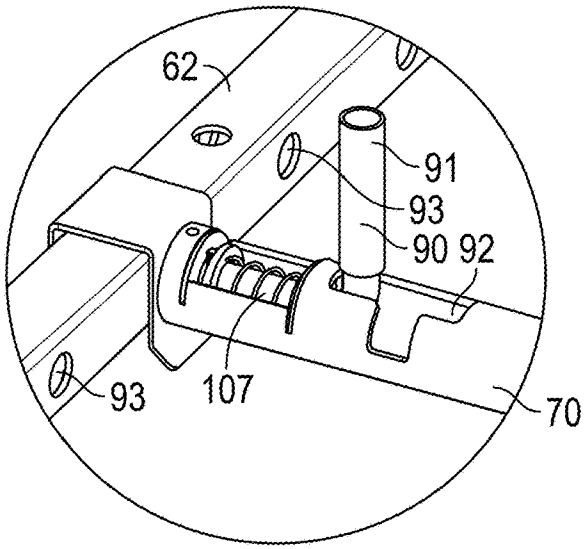
FIG. 12 is a detail view from FIG. 11.

FIG. 12 is a detail view from FIG. 11. This view shows a spring loaded pin attachment means 90 to attach the first vertical limiting top member 70 to the first side rail 62. The spring loaded pin attachment means 90 comprises a user handle 91, a slot 92, a pin 107, and holes 93 located in the first side rail 62. The holes 93 are configured to receive a pin 107 to lock the first vertical limiting top member 70 with respect to the first side rail.

Figure 13:
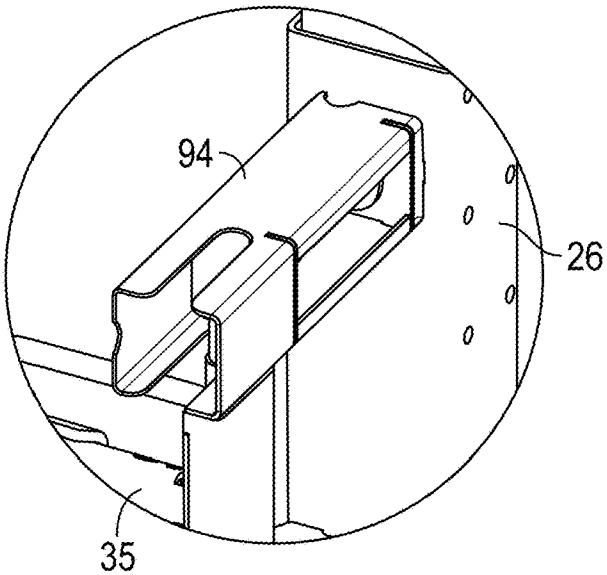
FIG. 13 is a detail view from FIG. 11 showing a horizontal member extending from the corner post.

FIG. 13 is a detail view from FIG. 11 showing a horizontal member 94 extending from the corner post 26. The horizontal members 94 lock the extensible members 19, 23, 27, 31 with respect to the corner posts 18, 22, 26, 30, thereby locking the first side end wall 78 and second side wend wall 82 in place and prevents the walls 78,82 from moving in a vertical direction.

Figure 14:
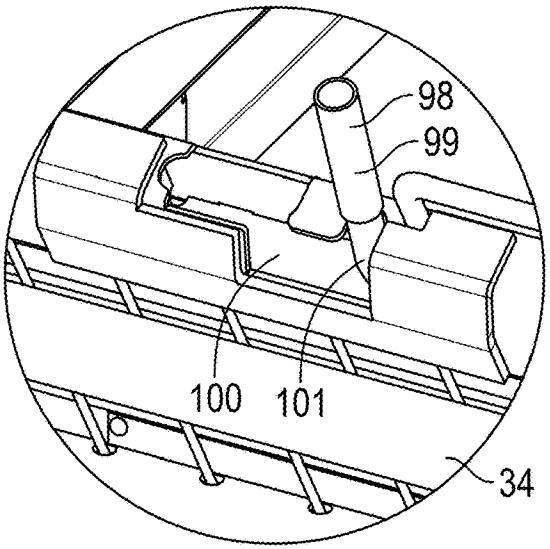
FIG. 14 is a detail view from FIG. 11 showing a slot and pin attachment means.

FIG. 14 is a detail view from FIG. 11 showing a slot and pin attachment means 98 for the front gate 34 to attach to a gate attachment member 102 attached to a corner post 30. The gate attachment member 102 has a plurality of holes 106 so that the front gate 34 (or rear gate 35) can attach at various angles with respect to the gate attachment member 102. The gate attachment member 102 cannot be seen in this view attached to corner post 30, but they can be seen attached to corner posts 18 and 22. The slot and pin attachment means 98 comprise a user handle 99, a slot 100, and a pin 101. The holes 106 are configured to receive the pin 101 to lock the front gate 34 with respect to the attachment member 102.

Figure 15:
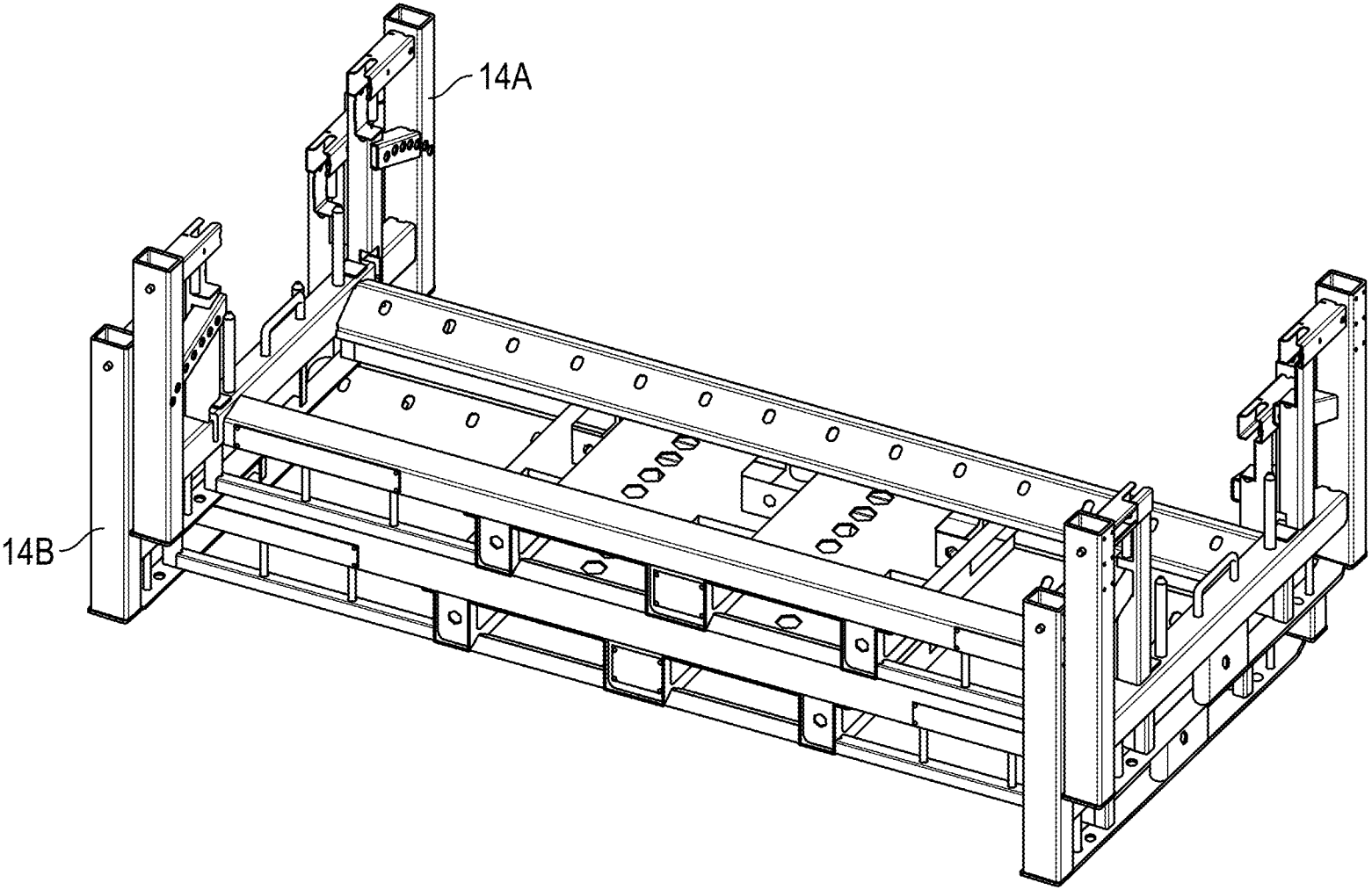
FIG. 15 is a perspective view showing two bottom frames stacked.

FIG. 15 is a perspective view showing two bottom frames 14A and 14B stacked in an offset manner on one another.

Figure 16:
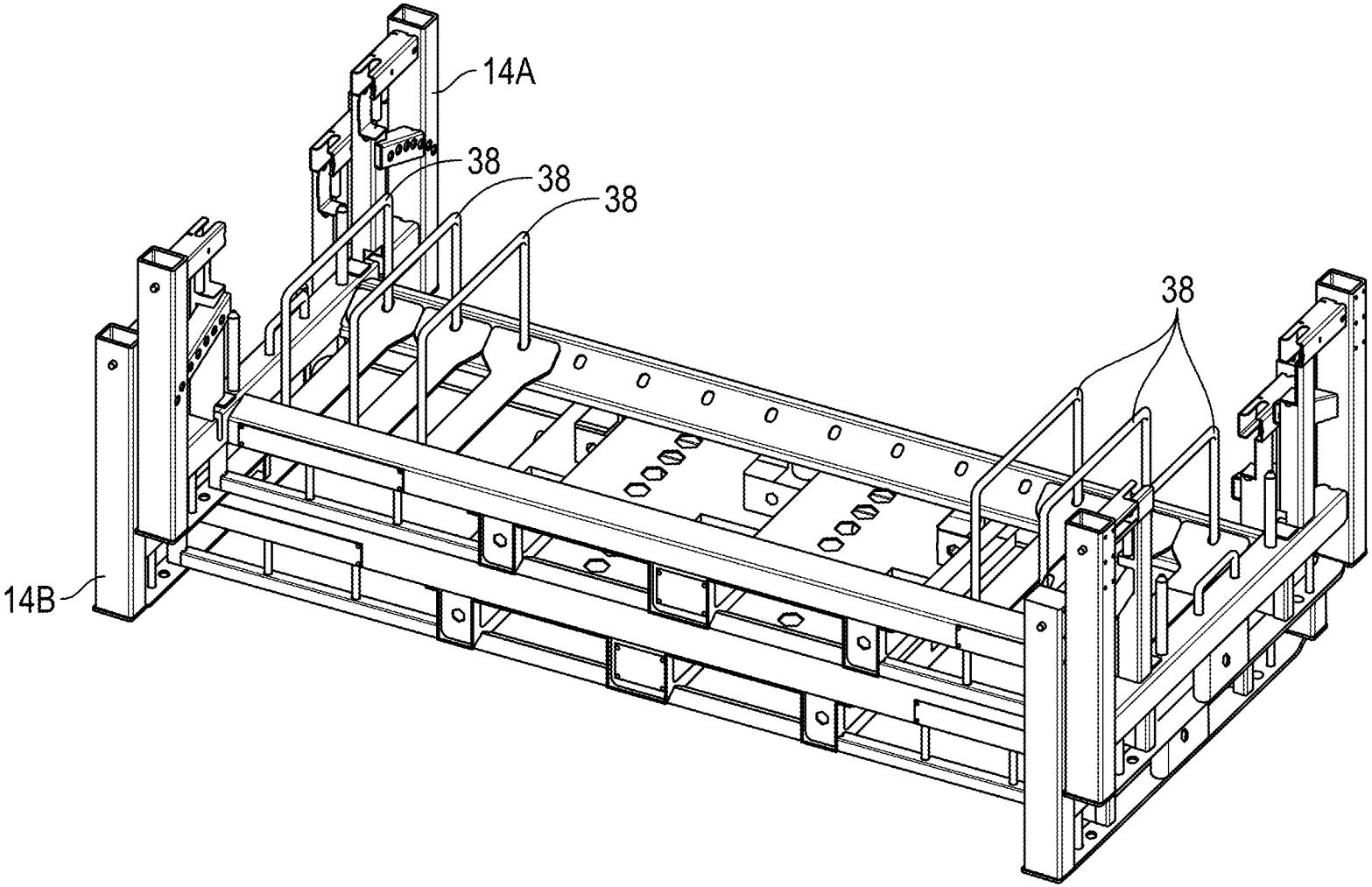
FIG. 16 is a perspective view showing two bottom frames stacked with six divider walls installed on a bottom frame.

FIGS. 16 is a perspective view showing two bottom frames 14A and 14B stacked in an offset manner on one another, with six divider walls installed on the bottom frame 14A.

Figure 17:
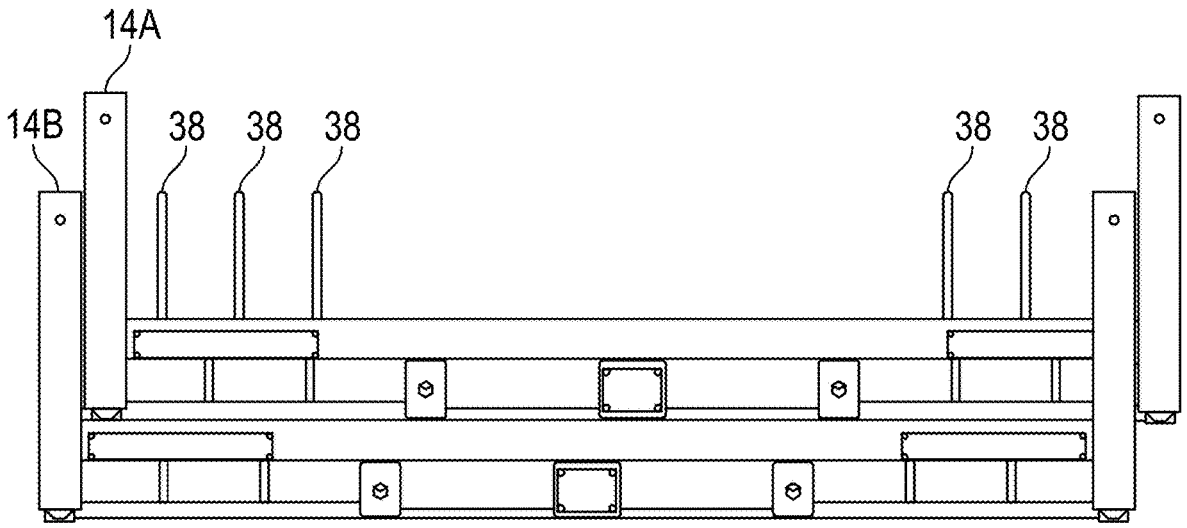
FIG. 17 is a front view of two bottom frames with five divider walls installed on a bottom frame.

FIG. 17 is a front view of two bottom frames 14A and 14B with five divider walls 38 installed on bottom frame 14A.

Figure 18:
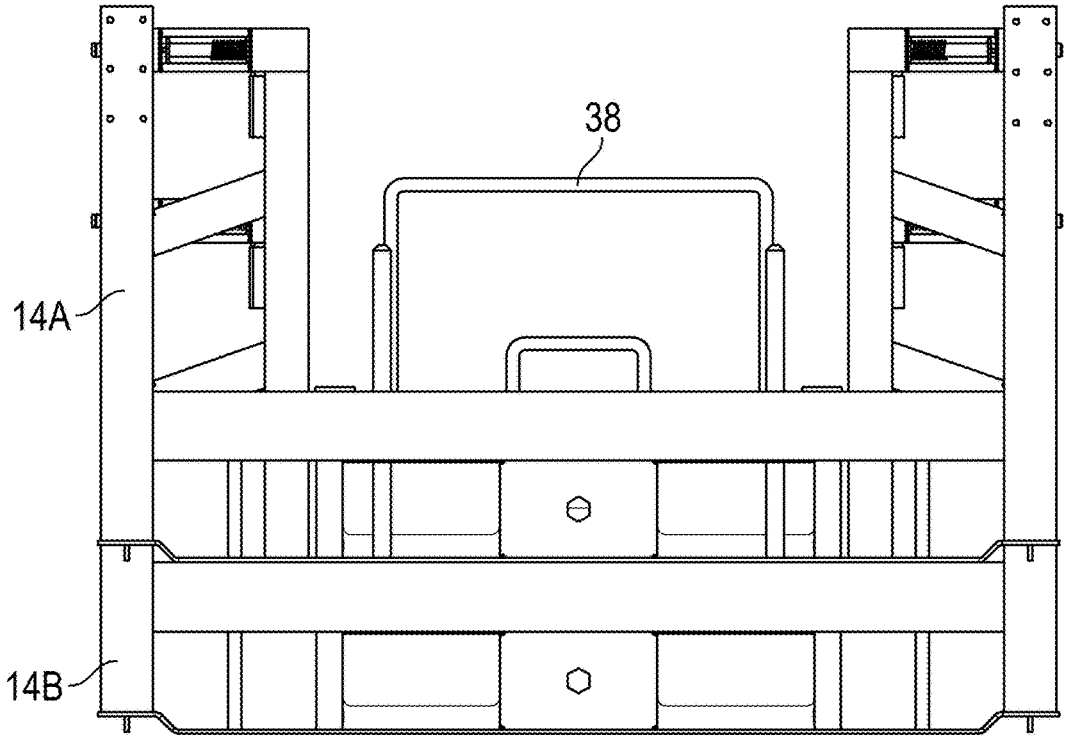
FIG. 18 is a side view of the two bottom frames from FIG. 17.

FIG. 18 is a side view of the two bottom frames 14A and 14B from FIG. 17.

Figure 19:
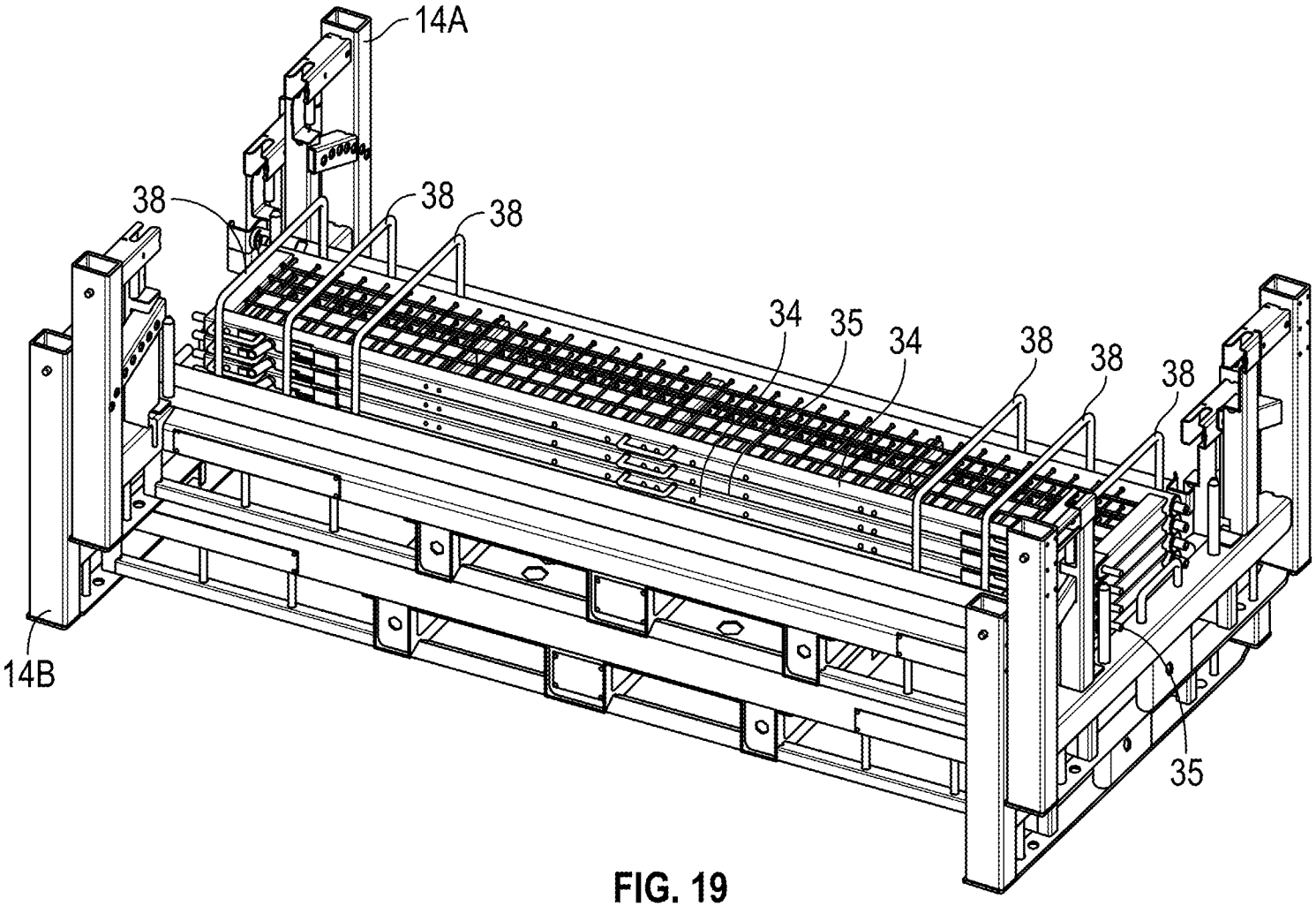
FIG. 19 is a perspective view showing two bottom frames stacked in an offset manner on one another, with two front gates and two rear gates and six divider walls stored on the stacked frames.

FIG. 19 is a perspective view showing two bottom frames 14A and 14B stacked in an offset manner on one another, with two front gates 34 and two rear gates 35 and six divider walls 38 stored on the stacked frames 14A and 14B.

Figure 20:
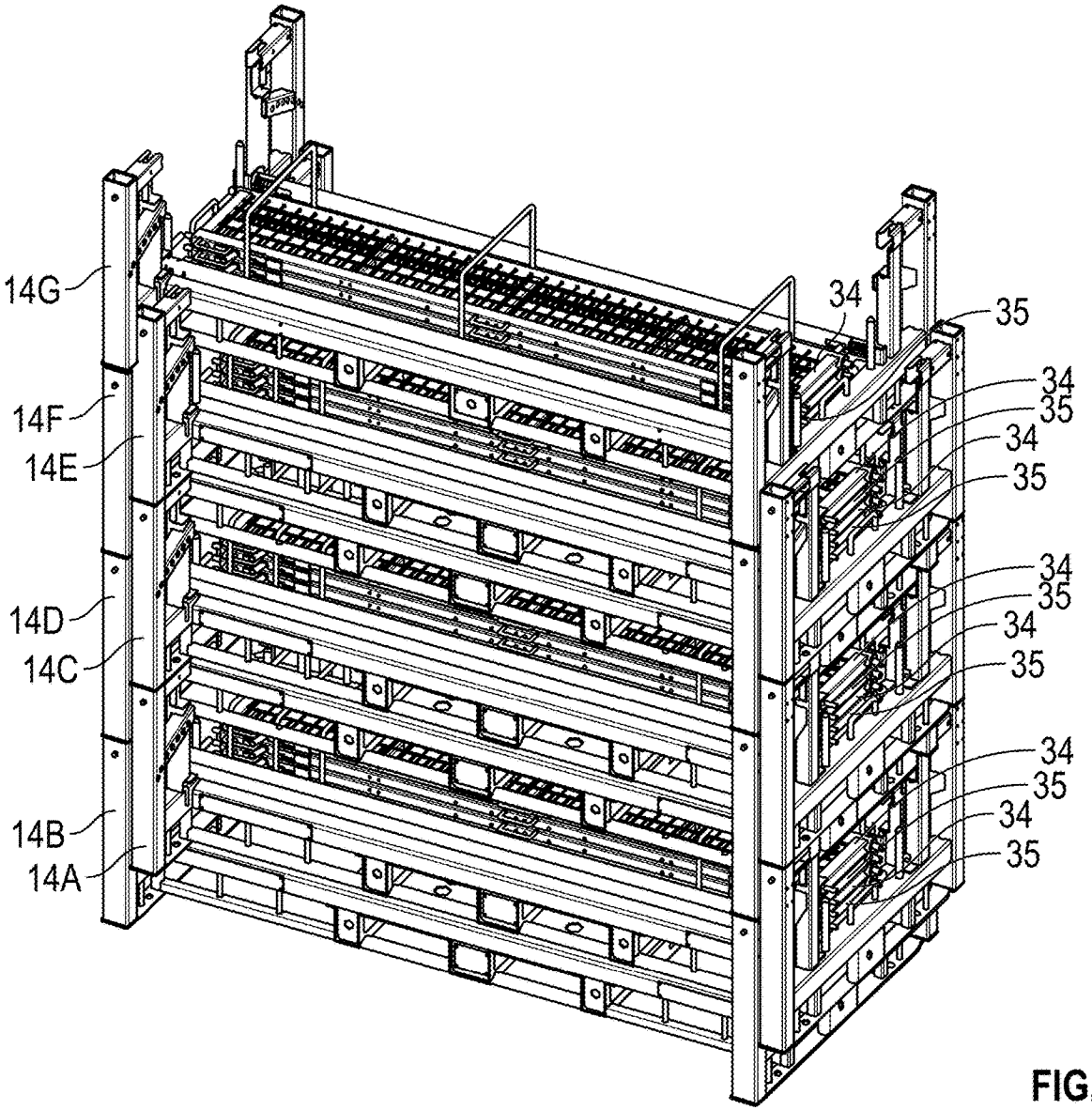
FIG. 20 is a perspective view of seven bottom frames stacked in an offset fashion with 14 front and rear gates.

FIG. 20 is a perspective view of seven bottom frames 14A-14G stacked in an offset fashion with 14 front and rear gates 34, 35.

Figure 21:
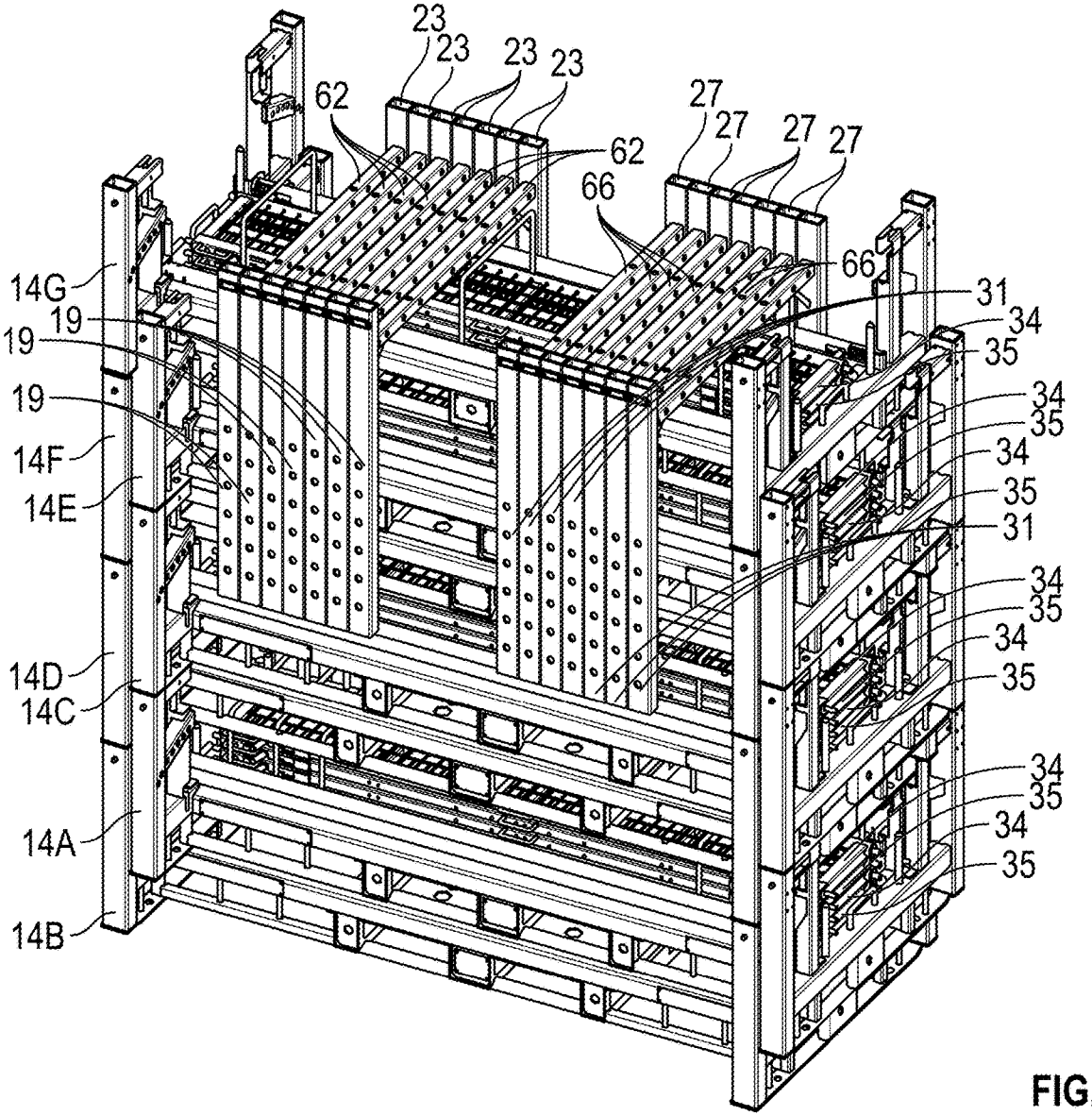
FIG. 21 is a perspective view of seven bottom frames stacked in an offset fashion with 14 side rails and 28 extensible members.

FIG. 21 is a perspective view of seven bottom frames 14A-14G stacked in an offset fashion with 14 side rails 62, 66, and 28 extensible members 19, 23, 27, 31.

Figure 22:
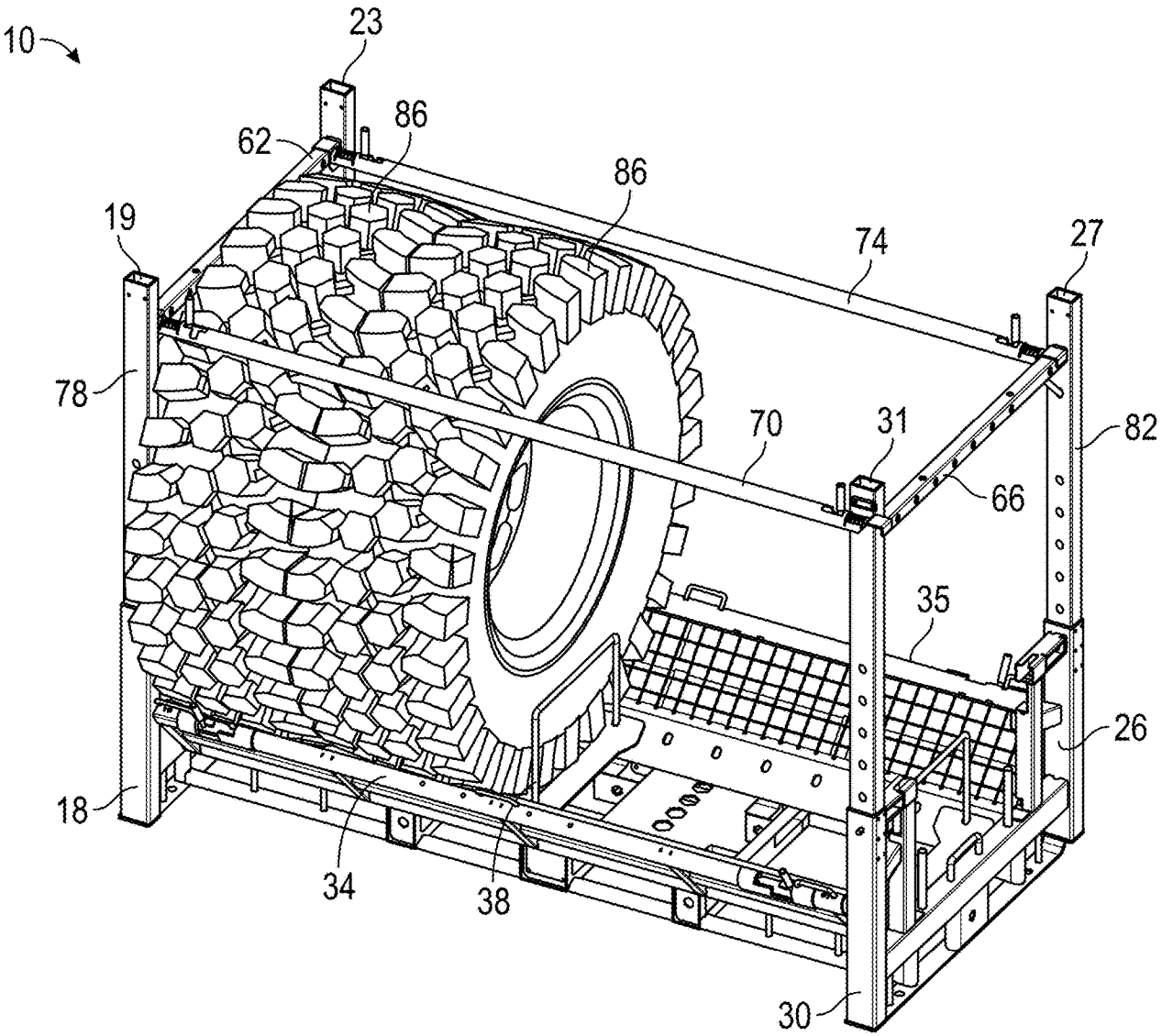
FIG. 22 is a perspective view of the cage with the extensible members fully extended so that the cage can hold 2 large tires and wheels.

FIG. 22 is a perspective view of the cage 10 with the extensible members 19, 23, 27, 31 fully extended so that the cage can hold 2 large tires and wheels 86, with a divider wall 38 holding the tires and wheels 86 against the first side end wall 78.

Figure 23:
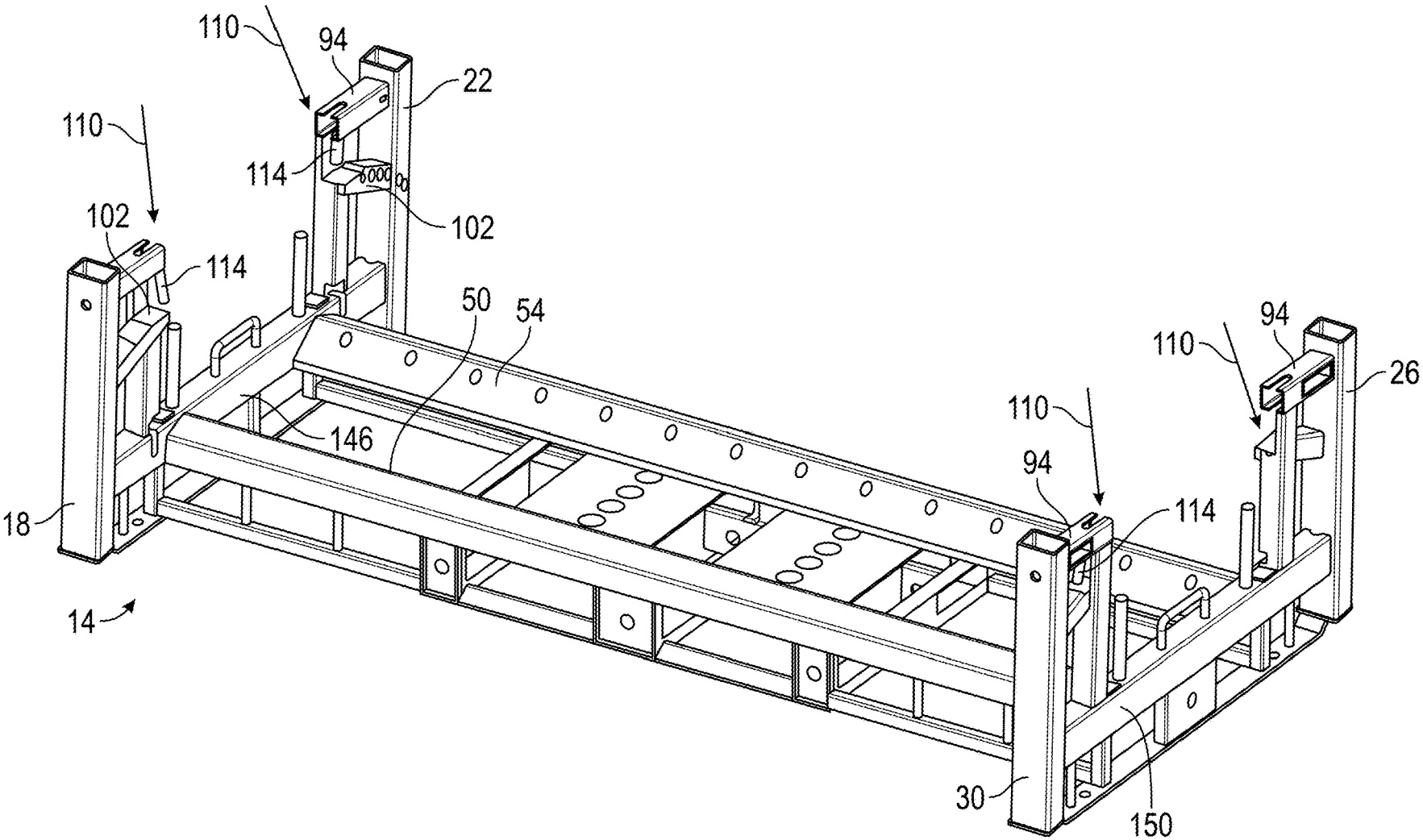
FIG. 23 shows a bottom frame with arrows pointed towards lock bars.

FIG. 23 through FIG. 43 are flat packing instructions for the disclosed cage 10. FIG. 23 shows a bottom frame 14, with arrows 110 pointed towards lock bars 114 extending from the horizontal members 94. The instruction is "1. Turn all Lock Bars in lower position as shown in the picture." In FIG. 23, the front bottom rail 50 is clearly visible. A first side bottom member 146 attaches to the first corner post 18 and second corner post 22. A second side bottom member 150 attaches to the third corner post 26 and the fourth corner post 30. The front bottom rail 50 is attached to and located between the first side bottom member 146 and second side bottom member 150. The rear bottom rail 54 is attached to and located between the first side bottom member 146 and second side bottom member 150.

Figure 24:
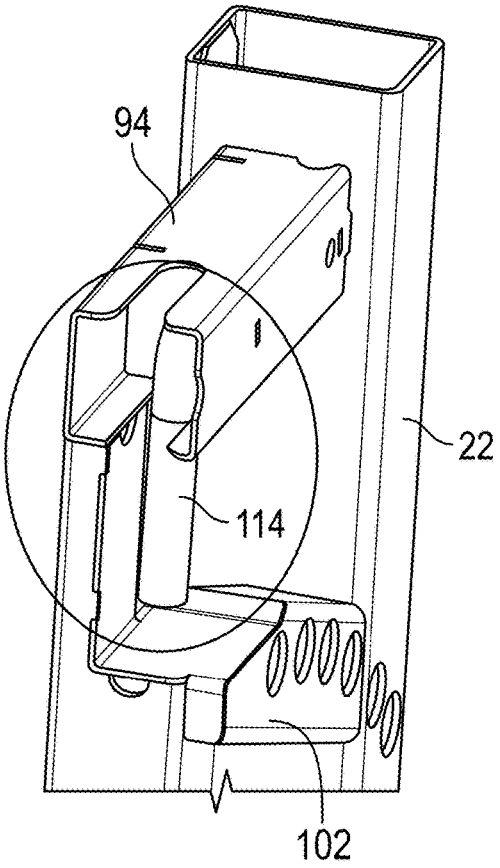
FIG. 24 is a detail from FIG. 23 showing the lock bar.

FIG. 24 is a detail from FIG. 23 showing the lock bar 114.

Figure 25:
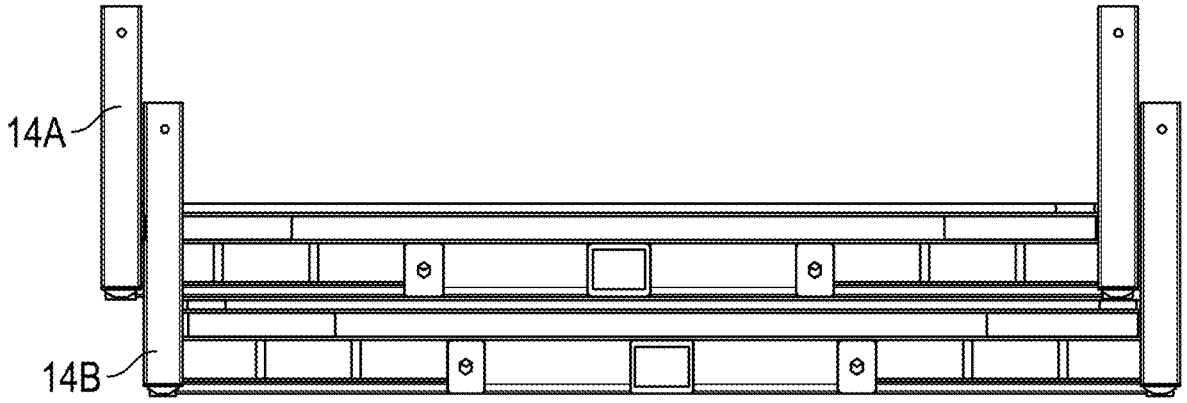
FIG. 25 is a front view of stacked two bottom frames.

FIG. 25 is a front view of stacking two bottom frames 14A and 14B. The instruction is "2. Install the next Bottom Frame on the previous one, a little to the left, centering the holes.".

Figure 26:
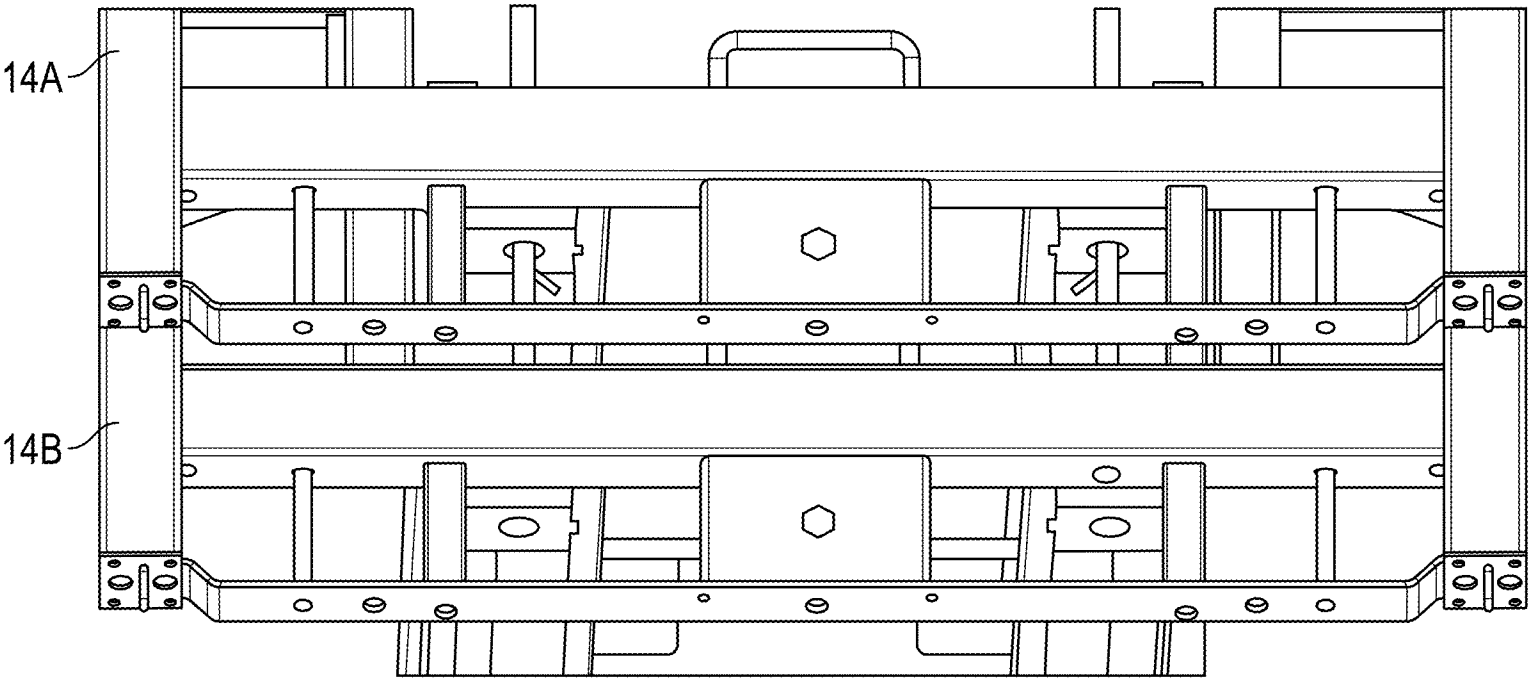
FIG. 26 is a side view of the frames from FIG. 25.

FIG. 26 is a side view of the frames 14A and 14B from FIG. 25.

Figure 27:
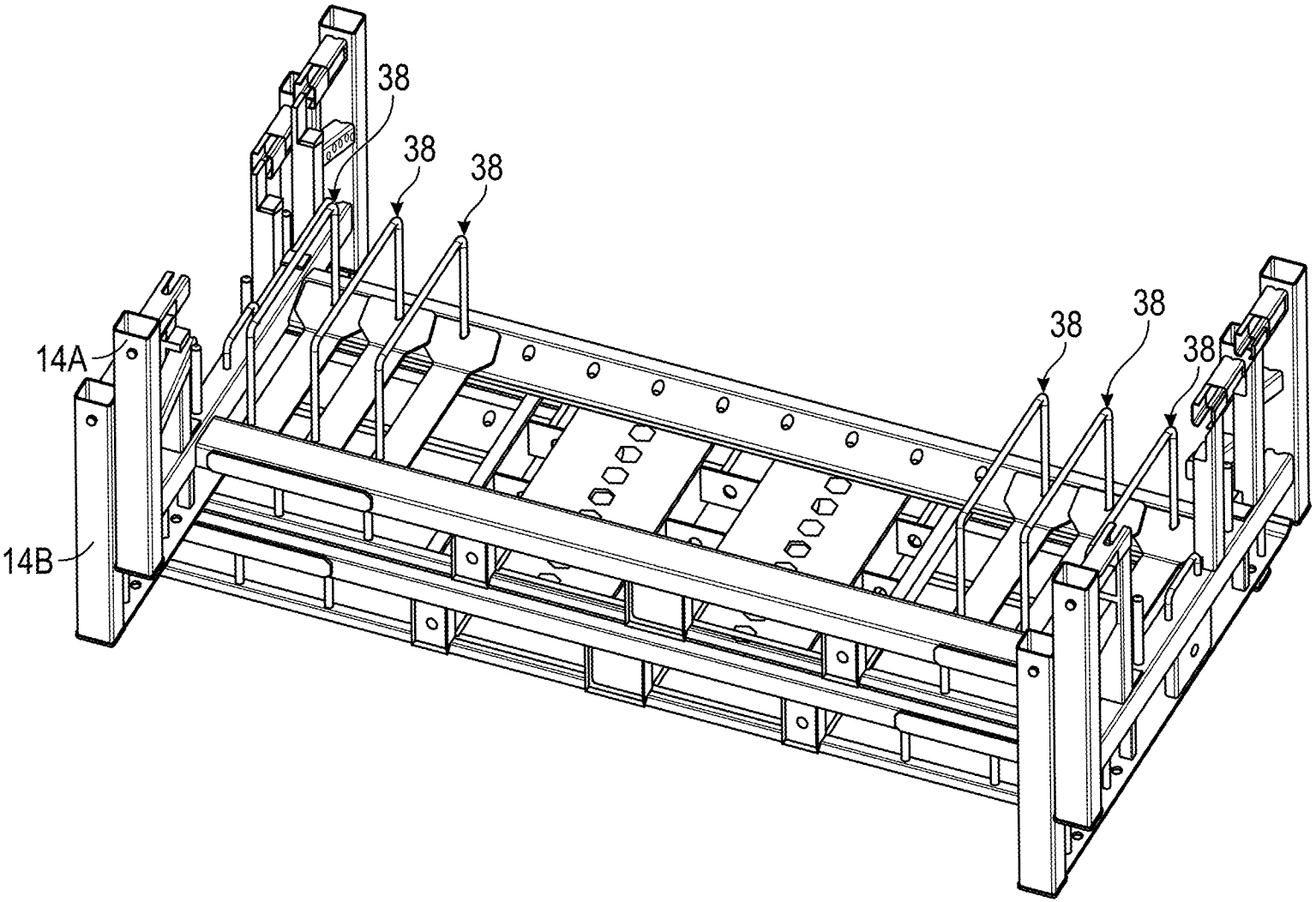
FIG. 27 shows the installation of 6 divider walls onto the stacked bottom frames.

FIG. 27 shows the installation of 6 divider walls 38 onto the stacked bottom frames 14A and 14B from FIG. 25. The instruction reads: "3. Install Divider Walls in the $1^{st}$, $2^{nd}$, $3^{rd}$ slots on each side.".

Figure 28:
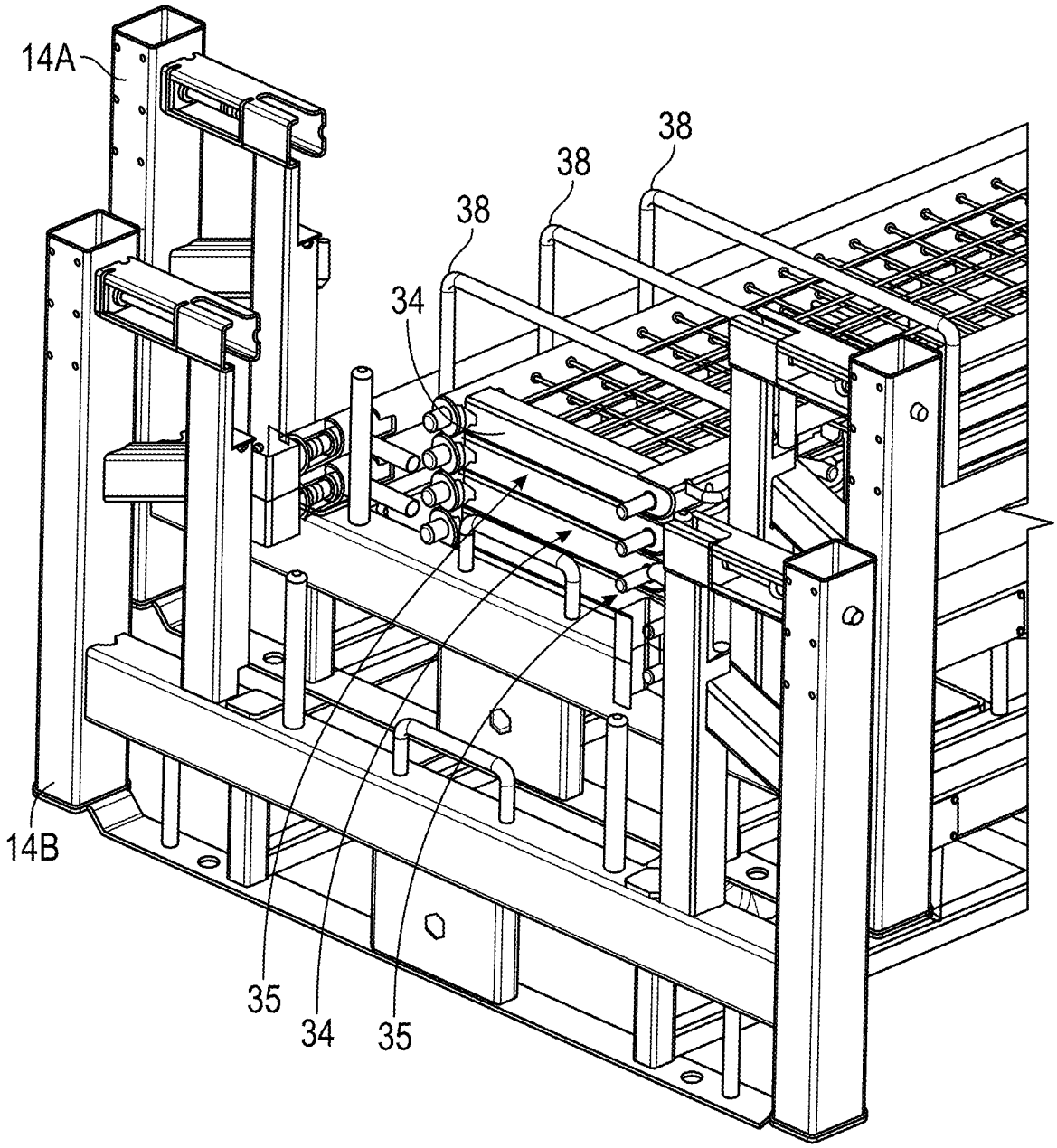
FIG. 28 shows a perspective view of the two stacked bottom frames with four gates pushed/slid under the divider walls.

FIG. 28 shows a perspective view of the two stacked bottom frames 14A 14B with four gates 34, 35 pushed/slid under the divider walls 38. The instruction says "4. Push Front Gages into Divider Walls.".

Figure 29:
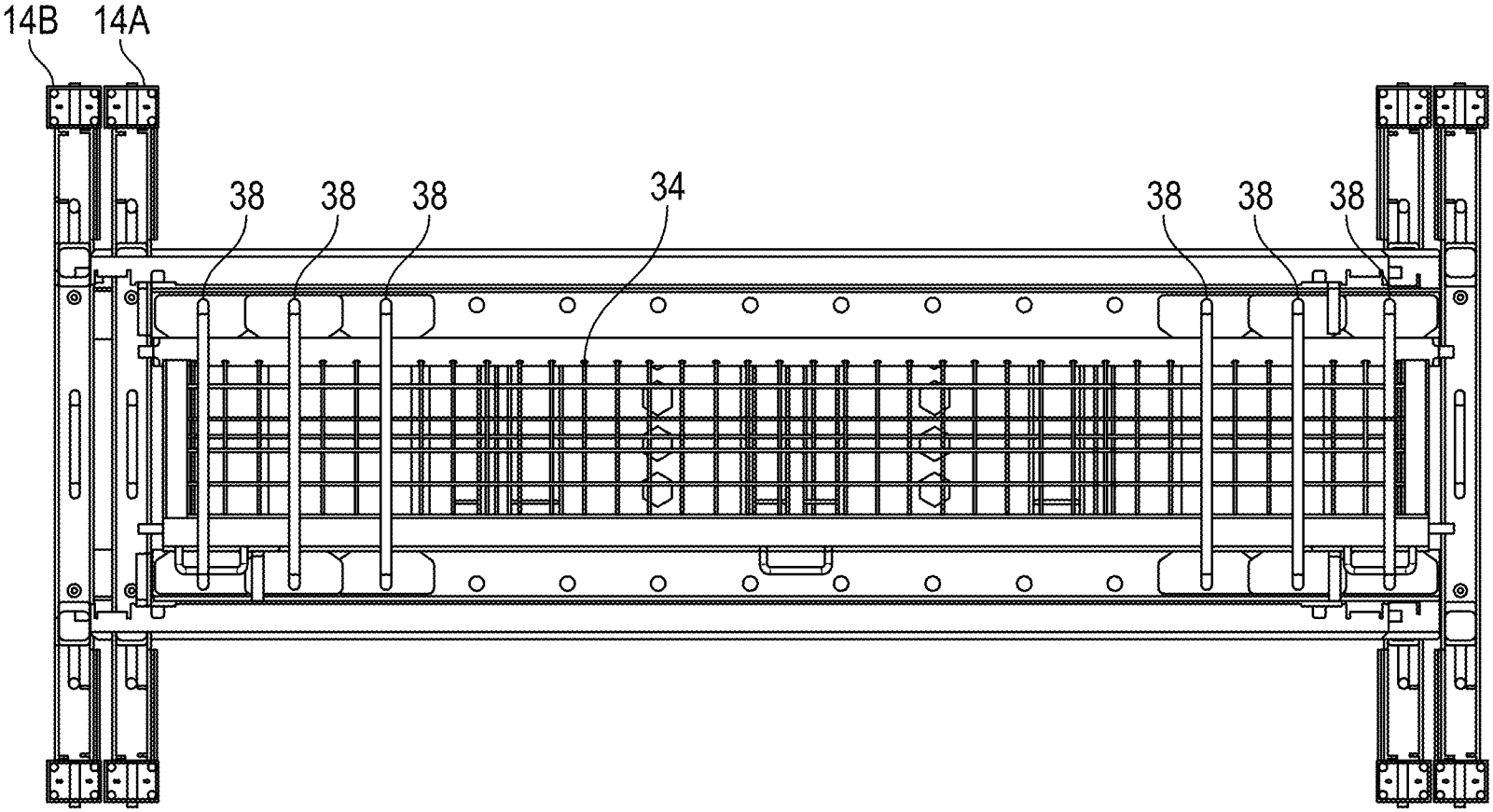
FIG. 29 is a top view of the two stacked bottom frames from FIG. 28.

FIG. 29 is a top view of the two stacked bottom frames 14A, 14B from FIG. 28.

Figure 30:
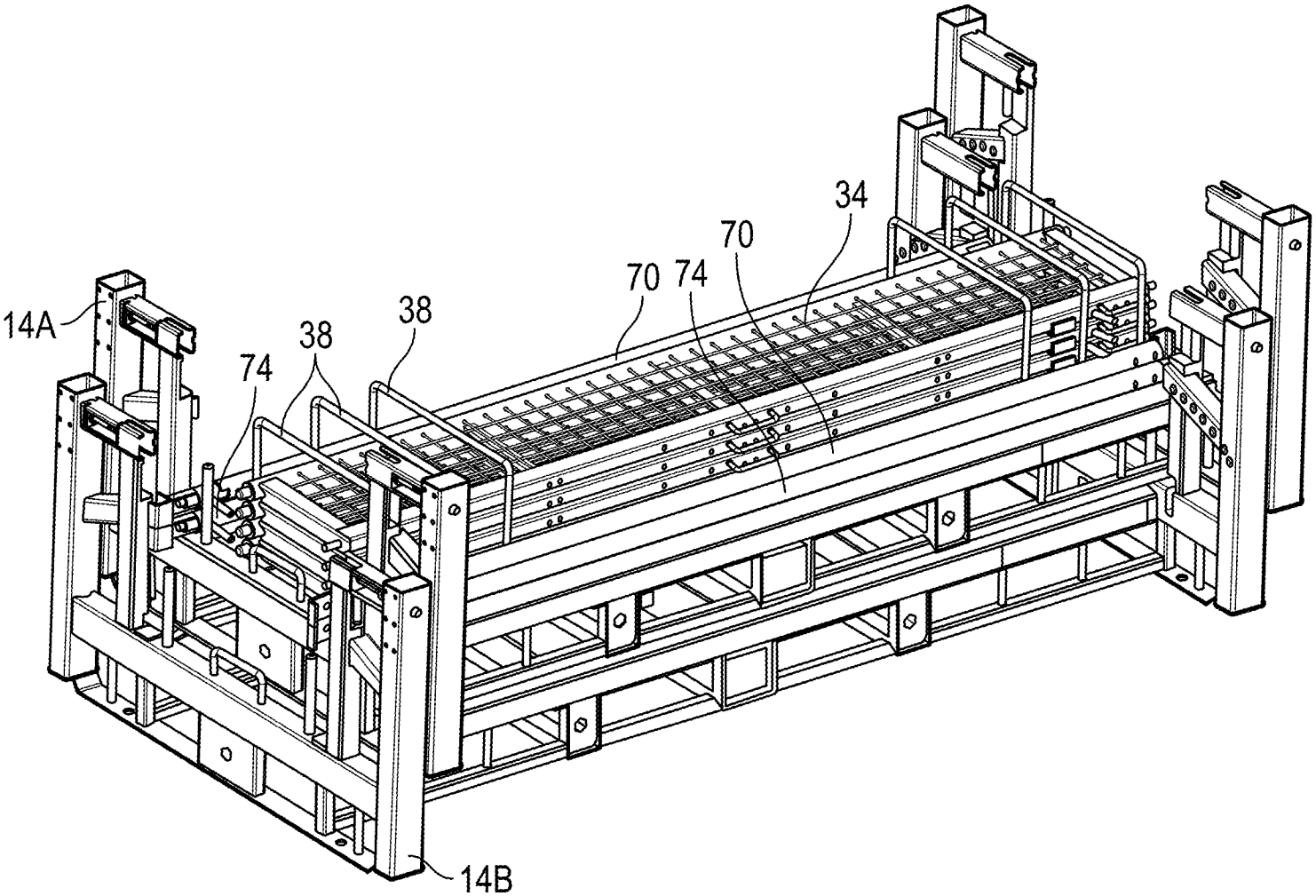
FIG. 30 is a perspective view of the two stacked bottom frames with the vertical limiting top members stored on the frames.

FIG. 30 is a perspective view of the two stacked bottom frames 14A, 14B with the vertical limiting top members 70,74 stored on the frames 14A, 14B. The instructions state: "5. Vertical limiting top Members must be placed as shown in the picture."

Figure 31:
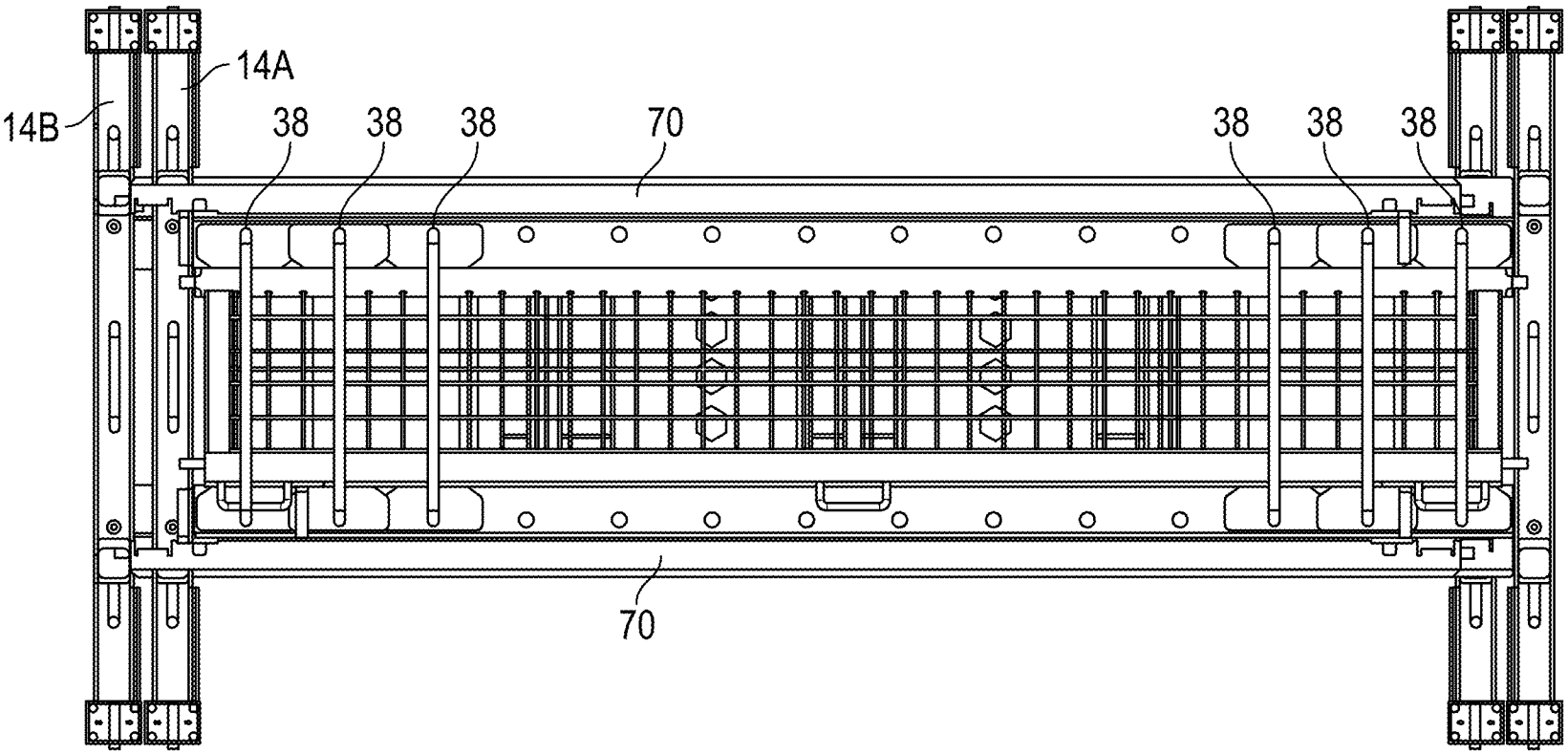
FIG. 31 is a top view of the two stacked bottom frames from FIG. 30.

FIG. 31 is a top view of the two stacked bottom frames 14A, 14B from FIG. 30.

Figure 32:
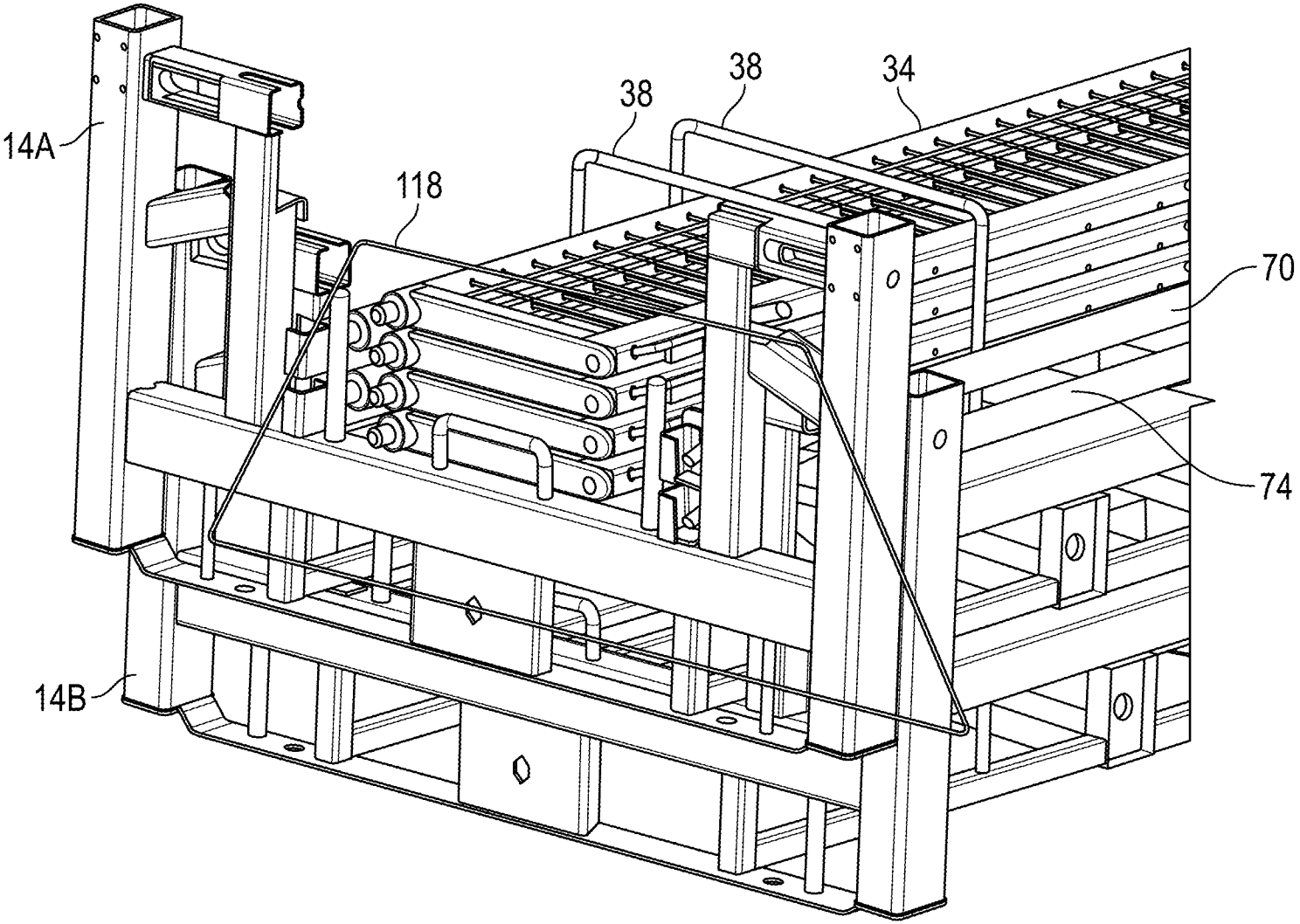
FIG. 32 is a perspective view of the two stacked bottom frames with the gates, divider walls, and vertical limiting top members stored on the frames.

FIG. 32 is a perspective view of the two stacked bottom frames 14A, 14B with the gates 34, 35, divider walls 38, and vertical limiting top members 70,74 stored on the frames 14A, 14B. The instructions state: "6. Connect Front Gates and Vertical limiting top Members with Bottom Frames in one kit with plastic packing straps." The trapezoid shape 118 indicates how the plastic packing straps may be wrapped around the gates, vertical limiting top members and bottom frames.

Figure 33:
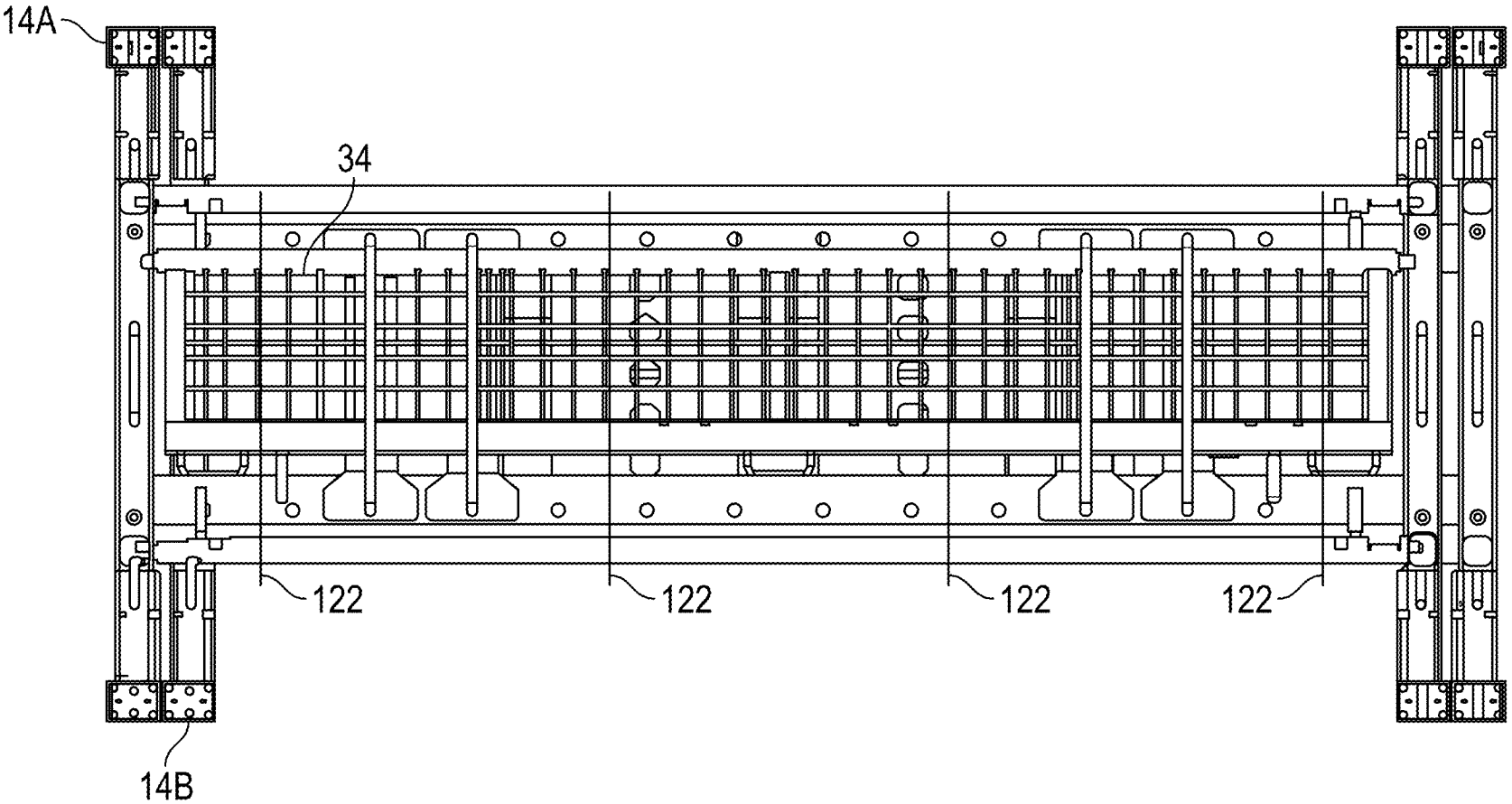
FIG. 33, is a top view of the two stacked bottom frames from FIG. 32.

FIG. 33, is a top view of the two stacked bottom frames 14A,14B from FIG. 32. The lines 122 indicate where the plastic packing straps may be wrapped around the gates, vertical limiting top members and bottom frames.

Figure 34:
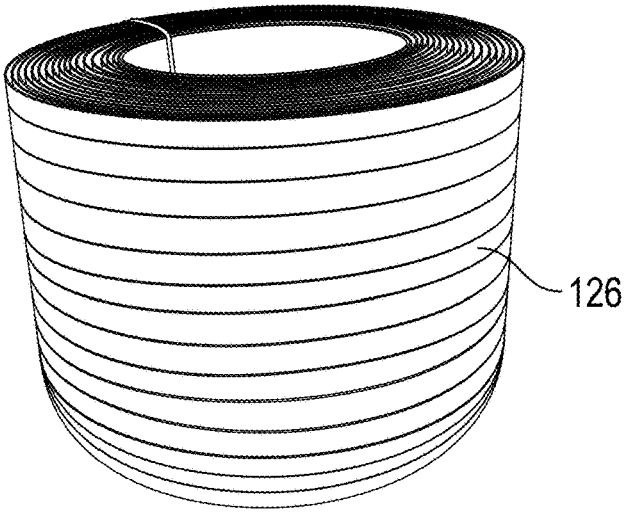
FIG. 34 is a perspective view of one embodiment of a roll of plastic packing straps.

FIG. 34 is a perspective view of one embodiment of a roll of plastic packing straps 126.

Figure 35:
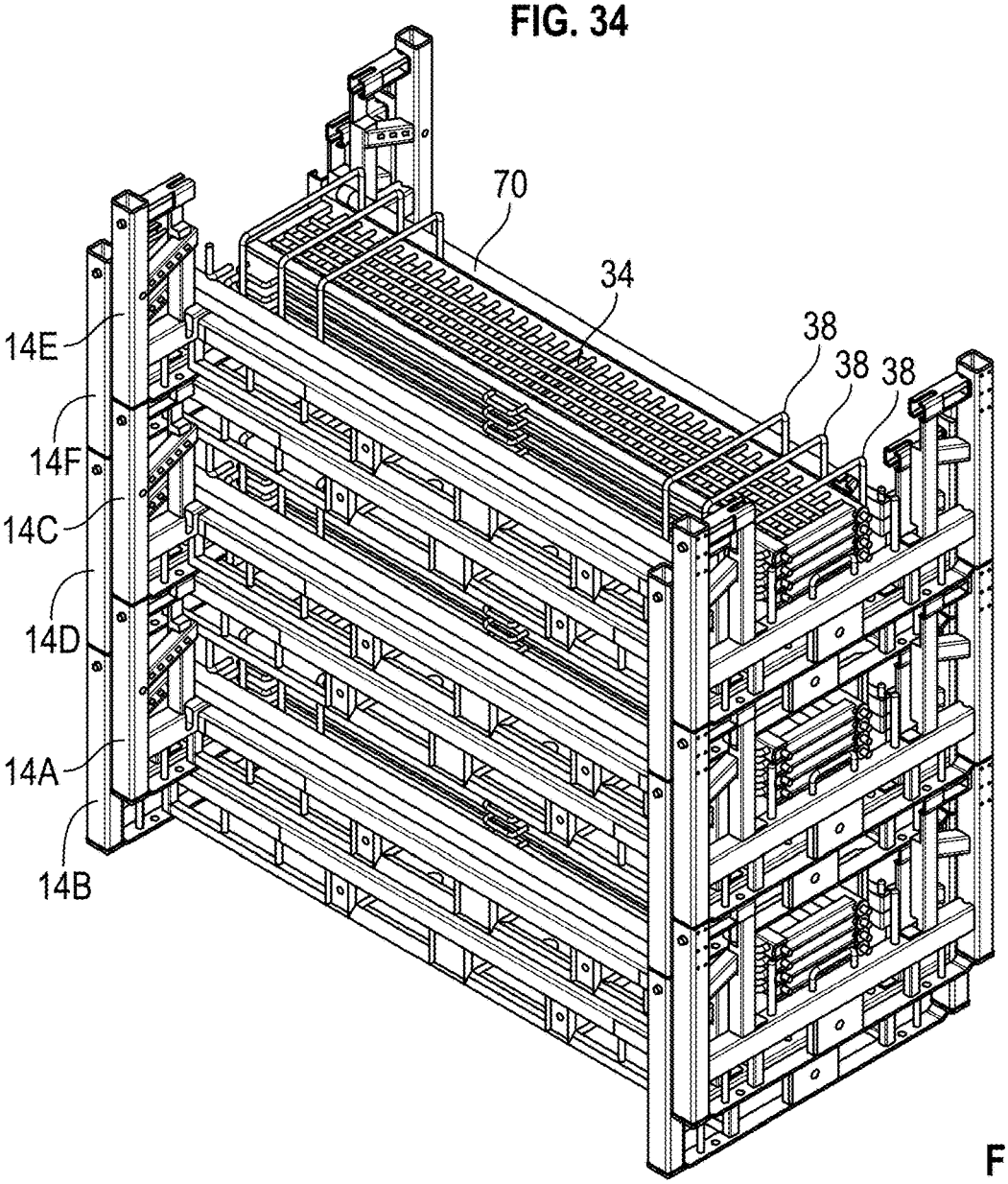
FIG. 35 shows a perspective view of 6 stacked bottom frames.

FIG. 35 shows a perspective view of 6 stacked bottom frames 14A, 14B, 14C, 14D, 14E, 14F. The instructions state: "7. Duplicate the resulting configuration upwards 2 more times. Follow steps 1-6."

Figure 36:
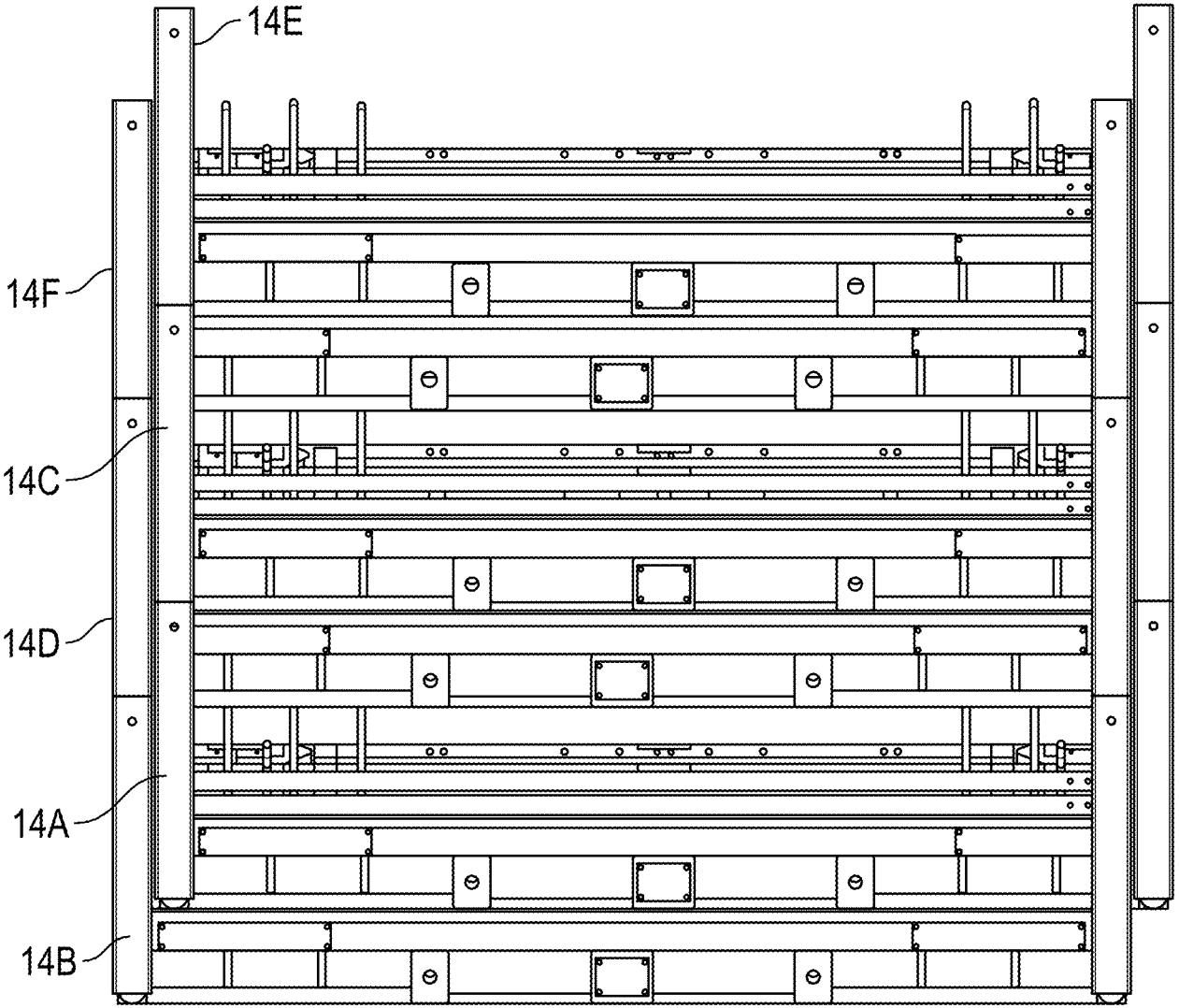
FIG. 36 is a front view of the 6 stacked bottom frames.

FIG. 36 is a front view of the stacked bottom frames 14A, 14B, 14C, 14D, 14E, 14F from FIG. 35.

Figure 37:
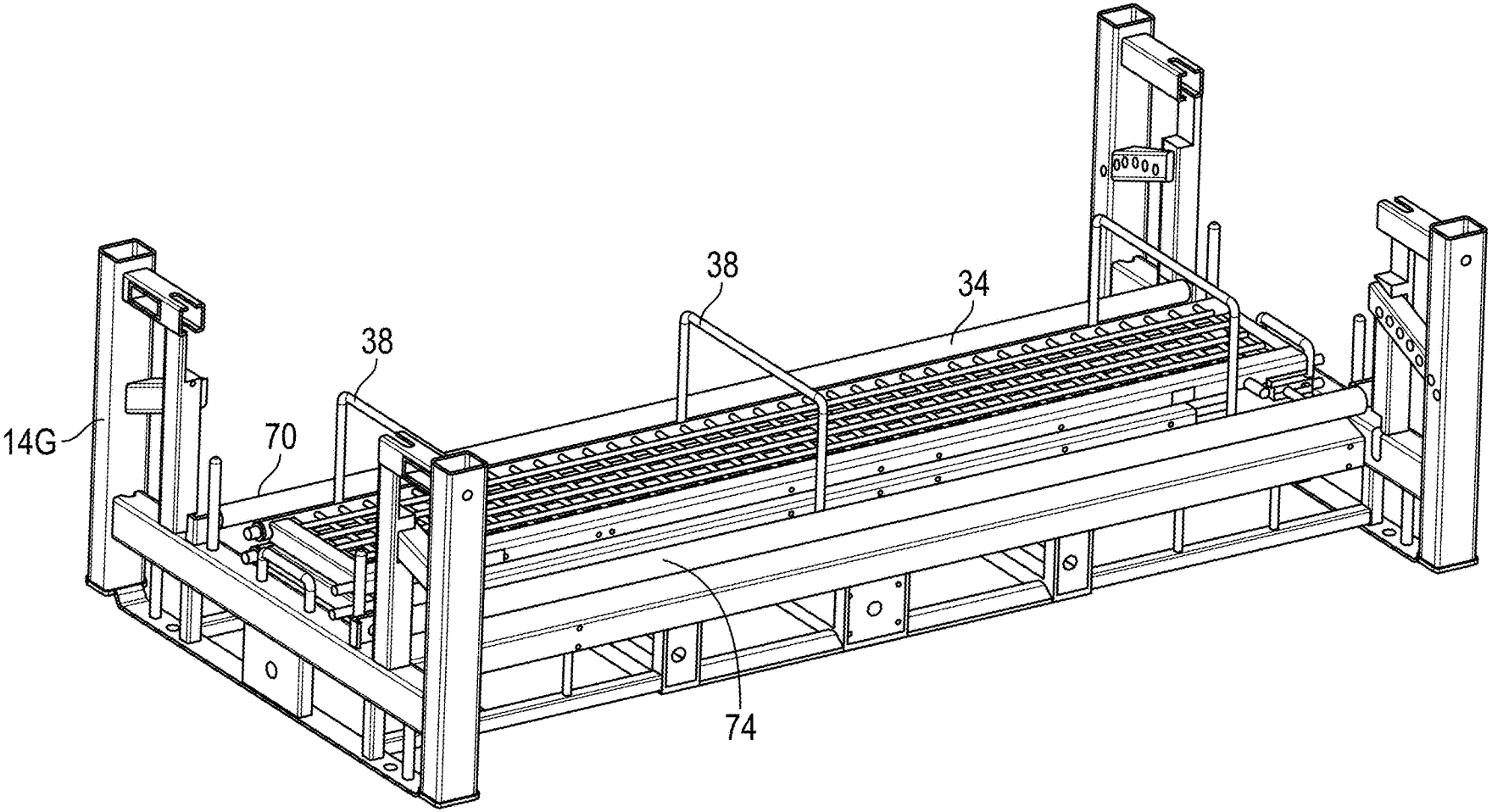
FIG. 37 is a perspective view of a bottom frame.

FIG. 37 is a perspective view of a bottom frame 14G. FIG. 37 shows the preparation of a final bottom frame 14G. The instructions state: "8. Prepare one more set: 1 Bottom Frame, 3 Divider Walls, 2 Front Gates, 2 Vertical limiting top Members. Put it top on previous 3 sets."

Figure 38:
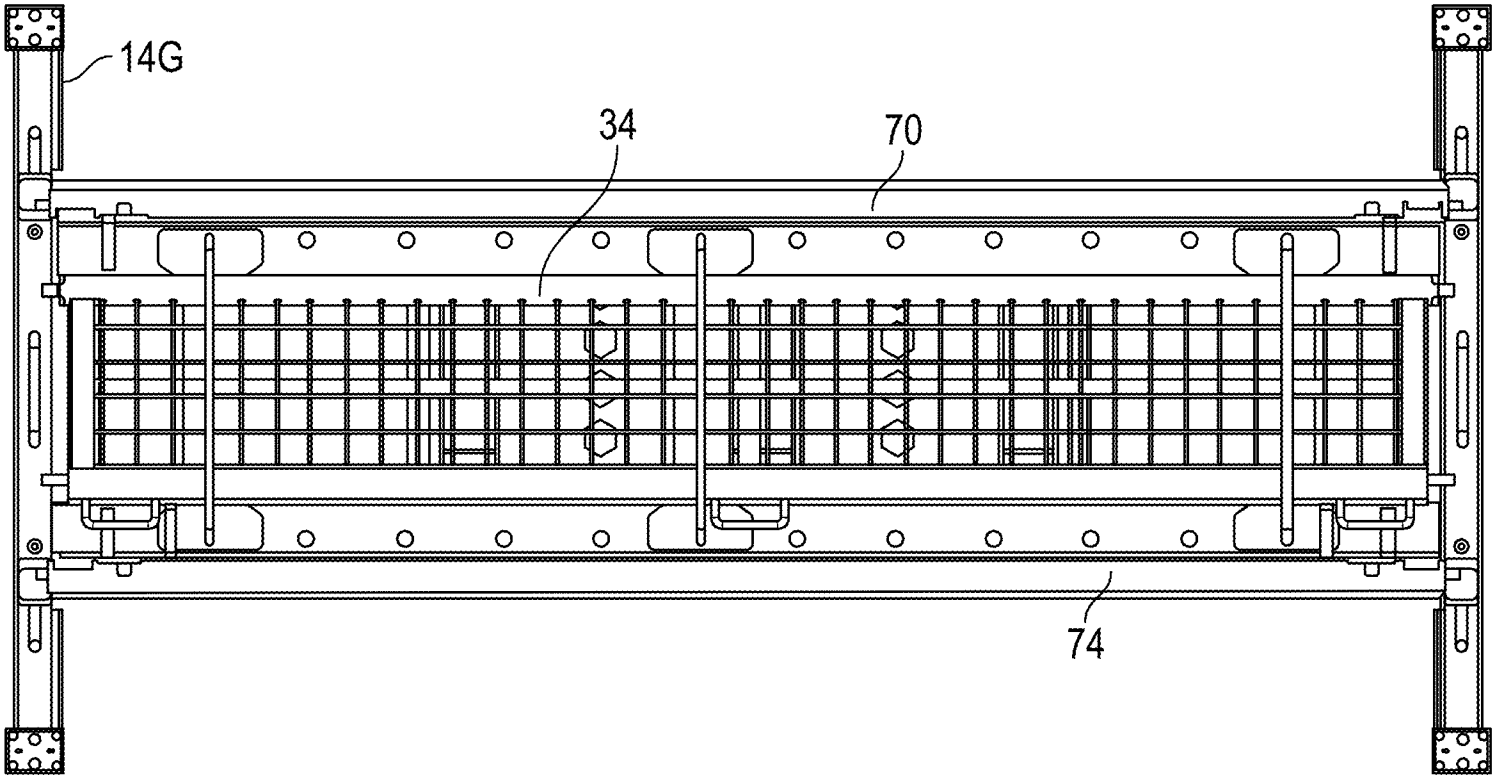
FIG. 38 is a front view of the bottom frame.

FIG. 38 is a front view of the bottom frame 14G.

Figure 39:
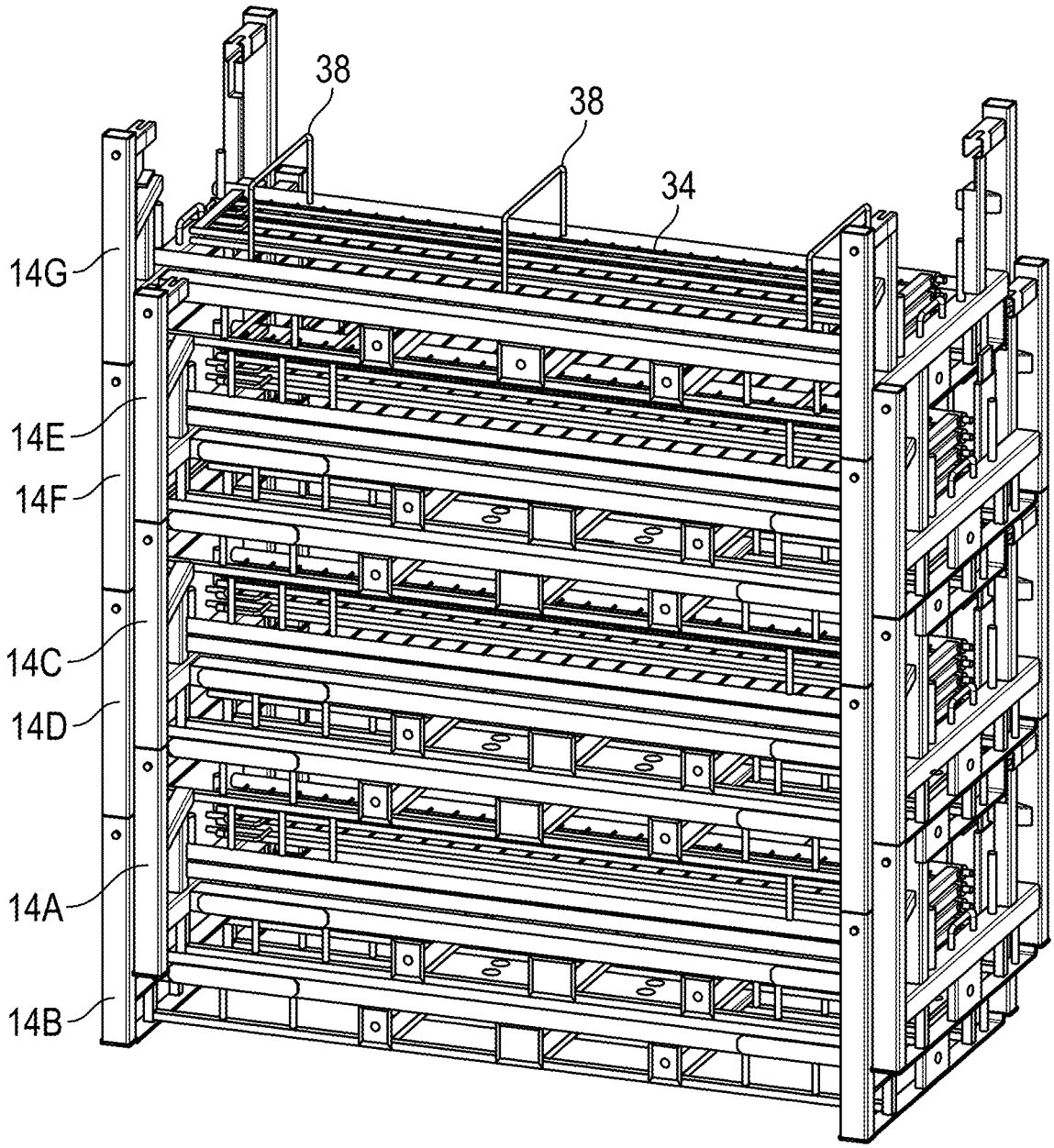
FIG. 39 is a perspective view of the bottom frame stacked on 6 stacked bottom frames.

FIG. 39 is a perspective view of the bottom frame 14G stacked on the stacked bottom frames 14A, 14B, 14C, 14D, 14E, 14F.

Figure 40:
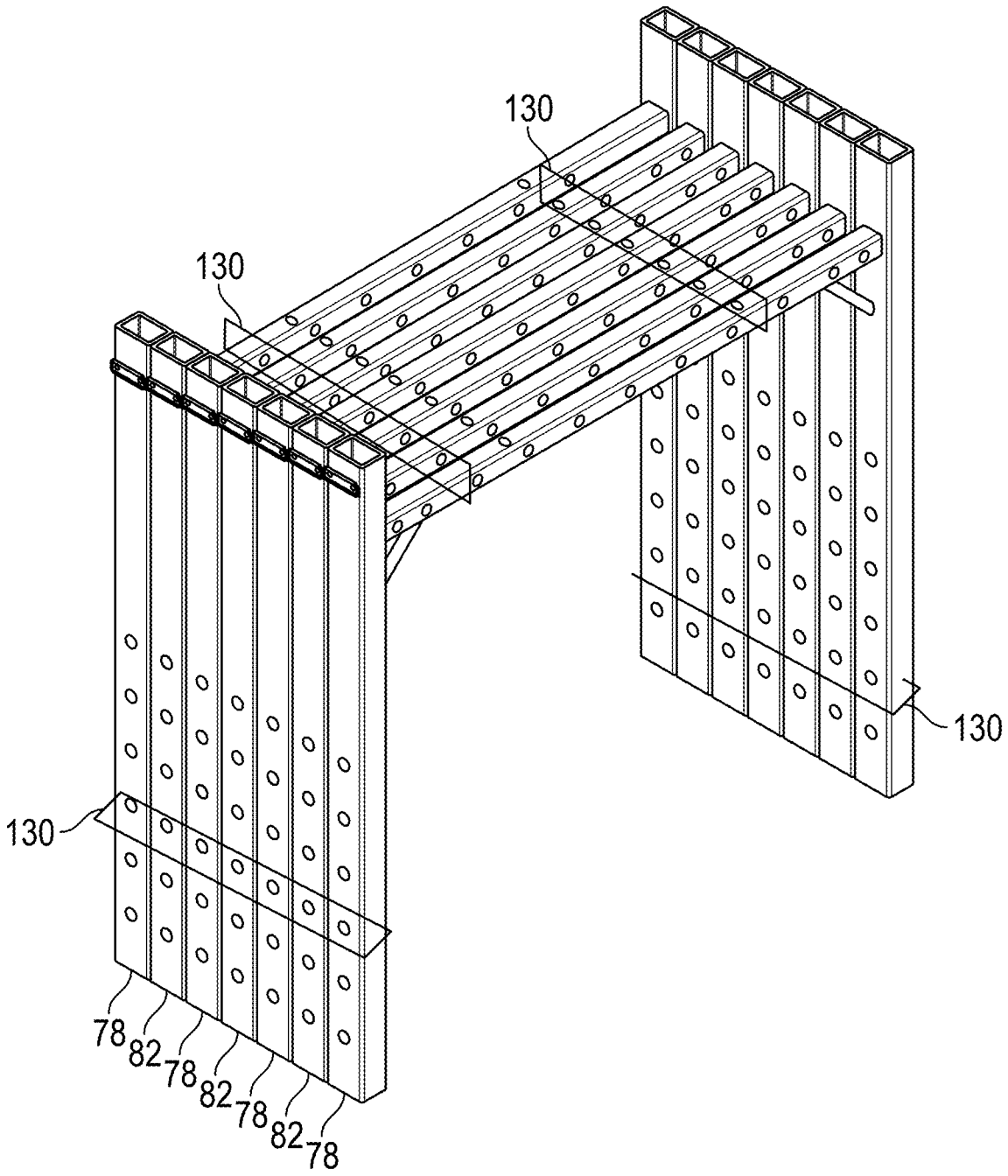
FIG. 40 is a perspective view of 7 end walls in a stored configuration.

FIG. 40 is a perspective view of 7 end walls 78, 82 in a stored configuration. The lines and shapes 130 represent where plastic packing straps may be placed to secure the end walls 78, 82. The instruction states: "9. Connect 7 End Walls assemblies in one kit with plastic packing straps. Make 2 such assemblies."

Figure 41:
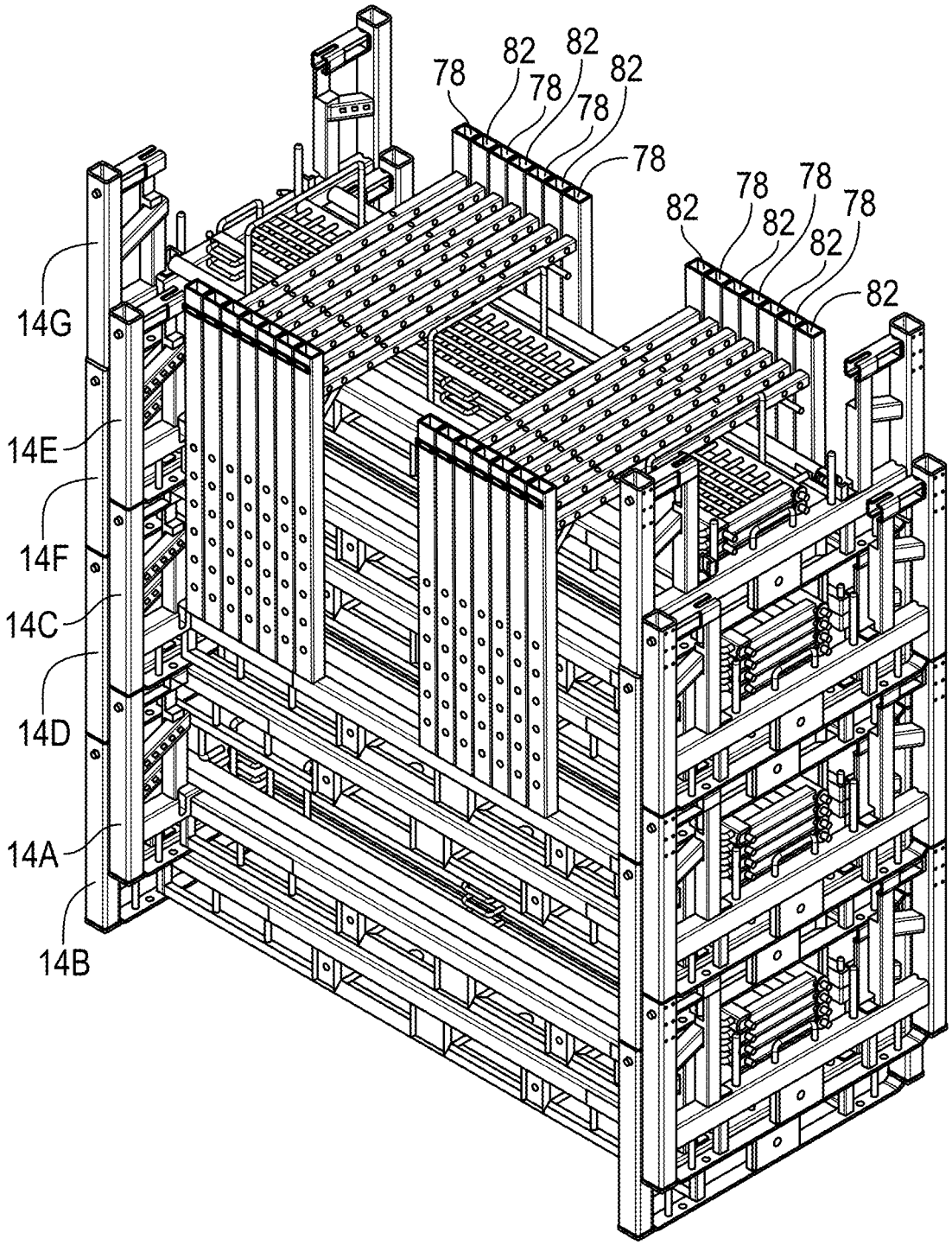
FIG. 41 is a perspective view of the bottom frames from FIG. 39.

FIG. 41 is a perspective view of the bottom frames 14A-14*g* from FIG. 39, with the two sets of 7 end walls 78,82 stacked on the bottom frames 14A-14*g*. The instructions state: "10. Install End Wall assemblies on top."

Figure 42:
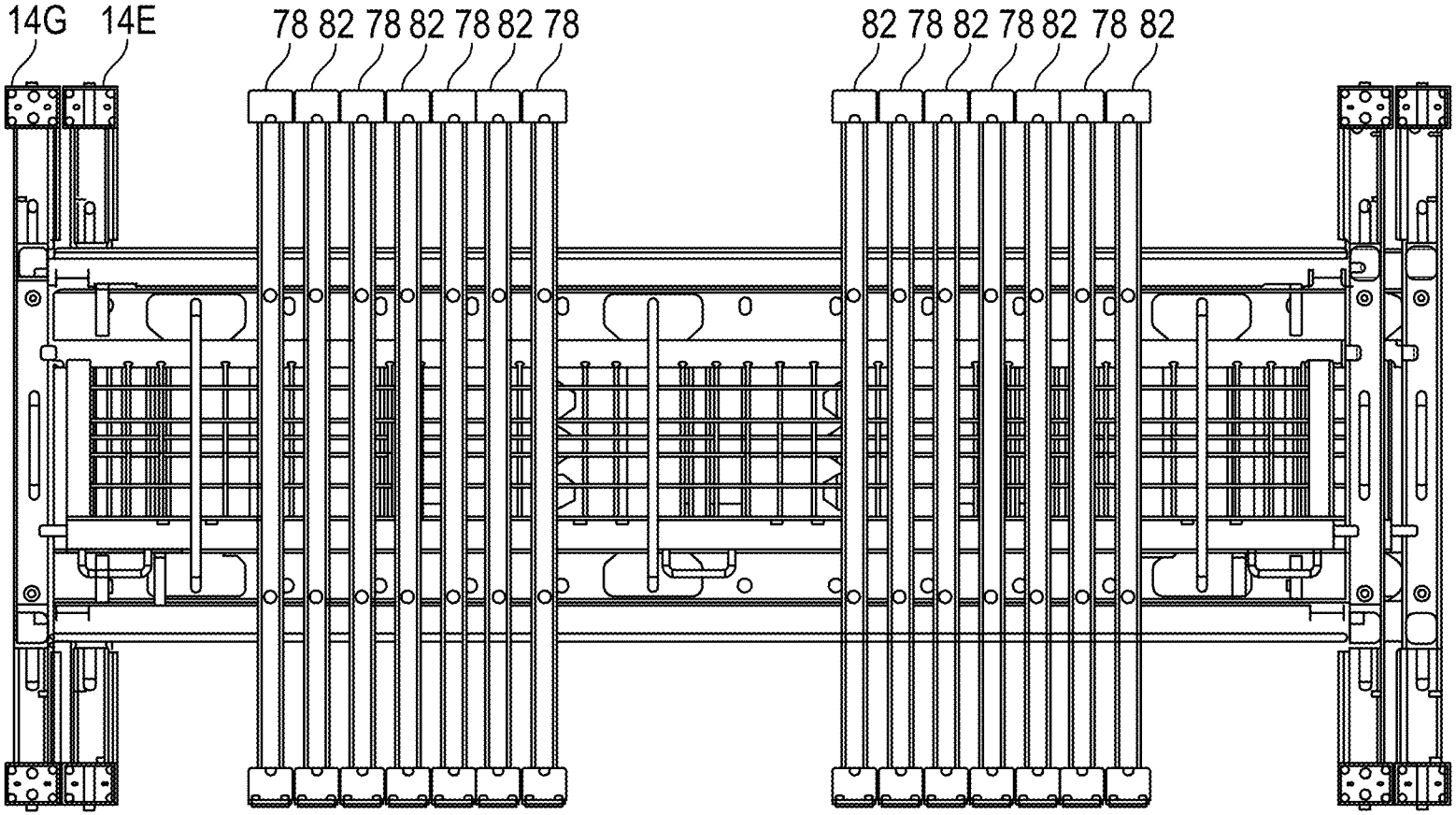
FIG. 42 is a top view of the frames and end walls from FIG. 41.

FIG. 42 is a top view of the frames 14A-14G and end walls 78,82 from FIG. 41.

Figure 43:
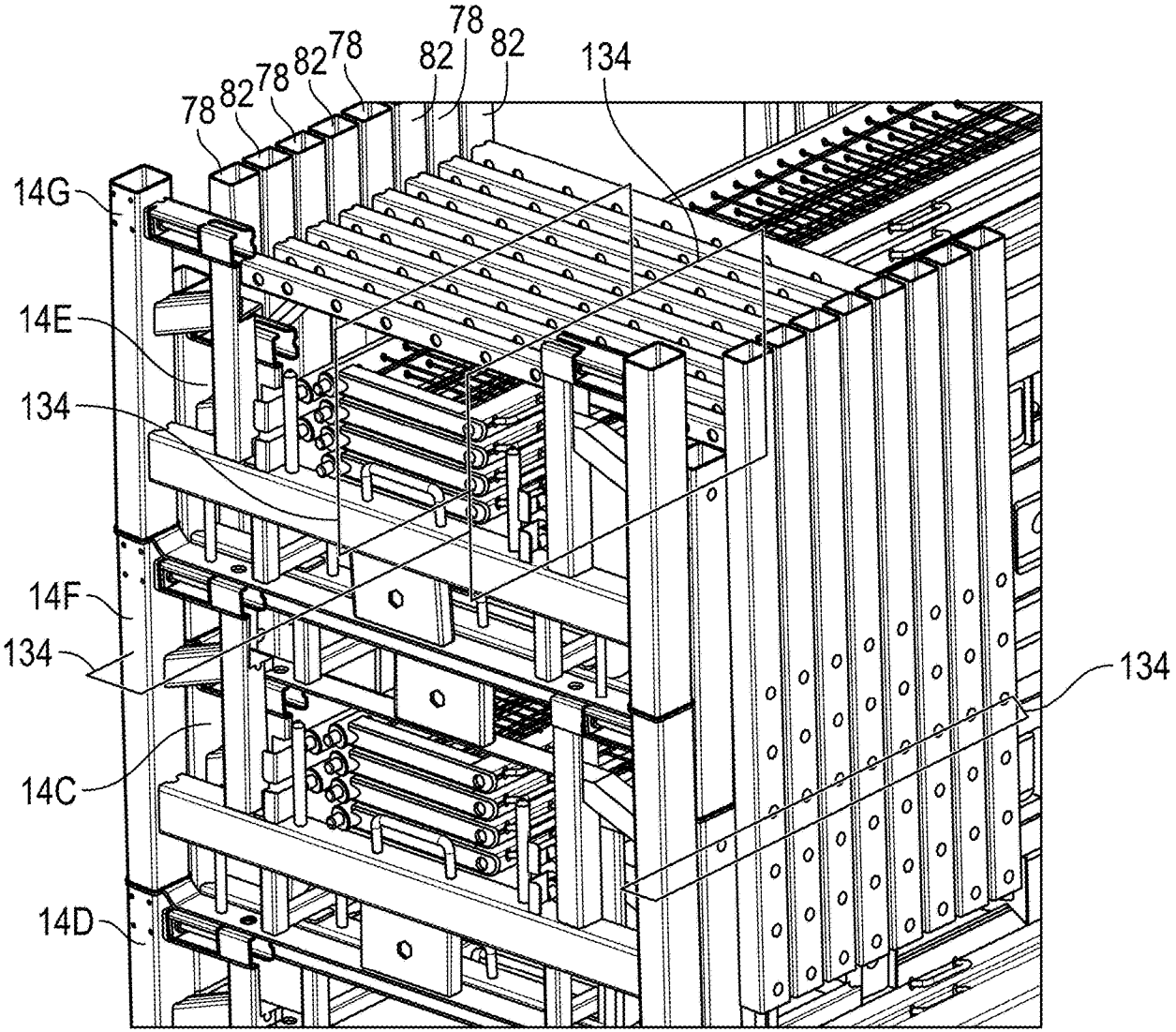
FIG. 43 is a close up view of the bottom frames and end walls from FIG. 41.

FIG. 43 is a close up view of the bottom frames 14A-14G and end walls 78,82 from FIG. 41. The lines 134 and shapes 134 indicate where plastic packing straps may be applied to the bottom frames 14A-14G and end walls 78,82 to secure them. The instructions state: "11. Connect End Wall assemblies with Frames using plastic packing straps.".

Figure 44:
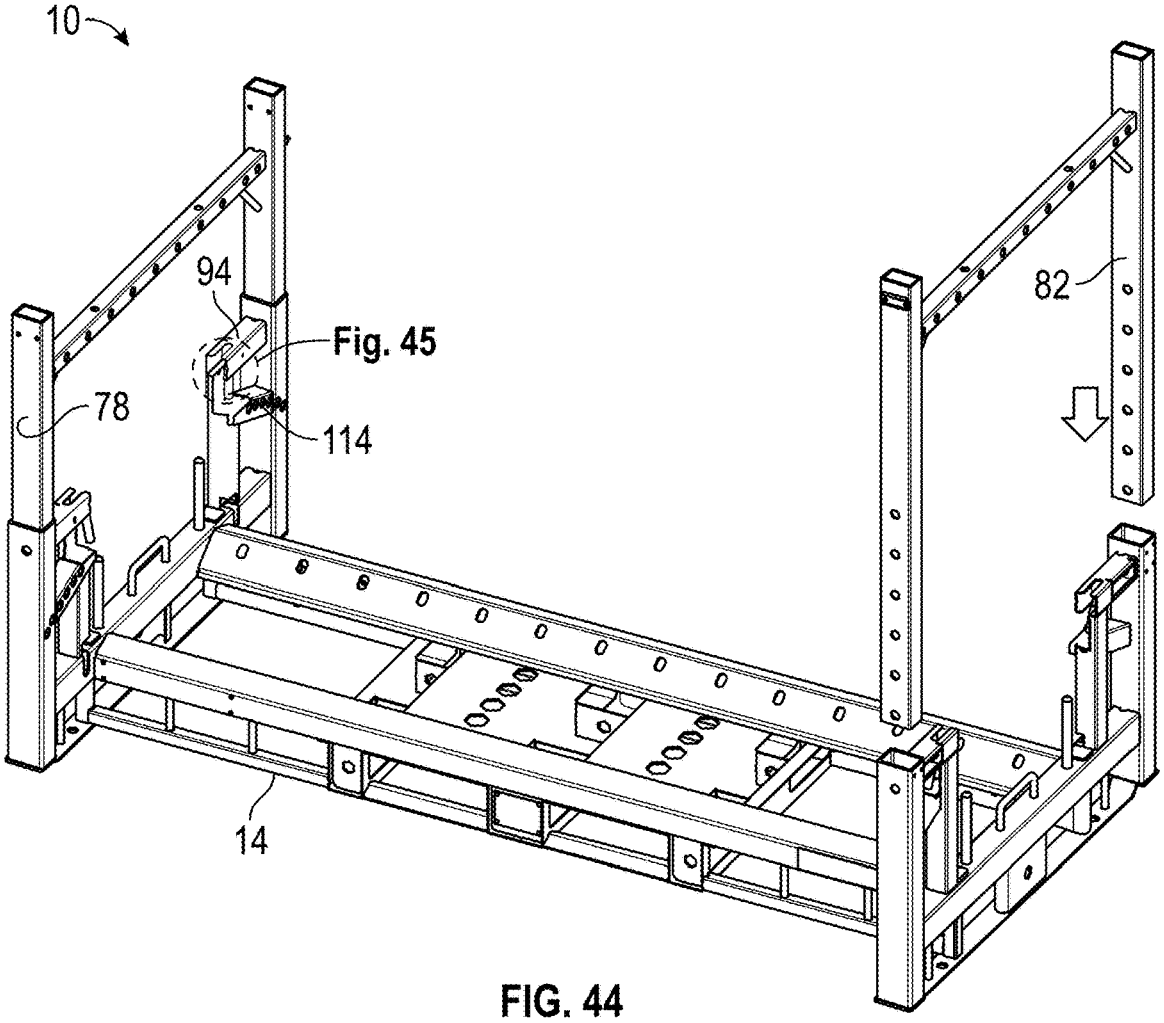
FIG. 44 shows a perspective view of an intermodal container being assembled.

FIGS. 44 through 51 are instructions on how to assemble the intermodal container 10. FIG. 44 shows a perspective view of an intermodal container 10 being assembled. FIG. 44 shows a bottom frame a bottom frame 14 with a first side end wall 78 installed into the bottom frame 14. The second side end wall 82 is shown above the bottom frame 14, ready to be installed into the bottom frame 14. The instructions state: "1. Open all locks. 2. Slide in End Walls and close locks."

Figure 45:
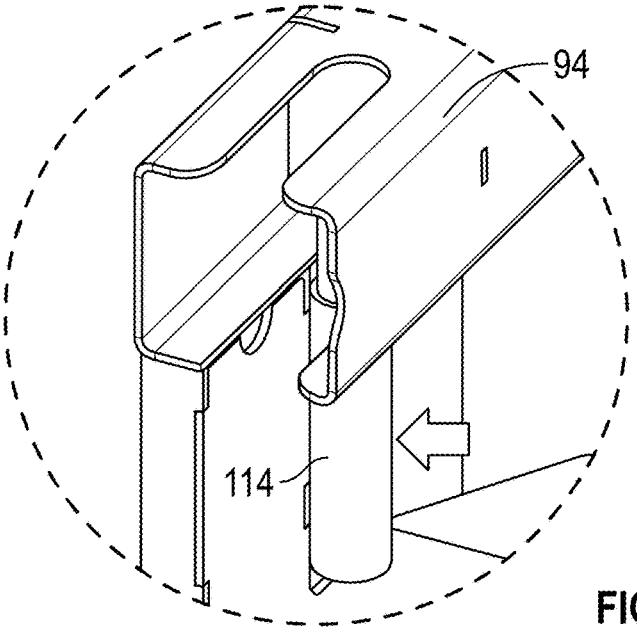
FIG. 45 is a detail view of a horizontal member and lock bar from FIG. 44.

FIG. 45 is a detail view of a horizontal member 94 and lock bar 114 from FIG. 44. The lock bar 114 is shown in a locked configuration in this embodiment.

Figure 46:
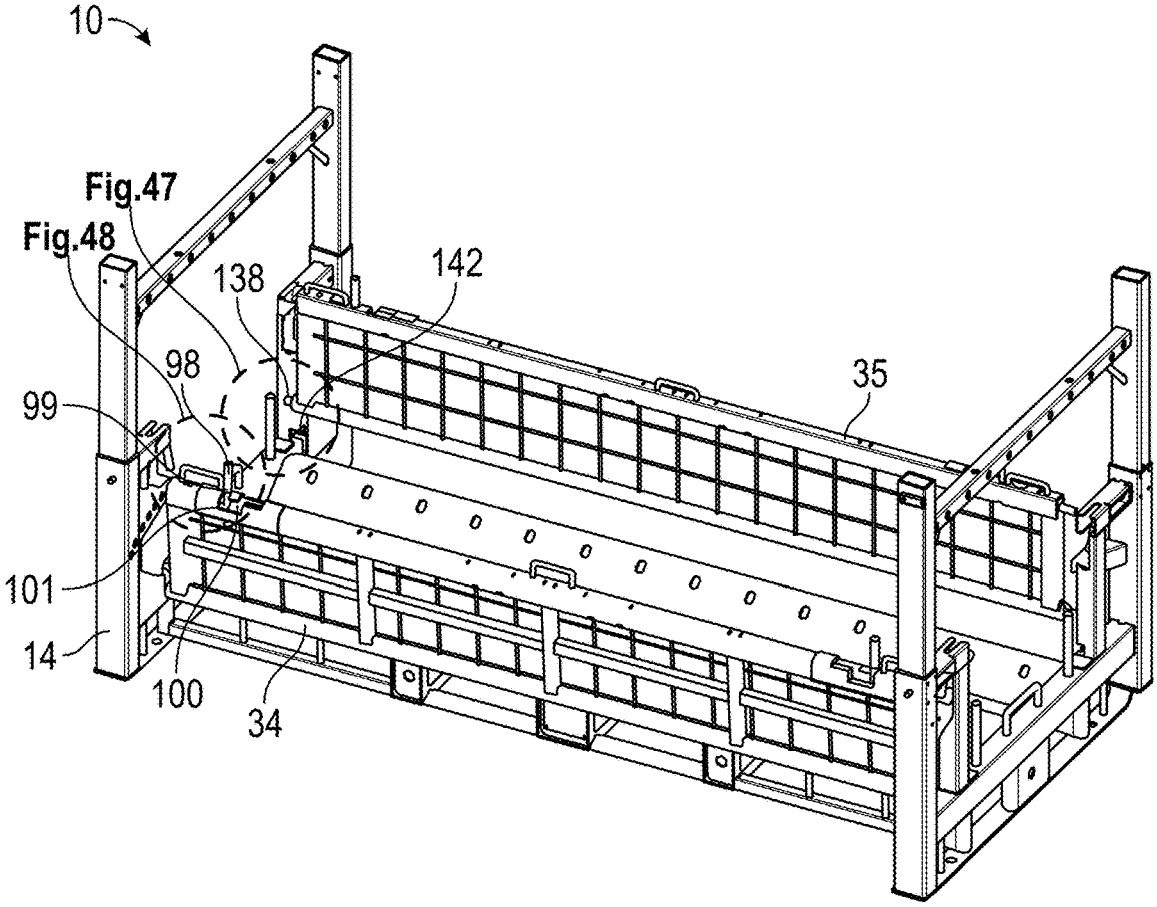
FIG. 46 is a perspective view of the bottom frame from FIG. 44.

FIG. 46 is a perspective view of the bottom frame 14 from FIG. 44, with the front gate 34 installed and the rear gate 35 in the process being installed. The instructions state: "3. Insert Front Gates in slots on the bottom first, then close locks."

Figure 47:
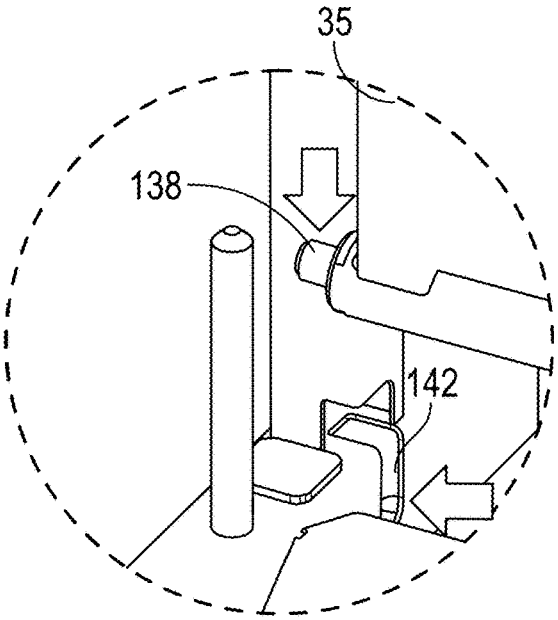
FIG. 47 is a detail from FIG. 46.

FIG. 47 is a detail from FIG. 46 showing the details of a bottom pin 138 located along the bottom of the rear gate 35. The pin 138 is configured to slide into a slot 142 located in the bottom frame 14. There is a pin 138 and slot 142 located on the opposite of the gate 35 and bottom frame 14 respectively. The pin 138 is configured to allow the rear gate 35 to rotate with respect to the bottom frame 14.

Figure 48:
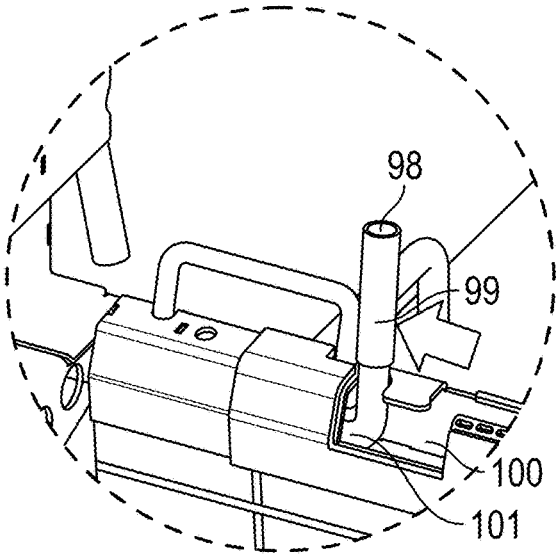
FIG. 48 is a detail view of the slot and pin attachment means.

FIG. 48 is a detail view of the slot and pin attachment means 98 from FIG. 46. The slot and pin attachment means 98 comprise a user handle 99, a slot 100, and a pin 101.

Figure 49:
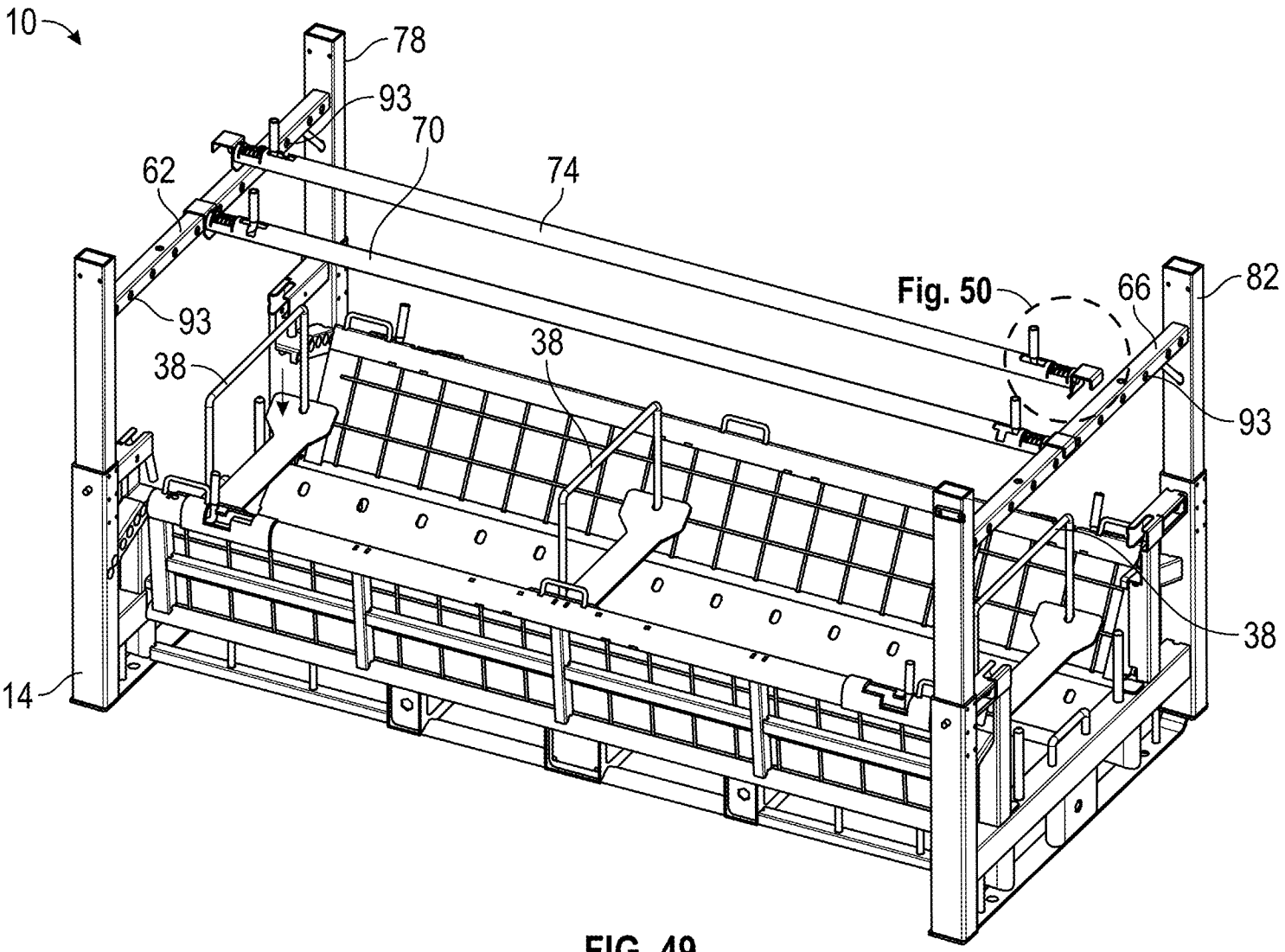
FIG. 49 is a perspective view of a bottom frame with the first vertical limiting top member installed on the first side end wall and second side end wall.

FIG. 49 is a perspective view of a bottom frame with the first vertical limiting top member 70 installed on the first side end wall 78 and second side end wall 82. The second vertical limiting top member 74 is shown int eh process of being installed on the first side end wall 78 and second side end wall 82. Additionally, the divider walls 38 are shown in the process of being installed on the bottom frame 14. The instructions state: "4. Insert Vertical Limiting Top Members and close locks. 5. Divider Walls must be installed before the wheels."

Figure 50:
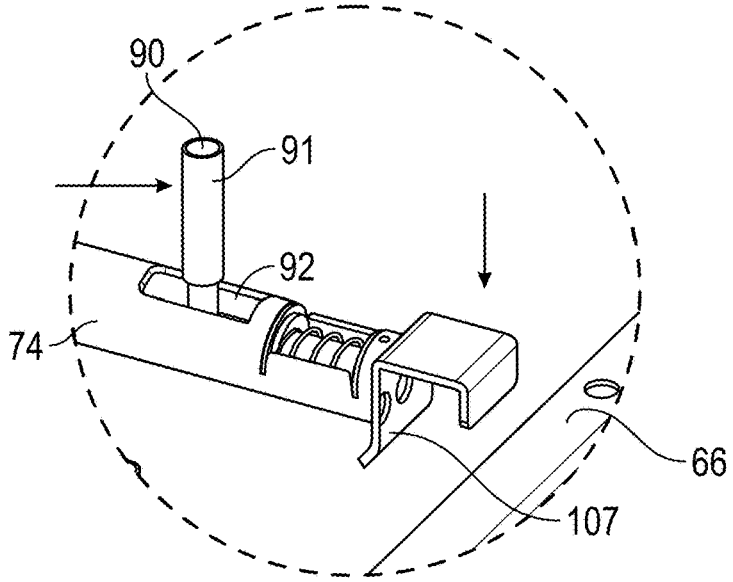
FIG. 50 is a detail view of the spring loaded pin attachment means.

FIG. 50 is a detail view of the spring loaded pin attachment means 90 configured to attach the second vertical limiting top member 74 to the second side rail 66. The spring loaded pin attachment means 90 comprises a user handle 91, a slot 92, a pin 107, and holes 93 located in the second side rail 66. The holes 93 are configured to receive a pin 107 to lock the second vertical limiting top member 74 with respect to the second side rail 66.

Figure 51:
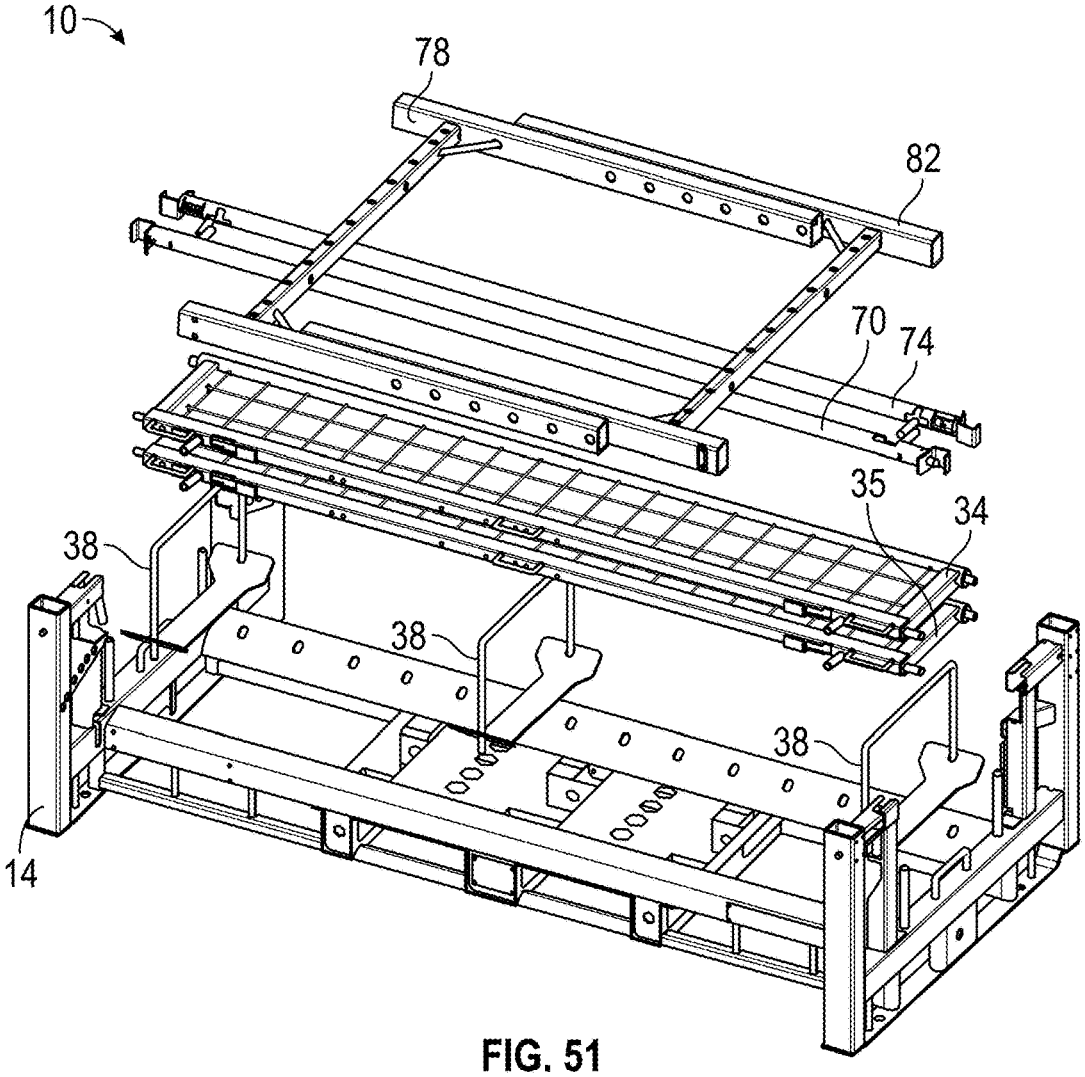
FIG. 51 is perspective view of the cage in an exploded view.

FIG. 51 is perspective view of the cage 10 in an exploded view showing one embodiment of how the cage may be packed for shipping or storage.

Figure 52:
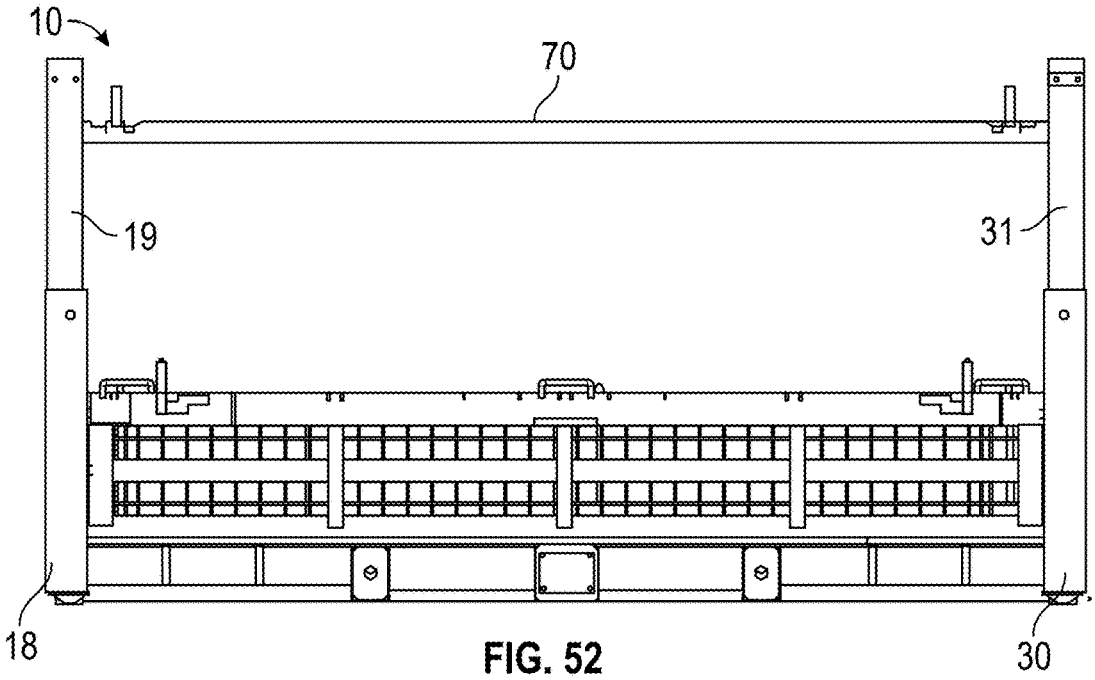
FIG. 52 is a front view of the cage in a high profile configuration.

FIG. 52 is a front view of the cage 10 in a high profile configuration, that is with side rails 62, 66 at their highest positions.

Figure 53:
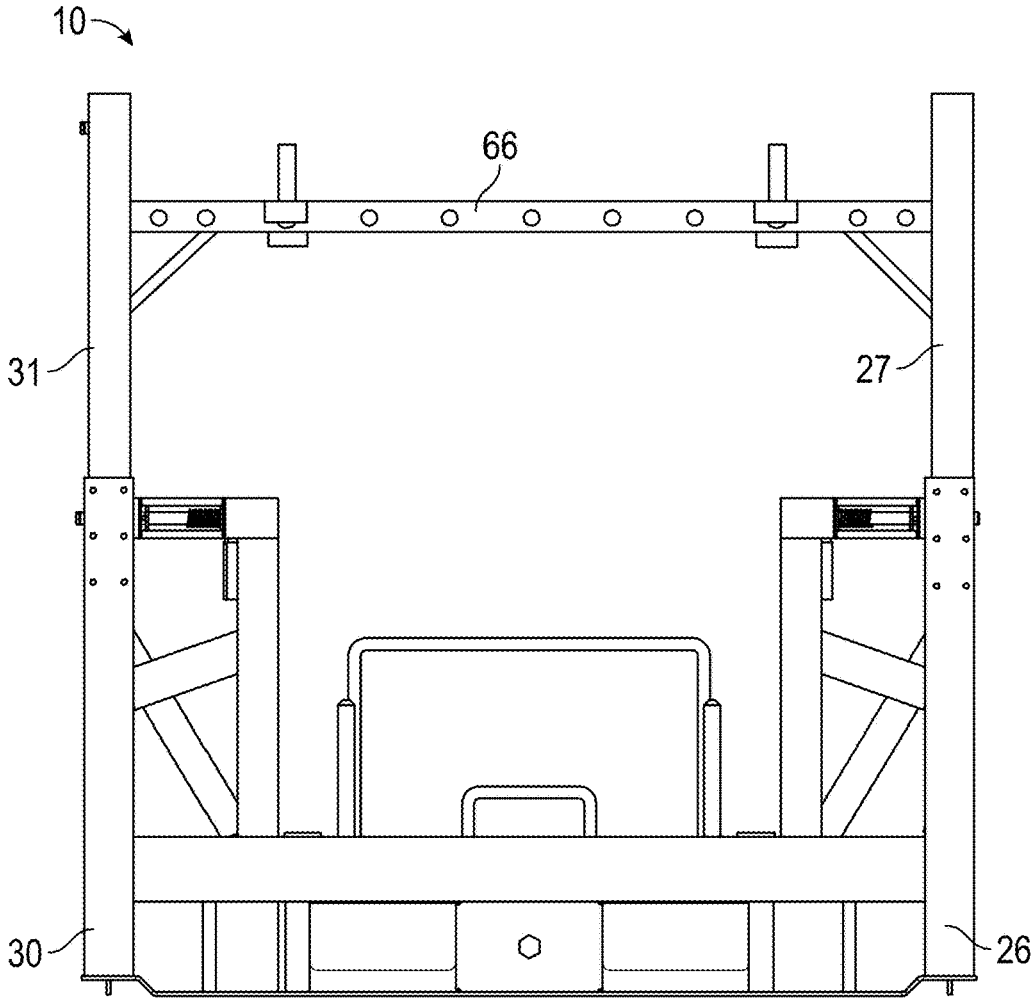
FIG. 53 is a side view of the cage from FIG. 52.

FIG. 53 is a side view of the cage 10 from FIG. 52.

Figure 54:
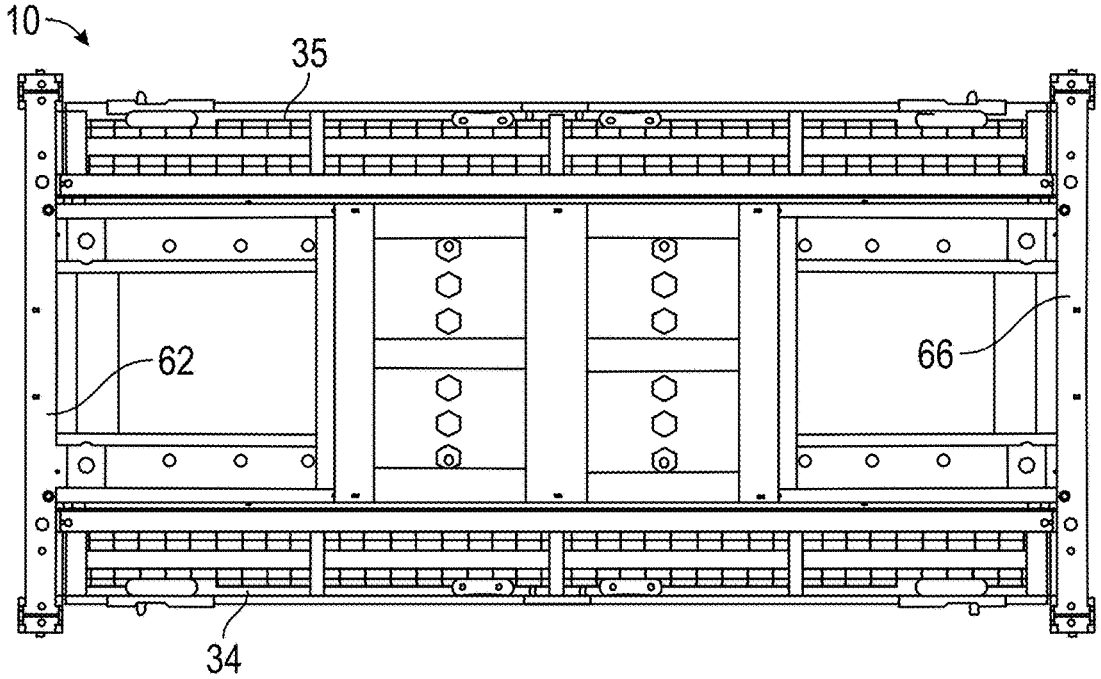
FIG. 54 is a top view of the cage from FIG. 52.

FIG. 54 is a top view of the cage 10 from FIG. 52.

Figure 55:
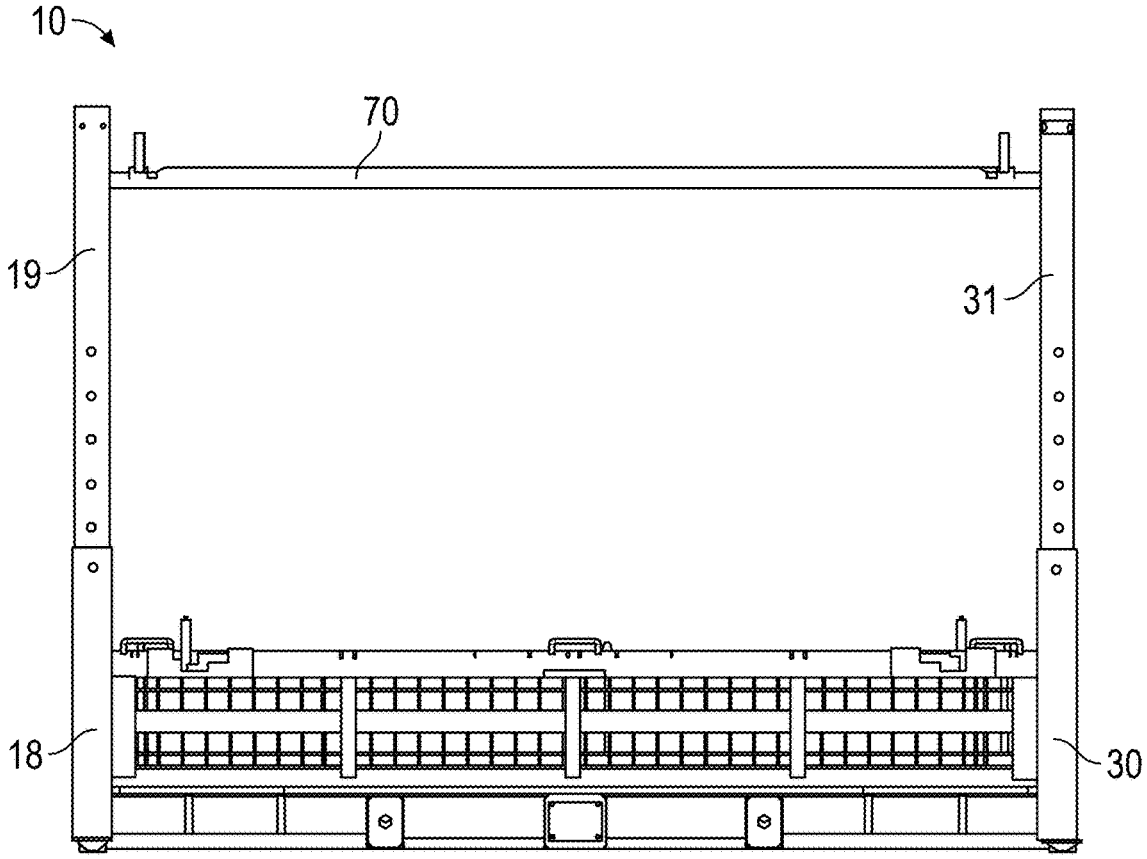
FIG. 55 is a front view of the cage in a high profile configuration.

FIG. 55 is a front view of the cage 10 in a high profile configuration, that is with side rails 62, 66 at their highest positions.

Figure 56:
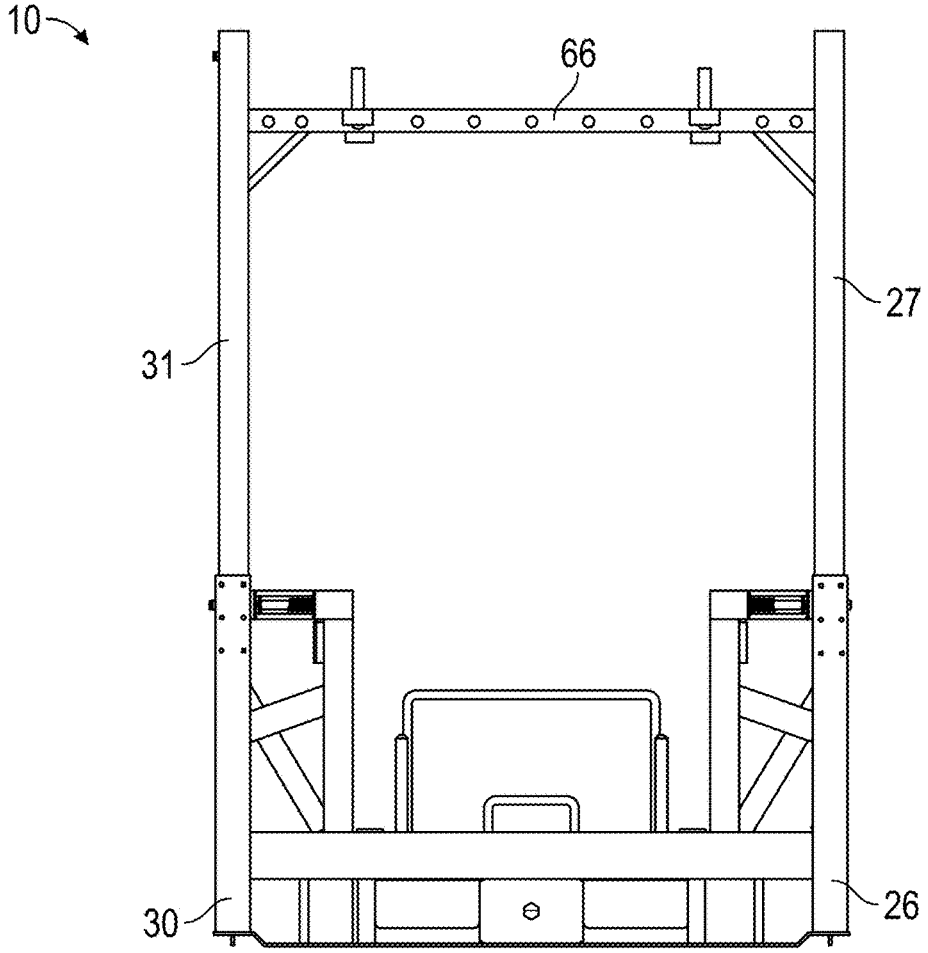
FIG. 56 is a side view of the cage from FIG. 55.

FIG. 56 is a side view of the cage 10 from FIG. 55.

Figure 57:
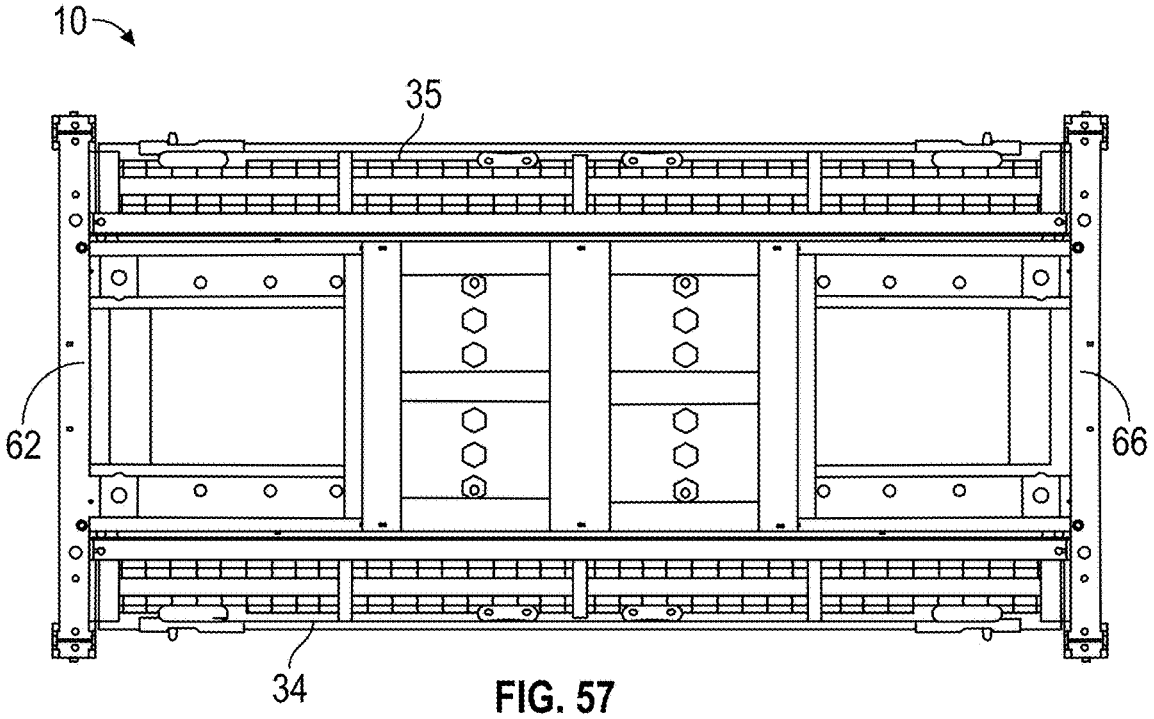
FIG. 57 is a top view of the cage from FIG. 55.

FIG. 57 is a top view of the cage 10 from FIG. 55.

Figure 58:
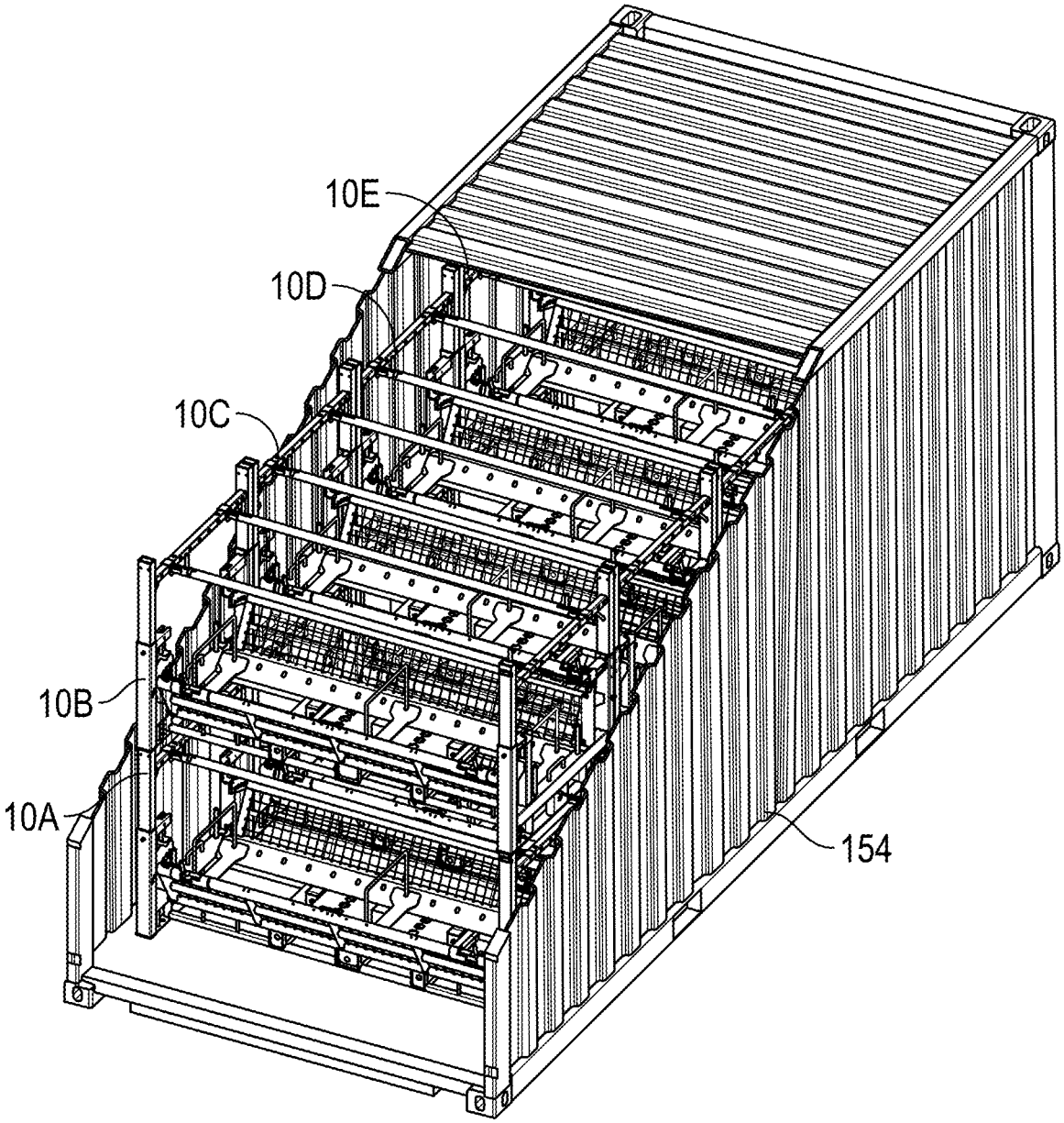
FIG. 58 shows several cages assembled and loaded onto a 20 foot container.

FIG. 58 shows several cages 10A, 10B, 10C, 10D, 10E assembled and loaded onto a 20 foot container 154.

Figure 59:
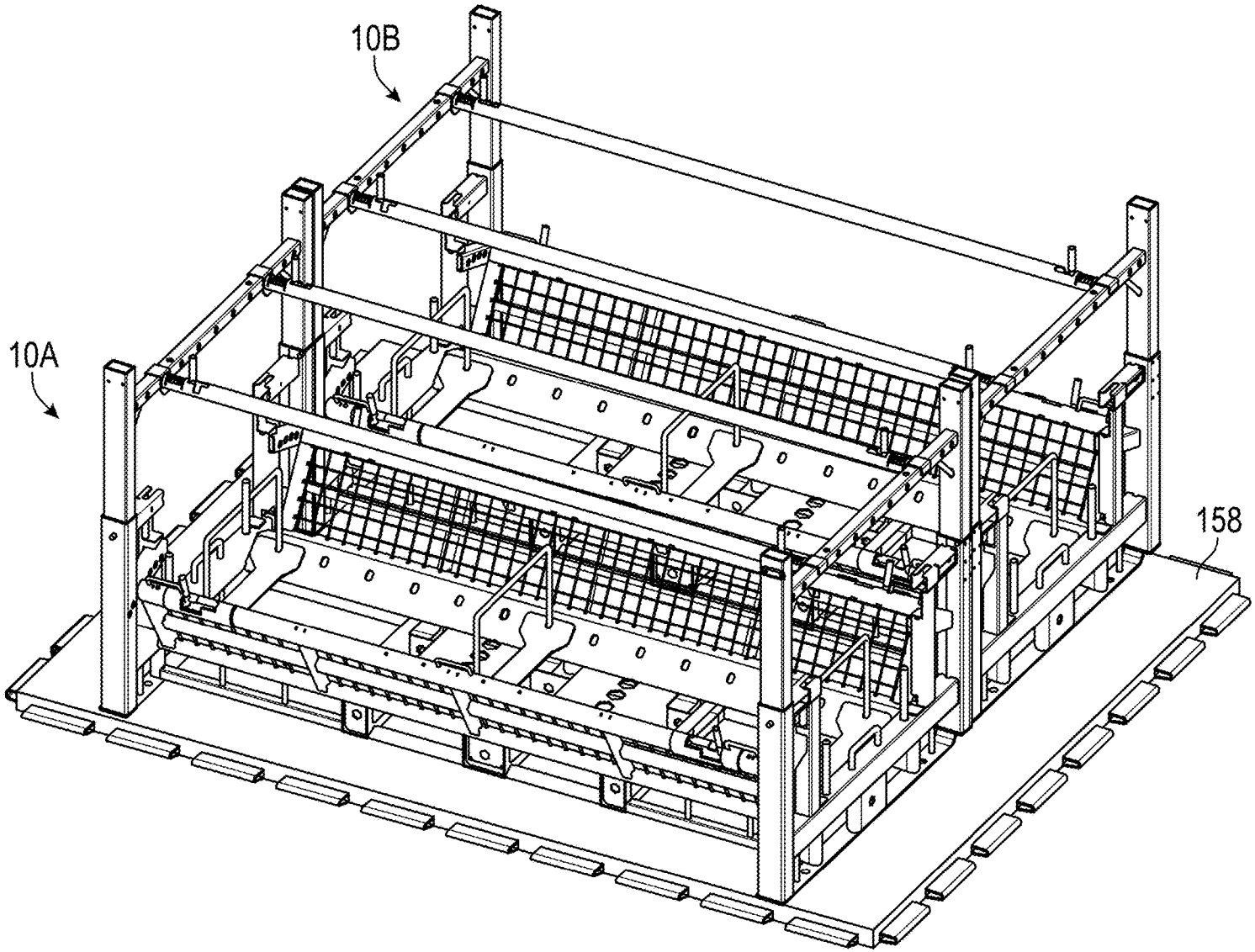
FIG. 59 shows two intermodal containers loaded on a 463L pallet.

FIG. 59 shows two intermodal containers 10A and 10B loaded on a 463L pallet 158.

Figure 60:
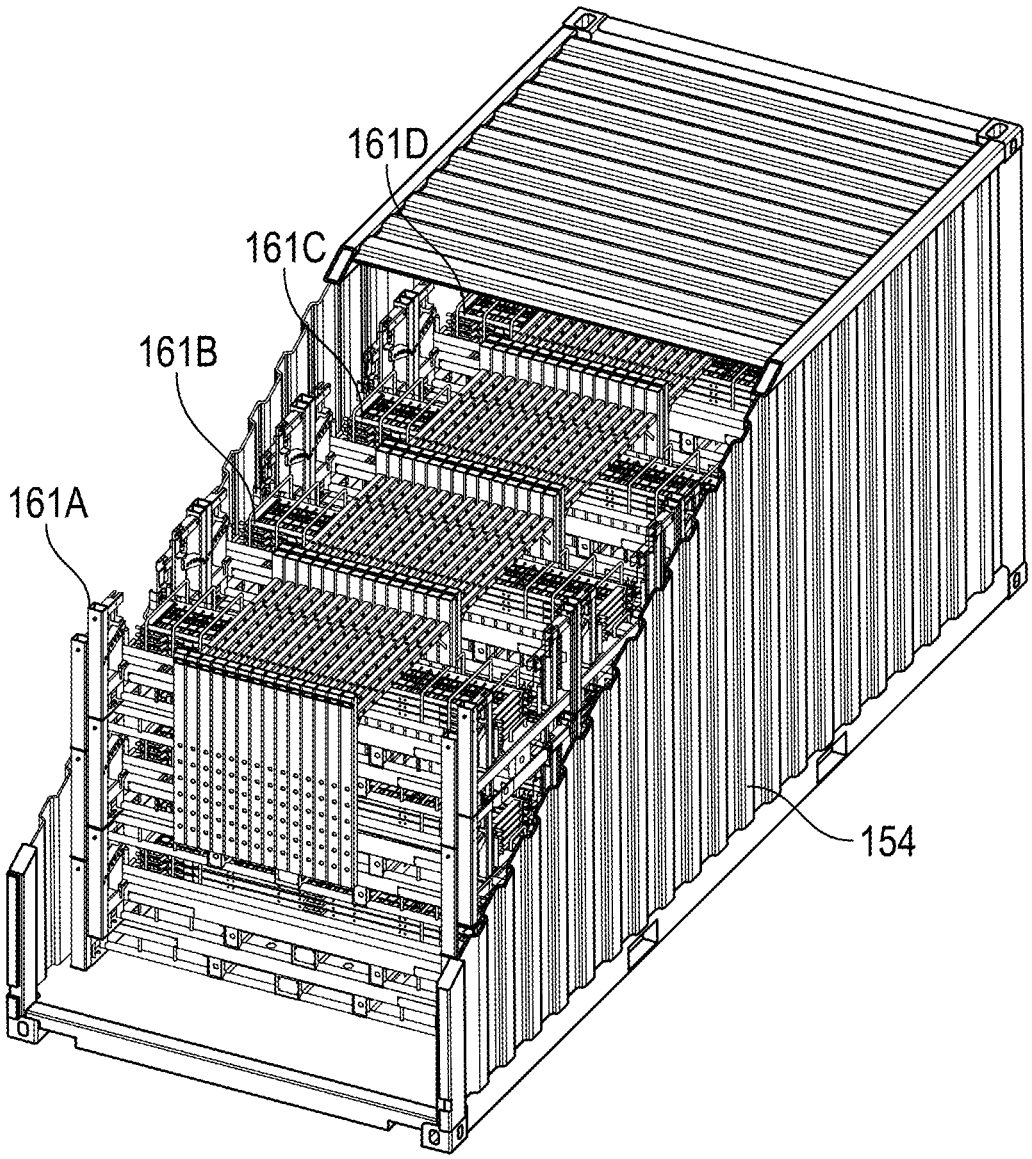
FIG. 60 shows 4 stacks of 6 disassembled cages loaded into a 20 foot container.
Figure 66:
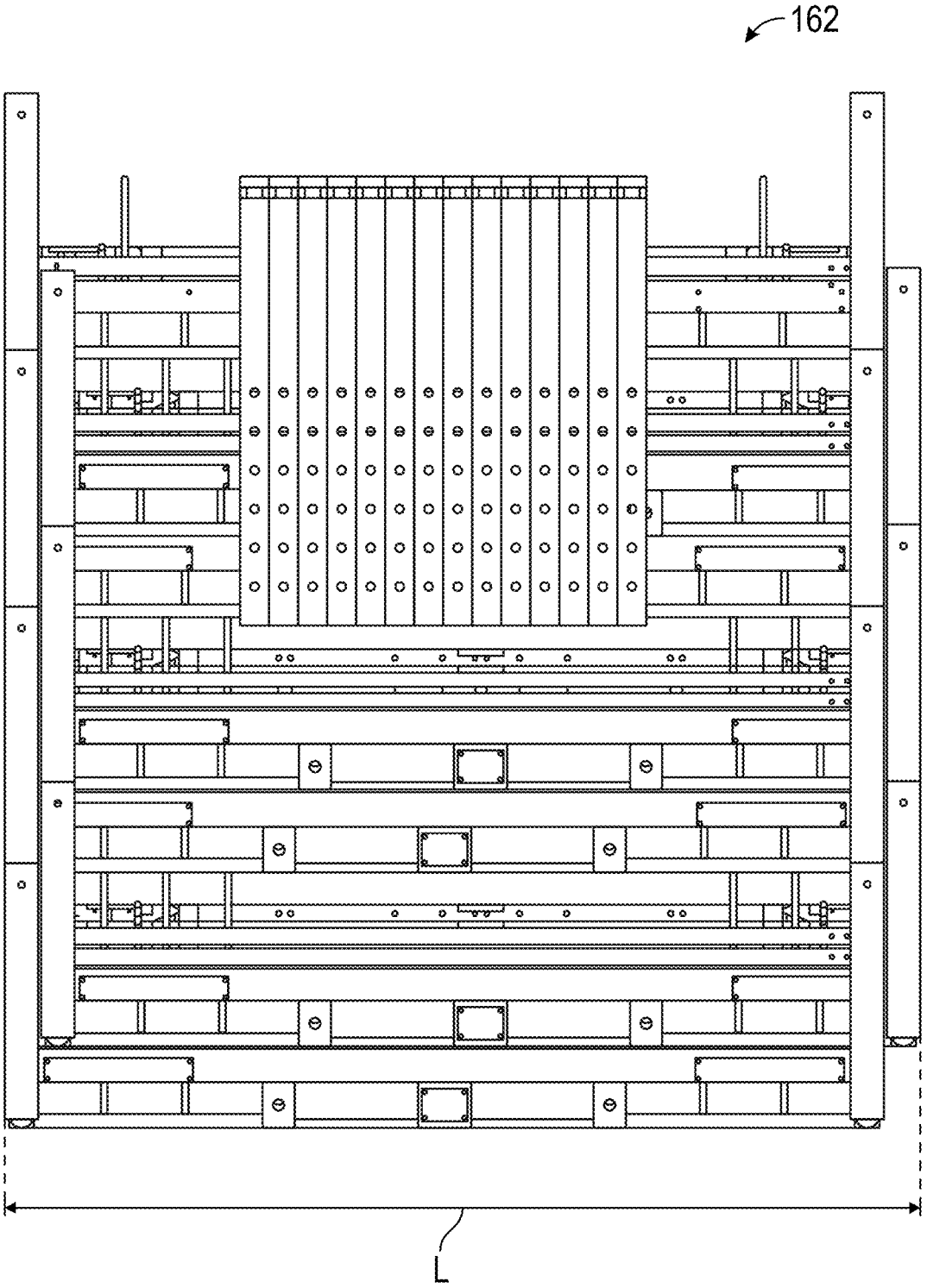
FIG. 66 shows a front view of 7 disassembled cages in a stack.
Figure 67:
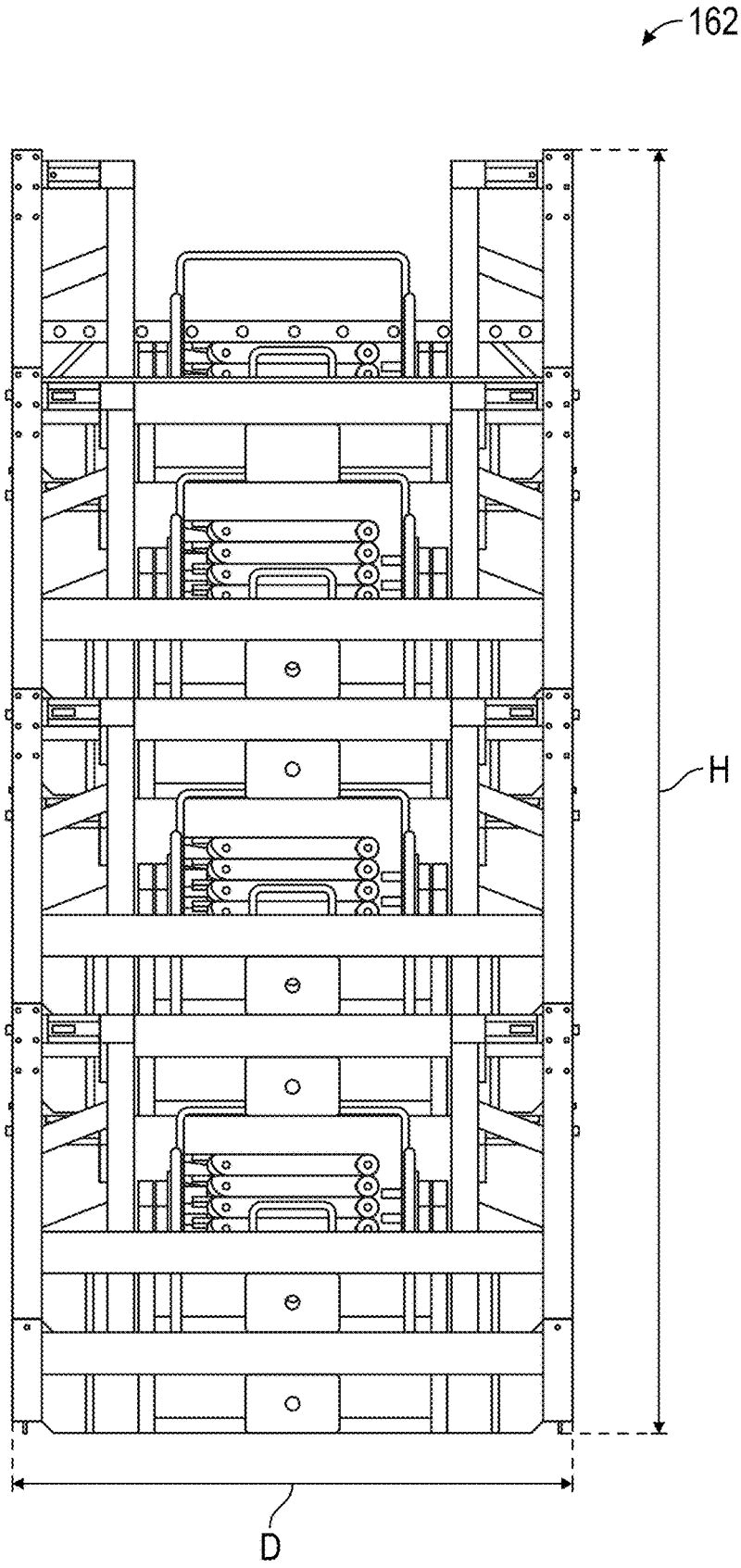
FIG. 67 shows a side view of the stack from FIG. 66.

FIG. 60 shows 4 stacks 161A, 161B, 161C, 161D of 6 disassembled cages loaded into a 20 foot container 154. Each stack 161 of 6 disassembled cages will also have a height, length and depth similar to what is shown in FIGS. 66 and 67. In one embodiment, the stack 161 may have the following dimensions: height about 82 inches; length about 87 inches, depth about 43 inches.

Figure 61:
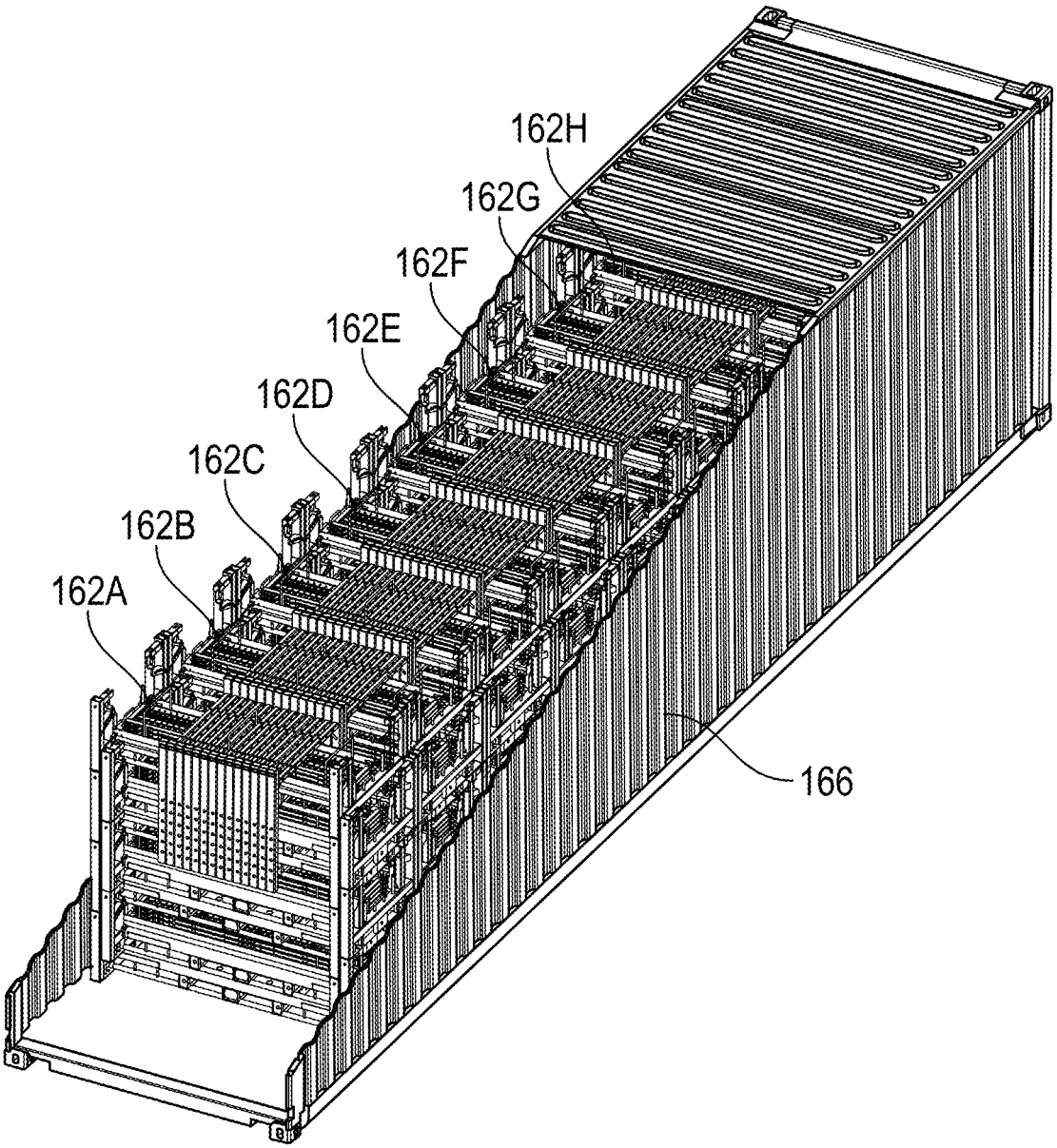
FIG. 61 shows 8 stacks of 7 disassembled cages loaded into a 40 foot HC container.

FIG. 61 shows 8 stacks 162A, 162B, 162C, 162D, 162E, 162F, 162G, 162H of 7 disassembled cages loaded into a 40 foot HC container 166.

Figure 62:
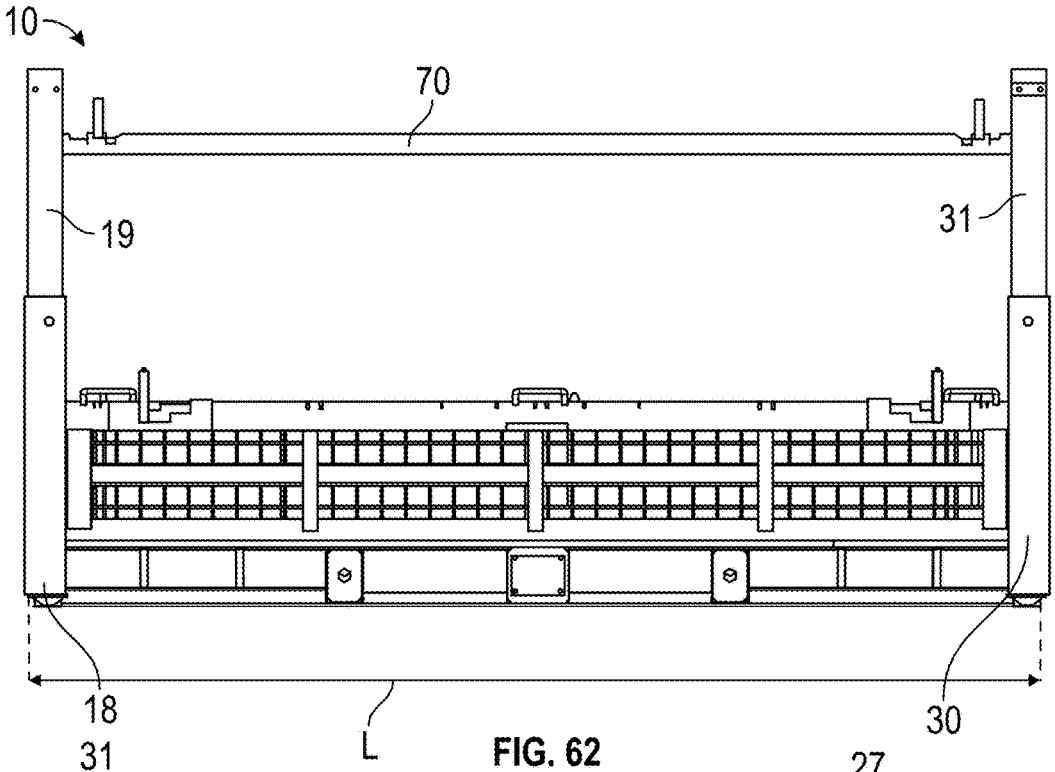
FIG. 62 shows a front view of an intermodal container when assembled in a low profile configuration.

FIG. 62 shows a front view of an intermodal container 10 when assembled in a low profile configuration (with the side rails 62, 66 at their lowest positions) with a length L.

Figure 63:
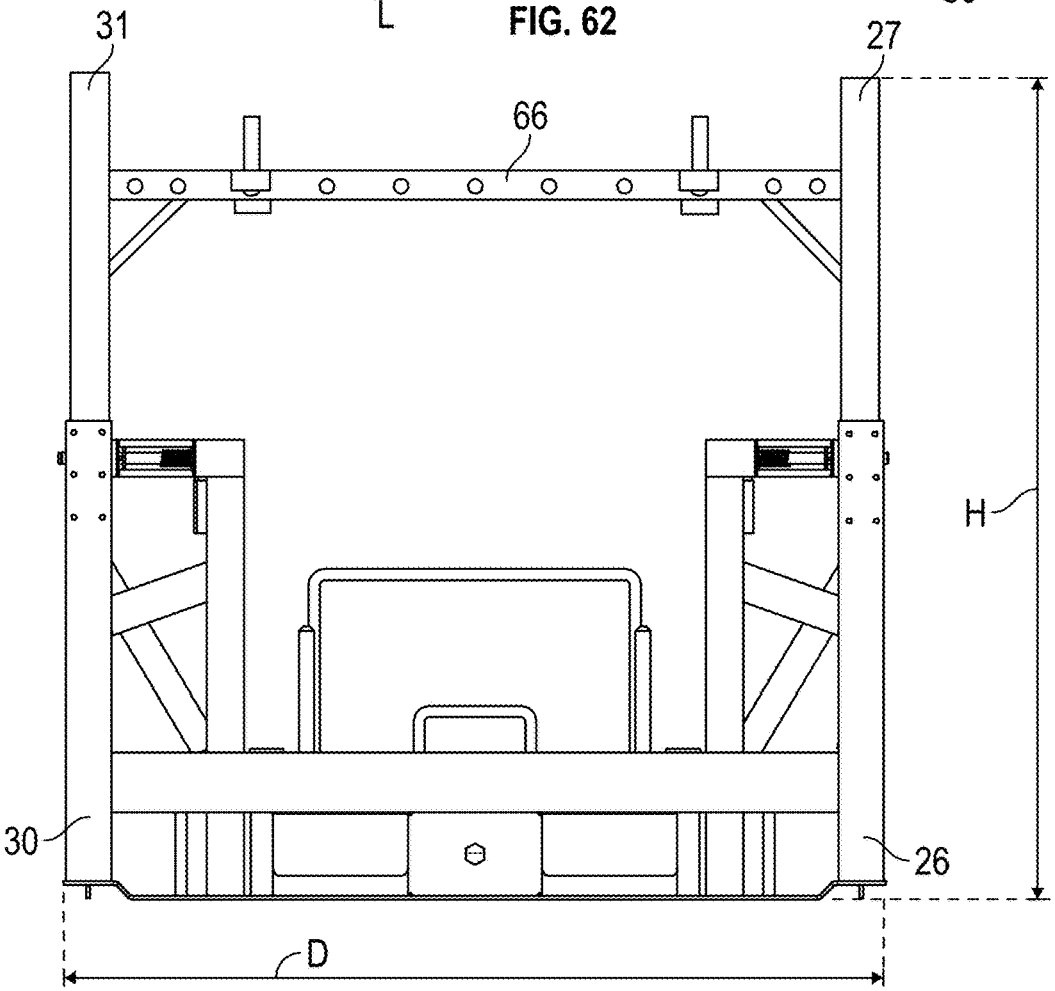
FIG. 63 shows a side view of the intermodal container from FIG. 62.

FIG. 63 shows a side view of the intermodal container 10 from FIG. 62, with a height H and a depth D. The intermodal container of FIGS. 62 and 63 may have the following dimensions: height about 44 inches; length about 84 inches, depth about 43 inches.

Figure 64:
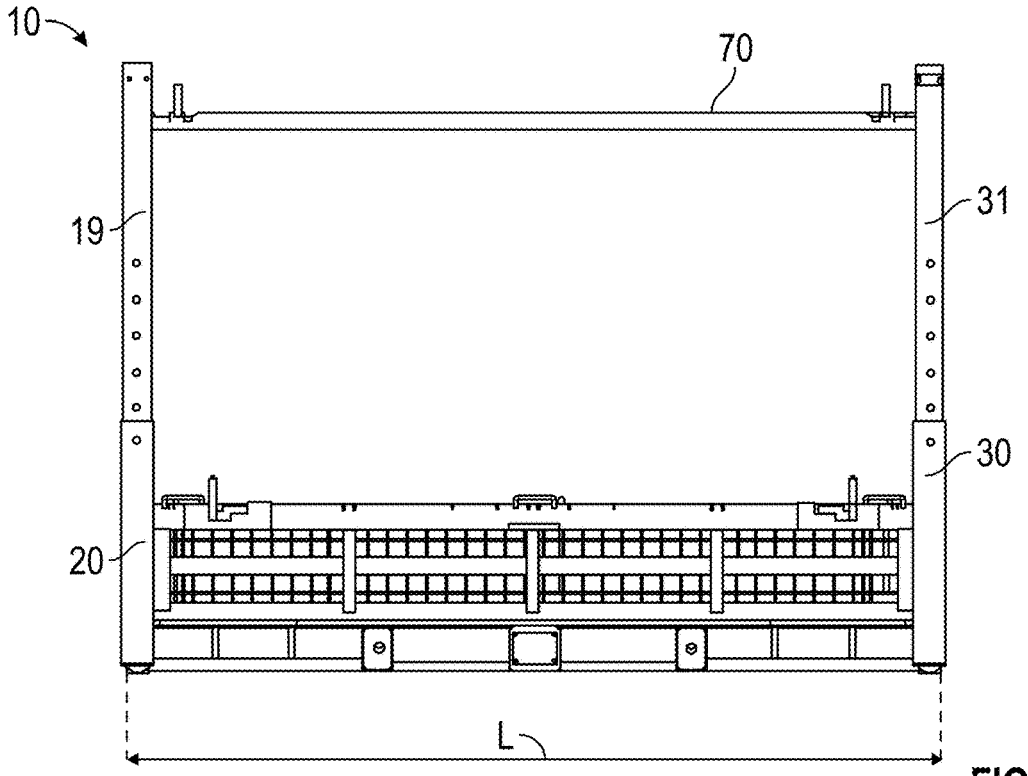
FIG. 64 shows a front view of an intermodal container when assembled in a high profile configuration.

FIG. 64 shows a front view of an intermodal container 10 when assembled in a high profile configuration (with the side rails 62, 66 at their highest positions) with a length L.

Figure 65:
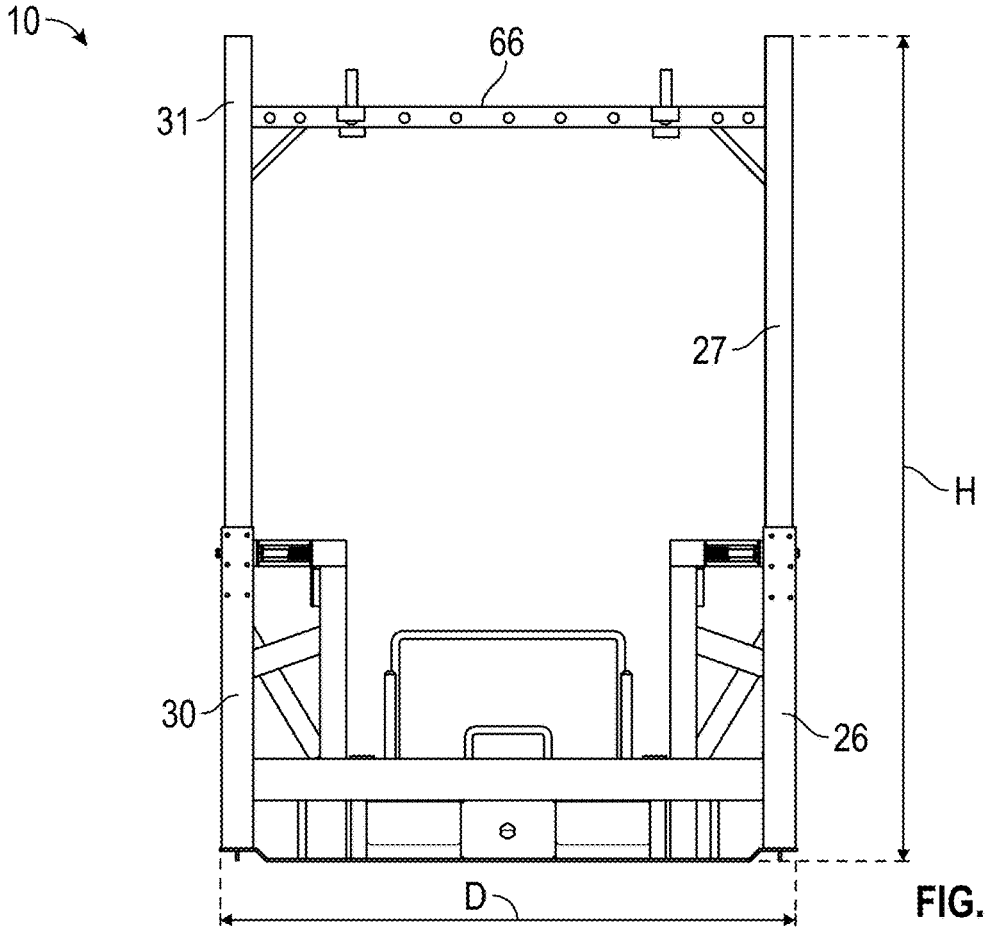
FIG. 65 shows a side view of the intermodal container from FIG. 64.

FIG. 65 shows a side view of the intermodal container 10 from FIG. 64 with a height H and a depth D. The intermodal container of FIGS. 64 and 65 may have the following dimensions: height about 62 inches; length about 84 inches, depth about 43 inches.

FIG. 66 shows a front view of 7 disassembled cages in a stack 162. The stack 162 has a length L.

FIG. 67 shows a side view of the stack 162 from FIG. 66. The stack 162 has a depth D and height H. In one embodiment, the stack 162 may have the following dimensions: height about 98 inches; length about 87 inches, depth about 43 inches.

With respect to 7 disassembled cages stacked for transport, in one embodiment, they will generally fit in 40 ft high cube (HC) (height slightly bigger than in standard container). With respect to standard 40 ft and 20 ft containers, disassembling 6 cages and stacking the pieces in a stack will generally fit. For reference, the dimensions of 40 ft HC container are: door opening 92"×102" (width×height); internal dimensions—92"×106"×474" (width×height×depth); the dimensions of 40 ft container are: door opening 92"×90" (width×height); internal dimensions—92"×93"×474" (width×height×depth); and the dimensions of 20 ft container are: door opening 92"×90" (width×height); internal dimensions—92"×93"×231" (width×height×depth).

This invention has many advantages. It is easy to get wheels in and out of the intermodal container. Wheels can be secured during storage, including different sizes of wheels. Wheels can be secured during transportation. When not completely filling up the intermodal container from side to side, the wheels are secured sideways by a removable divider. The intermodal container can be stored in a smaller volume when disassembled, enabling more efficient transport and storage when not in use. The wheels may be secured by a gate. The intermodal container gate can be operated without standing in front of where the wheels roll out, reducing risk of unintended movement of the wheels when opening the gate. The intermodal container has fewer beams, leaving only structure where it is needed for the storing the wheels hence reduce weight and cost.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. An intermodal container comprising:

a bottom frame;

a first side end wall configured to slide into a first side of the bottom frame, the first side end wall is height adjustable with respect to the bottom frame;

a second side end wall configured to slide into a second side of the bottom frame, the second side opposite of the first side, the second side end wall is height adjustable with respect to the bottom frame;

a first vertical limiting member configured to attach to the top of the first side end wall and the second side end wall;

wherein the intermodal container is configured to store, transport, and secure items; and wherein the first vertical limiting member is configured to limit items from moving in a vertical direction.

2. The intermodal container of claim 1 further comprising:

a second vertical limiting member configured to attach to the top of the first side end wall and the second side end wall; and wherein the second vertical limiting member is configured to limit items from moving in a vertical direction.

3. The intermodal container of claim 1, further comprising:

a divider wall configured to attach to the bottom frame between the first side end wall and the second side end wall, and the divider wall is further configured to prevent items from moving side to side in the intermodal container.

4. The intermodal container of claim 1, wherein the intermodal container is configured such that seven complete intermodal containers can be disassembled and stacked such that the seven disassembled and stacked intermodal containers take up of the space of no more than two complete assembled intermodal containers.

5. The intermodal container of claim 1, wherein the bottom frame comprises:

a front bottom rail;

a first side bottom member attached to the front bottom rail;

a rear bottom rail attached to the first side bottom member;

a second side bottom member attached to the front bottom rail and rear bottom rail;

a first corner post attached to the first side bottom member;

a second corner post attached to the first side bottom member;

a third corner post attached to the second side bottom member; and a fourth corner post attached to the second side bottom member.

6. The intermodal container of claim 5, wherein the first side end wall comprises:

a first extensible member configured to slide within the first corner post;

a second extensible member configured to slide within the second corner post;

a first side rail attached to the first extensible member and the second extensible member;

wherein the second side end wall comprises:

a third extensible member configured to slide within the third corner post;

a fourth extensible member configured to slide within the fourth corner post; and a second side rail attached to the third extensible member and the fourth extensible member.

7. The intermodal container of claim 1, wherein the items are tires ranging from 28 inches to 59 inches in outer diameter, and wherein the intermodal is user adjustable to securely hold tires ranging from 28 inches to 59 inches in outer diameter.

8. The intermodal container of claim 4, wherein when seven of the intermodal containers are disassembled and stacked, they have the following dimensions: height of about 98 inches, length of about 87 inches, and depth of about 43 inches.

9. The intermodal container of claim 4, wherein when seven of the intermodal containers are disassembled and stacked, they have a stacked height of less than about 102 inches.

10. The intermodal container of claim 1, wherein the intermodal container is configured such that six complete intermodal containers can be disassembled and stacked such that the six disassembled and stacked intermodal containers take up of the space of no more than two complete assembled intermodal containers.

11. The intermodal container of claim 10, wherein when six of the intermodal containers are disassembled and stacked, they have the following dimensions: height of about 82 inches, length of about 87 inches, and depth of about 43 inches.

12. The intermodal container of claim 10, wherein when six of the intermodal containers are disassembled and stacked, they have a stacked height of less than about 102 inches.

* * * * *